US012617508B2

(12) United States Patent
Farrell, III et al.

(10) Patent No.: US 12,617,508 B2
(45) Date of Patent: May 5, 2026

(54) FRAME FOR AN UNDERWATER DRILLING ASSEMBLY

(71) Applicant: Resolve Marine Group, Inc., Ft. Lauderdale, FL (US)

(72) Inventors: Joseph E. Farrell, III, Ft. Lauderdale, FL (US); Todd G. Holtz, Katy, TX (US); Nolan B. Conway, Ft. Lauderdale, FL (US); Cody C. Kurtz, Apopka, FL (US); Petrus Maria Leonardus Van Der Sanden, Hilversum (NL); Josephus Kuijs, Lisse (NL); Peter Theo Frank Van Poppel, Haarlem (NL); Ewoud Anton Georges Goorix, Heemstede (NL); René Timotheus Gerardus Witteman, Nootdorp (NL); Jeroen Mooij, Singapore (SG)

(73) Assignee: Resolve Marine Group, Inc., Ft. Lauderdale, FL (US)

( * ) Notice: Subject to any disclaimer, the term of this patent is extended or adjusted under 35 U.S.C. 154(b) by 0 days.

(21) Appl. No.: 19/129,932

(22) PCT Filed: Nov. 17, 2023

(86) PCT No.: PCT/US2023/080325

§ 371 (c)(1),
(2) Date: May 14, 2025

(87) PCT Pub. No.: WO2024/108142

PCT Pub. Date: May 23, 2024

(65) Prior Publication Data

US 2026/0008527 A1 Jan. 8, 2026

Related U.S. Application Data

(60) Provisional application No. 63/426,591, filed on Nov. 18, 2022.

(51) Int. Cl.
*B63C 7/00* (2006.01)
*B63C 11/52* (2006.01)

(52) U.S. Cl.
CPC ..... *B63C 7/006* (2013.01); *B63C 11/52* (2013.01)

(58) Field of Classification Search
CPC ..... B63C 7/006; B63C 11/52
See application file for complete search history.

(56) References Cited

U.S. PATENT DOCUMENTS 2,937,006 A 5/1960 Thayer
3,533,478 A * 10/1970 Tissier ..... E21B 49/025 175/6

(Continued)

FOREIGN PATENT DOCUMENTS

CA 2278111 A1 1/2001
CN 1922073 A 2/2007

(Continued)

OTHER PUBLICATIONS

Search Report from Chinese Office Action in corresponding Chinese Application No. 202380086911.8 mailed on Sep. 24, 2025 (English Translation).

(Continued)

*Primary Examiner* — Kyle Armstrong
(74) *Attorney, Agent, or Firm* — K&L Gates LLP

(57) ABSTRACT

Underwater drilling assemblies and systems are disclosed. The underwater drilling assemblies and systems include drill assemblies, frames for drill assemblies, and connection flange assemblies to be fastened to a ship skin. The underwater drilling assemblies and systems further include waste cartridges and automatic air-bleed valve assemblies.

19 Claims, 33 Drawing Sheets

(56) References Cited

U.S. PATENT DOCUMENTS

| | | | | |
|---|---|---|---|---|
| 4,793,275 | A | 12/1988 | Usher | |
| 5,775,390 | A | 7/1998 | Mohn | |
| 7,308,614 | B2 * | 12/2007 | Kojori | G06F 11/24 714/E11.154 |
| 11,014,639 | B2 | 5/2021 | Farrell, III et al. | |
| 11,364,982 | B2 | 6/2022 | Farrell, III et al. | |
| 11,708,139 | B2 | 7/2023 | Farrell, III et al. | |
| 12,227,273 | B2 | 2/2025 | Farrell, III et al. | |
| 2005/0025574 | A1 | 2/2005 | Lazes | |
| 2007/0261629 | A1 | 11/2007 | Choi | |
| 2009/0014213 | A1 | 1/2009 | Haughom | |
| 2016/0138352 | A1 | 5/2016 | Leba et al. | |
| 2016/0348449 | A1 | 12/2016 | Macgregor et al. | |
| 2019/0283841 | A1 | 9/2019 | Farrell, III et al. | |
| 2020/0361573 | A1 | 11/2020 | Stacey | |

FOREIGN PATENT DOCUMENTS

| | | | |
|---|---|---|---|
| CN | 104354843 | A | 2/2015 |
| CN | 105324301 | A | 2/2016 |
| CN | 112088123 | B | 1/2023 |
| EP | 3768589 | B1 | 8/2024 |
| WO | 2012123431 | A1 | 9/2012 |
| WO | 2019182958 | A1 | 9/2019 |
| WO | 2024108142 | A1 | 5/2024 |
| WO | 2024108149 | A1 | 5/2024 |
| WO | 2024108153 | A1 | 5/2024 |
| WO | 2024108157 | A1 | 5/2024 |
| WO | 2024108159 | A1 | 5/2024 |

OTHER PUBLICATIONS

Search Report from Chinese Office Action in corresponding Chinese Application No. 202380086913.7 mailed on Sep. 24, 2025 (English Translation).

Search Report from Chinese Office Action in corresponding Chinese Application No. 202380086907.1 mailed on Sep. 18, 2025 (English Translation).

Search Report from Chinese Office Action in corresponding Chinese Application No. 202380086909.0 mailed on Sep. 7, 2025 (English Translation).

International Search Report and Written Opinion for corresponding International Application No. PCT/US2023/080325 mailed Mar. 18, 2024.

International Search Report and Written Opinion for corresponding International Application No. PCT/US2023/080332 mailed Apr. 4, 2024.

International Search Report and Written Opinion for corresponding International Application No. PCT/US2023/080336 mailed Feb. 28, 2024.

International Search Report and Written Opinion for corresponding International Application No. PCT/US2023/080340 mailed Mar. 22, 2024.

International Search Report and Written Opinion for corresponding International Application No. PCT/US2023/080343 mailed Apr. 5, 2024.

* cited by examiner

FRAME FOR AN UNDERWATER DRILLING ASSEMBLY

CROSS-REFERENCE TO RELATED APPLICATIONS

This application is a U.S. National Stage Entry under 35 U.S.C. § 371 of International Patent Application No. PCT/US2023/080325, titled FRAME FOR AN UNDERWATER DRILLING ASSEMBLY, filed Nov. 17, 2023, which claims the benefit of priority under 35 U.S.C. § 119(e) to U.S. Provisional Patent Application Ser. No. 63/426,591 titled MARINE SALVAGE DRILL ASSEMBLIES AND SYSTEMS, filed Nov. 18, 2022 the entire disclosures of which are herein incorporated by reference.

BACKGROUND

The present disclosure relates to drilling systems, assemblies, and components that may be employed for marine salvage.

SUMMARY

In various aspects of the present disclosure, an underwater drilling system for marine salvage is disclosed. The underwater drilling system comprises a frame, a drill assembly supported by the frame, and a connection flange assembly configured to be attached to a ship skin by the drill assembly. Hydrocarbons, for example, can be extracted from a ship through the ship skin by way of the connection flange assembly after the connection flange assembly is attached to the ship skin and the drill assembly is decoupled from the connection flange assembly.

BRIEF DESCRIPTION OF THE DRAWINGS

Various aspects described herein, together with advantages thereof, may be understood in accordance with the following description taken in conjunction with the accompanying drawings as follows.

Corresponding reference characters indicate corresponding parts throughout the several views. The exemplifications set out herein illustrate various aspects of the present disclosure, in one form, and such exemplifications are not to be construed as limiting the scope of the invention in any manner.

DETAILED DESCRIPTION

Figure 1:
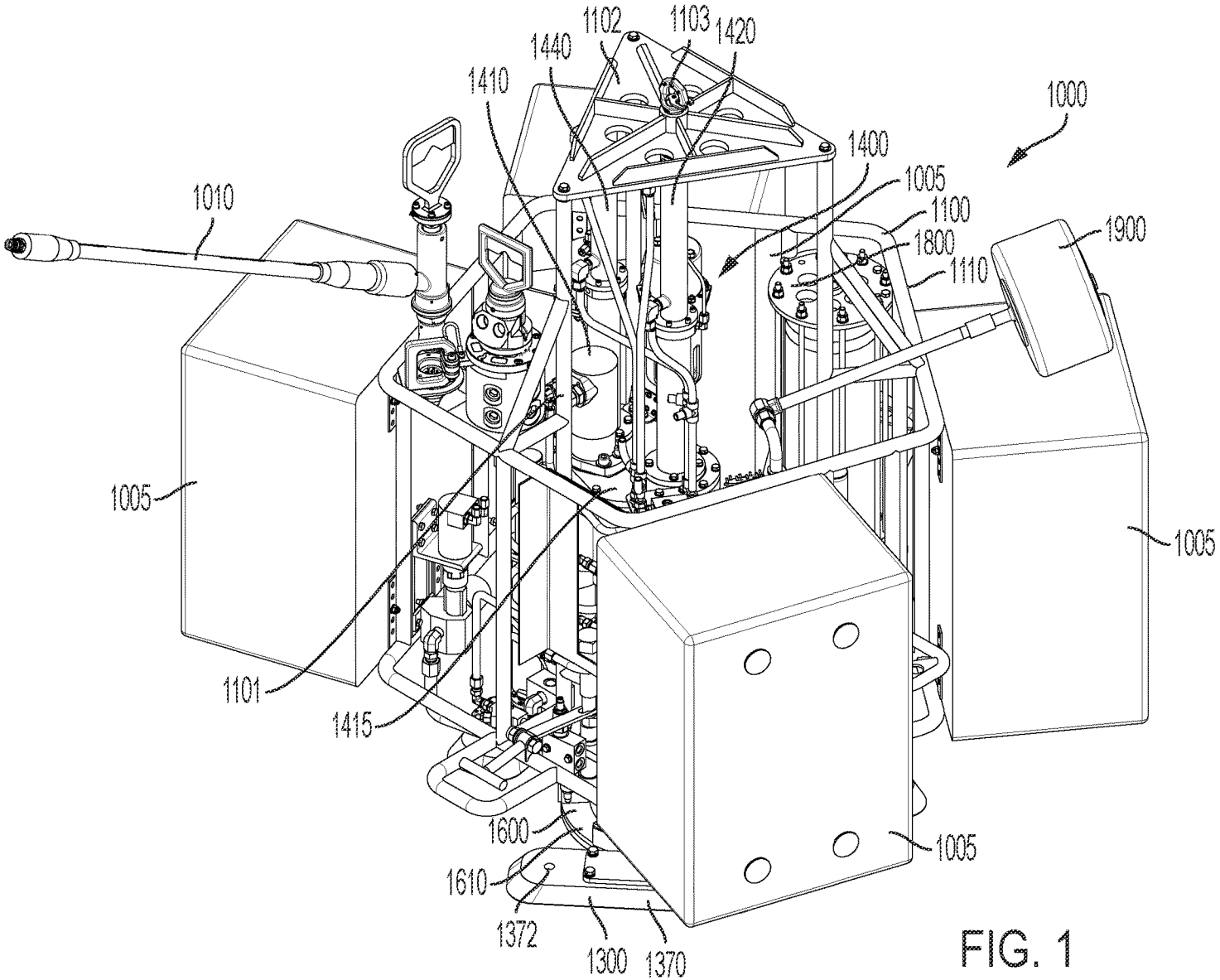
FIG. 1 is a perspective view of an underwater drilling system comprising a frame, a drill assembly supported by the frame, and a connection flange assembly configured to be affixed to a ship skin by the underwater drilling system, according to at least one aspect of the present disclosure.

Applicant of the present application owns the following patent applications, which are filed on Nov. 17, 2023 and are each herein incorporated by reference in their respective entireties:

1. PCT Patent Application, titled FASTENERS FOR AN UNDERWATER DRILLING ASSEMBLY; PCT/US2023/080332;
2. PCT Patent Application, titled LATCHABLE FLANGE FOR AN UNDERWATER DRILLING ASSEMBLY; PCT/US2023/080336;
3. PCT Patent Application, titled WASTE CARTRIDGE FOR AN UNDERWATER DRILLING ASSEMBLY; PCT/US2023/080340; and
4. PCT Patent Application, titled AIR-BLEED ASSEMBLY FOR AN UNDERWATER DRILLING ASSEMBLY; PCT/US202/080343.

Before explaining various aspects of drilling assemblies and systems, it should be noted that the illustrative examples are not limited in application or use to the details of construction and arrangement of parts illustrated in the accompanying drawings and description. The illustrative examples may be implemented or incorporated in other aspects, variations and modifications, and may be practiced or carried out in various ways. Further, unless otherwise indicated, the terms and expressions employed herein have been chosen for the purpose of describing the illustrative examples for the convenience of the reader and are not for the purpose of limitation thereof. Also, it will be appreciated that one or more of the following-described aspects, expressions of aspects, and/or examples, can be combined with any one or more of the other following-described aspects, expressions of aspects and/or examples.

One function of marine salvaging can include the removal, or extraction, of fluid contained within a disabled vessel or marine vehicle. Leaving fluids within a disabled vessel can pose a potential environmental hazard. A vessel may be classified as disabled if the vessel has sunken to an ocean floor, for example, or is otherwise unable to return to a condition where the vessel can independently discard of its fluids. The fluid to be extracted can comprise fuel, for example. In one instance, the fuel is contained within a fuel tank of the vessel. In another instance, the fuel is contained within the vessel's cargo area. At any rate, the extraction of fluid from a disabled vessel can mitigate the risk of a potential environmental hazard.

In one instance, methods for extracting fluid from a disabled vessel involve a human diver manually drilling a hole in a vessel. Manual drilling requires numerous steps and devices. A diver must locate the fluid to be extracted and assess where to drill a hole in the vessel to extract the fluid. In many instances, the frame of a vessel runs behind, or adjacent to, the outer shell, or skin, of the vessel. This poses a risk of drilling into the frame which can cause a drill bit to fail and/or leaking of the fluid from the vessel. Current methods for deciding where to drill a hole involve tapping on the vessel's outer shell and listening to the tone of the taps until a hollow-sounding tap is found-similar to locating studs in a wall.

In one instance, once the diver finds a spot to drill, the diver then installs a flange piece on the outer shell. The flange piece can be attached to the outer shell of the vessel by inserting self-tapping stud bolts and using the stud bolts to bolt the flange to the outer shell, for example. Once the flange is attached to the outer shell of the vessel, a valve is attached to the flange by way of bolts, for example. Once the valve is installed, the diver installs a drill assembly by bolting the drill assembly to the valve. Once the drill assembly is installed, the valve is opened. The diver can now actuate the drill and, thus, the drill bit which is configured to pass through the valve and the flange to drill a hole in the outer shell of the vessel. The drill bit can act as a temporary fluid stop to prevent fluid spilling out during the drilling process. Once the hole is drilled, the drill bit is raised above the valve, the valve is closed, and the drill is removed. Once the drill is removed, the fluid can be extracted by way of a port in the valve.

In at least one instance, various marine salvage tasks are performed by an underwater drilling system capable of performing several steps of marine salvage with little, to no, diver intervention at a drilling site. An overview of the underwater drilling system will now be described. Several components discussed below are described in greater detail throughout the present disclosure. First, a vessel containing all of the necessary equipment to extract fluid from a sunken ship is positioned near the sunken ship. Once the vessel takes its position, a crane positioned on the vessel is used to place the underwater drilling system on the surface of the water where the assembly will float by way of a plurality of removable floats. Then, a remotely-operated underwater vehicle (ROV) is deployed to hook up to the underwater drilling system. After the ROV is hooked up to the underwater drilling system, the floats are removed to allow the ROV to lower the underwater drilling system to the drilling site. The underwater drilling system is tethered to a control interface on the vessel to transmit hydraulic fluid between a hydraulic power pack and the underwater drilling system and to transmit electrical signals and data signals between the control interface and the underwater drilling system.

Once the underwater drilling system is positioned at the drilling location, the underwater drilling system is positioned against a surface of the sunken ship by the ROV. In at least one instance, the ROV pushes the underwater drilling system against the surface of the sunken ship with a predetermined holding force. At this point, attachment legs are actuated via the control interface on the vessel to attach and hold the underwater drilling system to the surface of the sunken ship. Once the attachment legs are engaged with the surface of the sunken ship, the ROV can reduce or stop the application of the predetermined holding force and allow the underwater drilling system to be held against the surface of the sunken ship by the attachment legs.

After the engagement of the attachment legs, a drilling assembly of the underwater drilling system is used to one, secure a flange connection assembly to the surface of the sunken ship with a plurality of self-tapping connection studs and, two, drill a primary hole in the surface of the sunken ship to be used for fluid extraction. The drilling assembly comprises two linear fluidic actuators and a rotary fluidic actuator. Each linear fluidic actuator is configured to linearly actuate a drill shaft and each drill shaft is configured to be rotated by the rotary fluidic actuator through a transmission assembly. One of the drill shafts is configured to drive the self-tapping connection studs into the surface of the sunken ship to secure the flange connection assembly to the surface of the sunken ship and the other drill shaft is configured to drill the primary hole in the surface of the sunken ship to be used for fluid extraction.

The flange connection assembly is secured to the ship skin by way of the plurality of self-tapping connection studs. The flange connection assembly comprises a plurality of containment structures configured to contain possible leakage of waste fluid as a result of drilling the self-tapping connection studs into the ship skin. In at least one instance, one or more of the self-tapping connection studs may break and, in such an instance, the containment structures are configured to prevent waste fluid from leaking from the flange connection assembly as a result of the breakage.

After the flange connection assembly is secured and the primary hole is drilled, a knife gate of the flange connection assembly is actuated to seal the flange connection assembly to prevent additional fluid from escaping out of the primary hole from the sunken ship beyond the fluid which escaped from the sunken ship during the drilling of the primary hole. The knife gate divides a drill cavity through which the drill shaft passes to drill the primary hole into an upper drill cavity and a lower drill cavity. At this point, the fluid and/or debris which escaped from the primary hole during the drilling of the primary hole is trapped in the upper drill cavity defined in a male coupling portion of the frame of the underwater drilling system. Discussed in greater detail below, the male coupling portion is secured to the flange connection assembly by way of a latching mechanism.

The fluid trapped in the upper drill cavity is now purged from the upper drill cavity into a waste cartridge of the underwater drilling system in an attempt to reduce or eliminate waste fluid from escaping into the surrounding medium such as, for example, ocean water when the frame and drilling assembly of the underwater drilling assembly is separated from the installed connection flange assembly. The waste cartridge is mounted to the frame and fluidically coupled to the upper drill cavity through the male coupling portion. A pump is provided to pump ocean water into the upper drill cavity to purge the waste fluid into the waste cartridge.

The underwater drilling system further comprises an automatic air-bleed assembly fluidically coupled to the upper drill cavity to automatically release any trapped air encountered within the sunken ship. The automatic air-bleed assembly is pivotally coupled to the frame to allow the automatic air-bleed assembly to pivot to its highest location encouraging trapped air to bleed out of the automatic air-bleed assembly.

After the waste fluid is purged from the upper drill cavity, the latching mechanism is actuated to de-latch the male coupling portion and the female coupling portion thereby permitting the removal of the drilling assembly, frame, and various other components of the underwater drilling system from the installed flange connection assembly. In addition to de-latching the male coupling portion and the female coupling portion of the flange connection assembly, the attachment legs are released from the surface of the sunken ship to permit complete separation of the frame, the drilling assembly, and various other components of the underwater drilling system from the installed connection flange assembly.

Once removed from the installed flange connection assembly, the underwater drilling system may be transported back to the surface, for example, by the ROV to have the floats reinstalled, to be reloaded with an additional flange connection assembly, to have the waste cartridge cleaned out and/or flushed, and to be prepared for the next installation of a flange connection assembly. In at least one instance, the floats are re-installed back onto the frame prior to the occurrence of the aforementioned steps. In at least one instance, another flange connection assembly is aligned with the male coupling portion of the frame and the latching mechanism latches the male coupling portion and the new flange connection assembly. The underwater drilling system can then be lowered back to a new drilling site for the installation of the new flange connection assembly.

After the installation of the flange connection assembly, the ROV can be configured to connect a hose assembly to the flange connection assembly, release the knife gate seal, and extract fluid from the sunken ship by way of a vacuum, for example. In at least one instance, the flange connection assembly is re-sealed after fluid extraction.

All of the steps described herein may either be performed by an ROV exclusively, an ROV with the assistance of a diver, and/or with a diver exclusively.

The hydraulic hoses and/or electrical transmission lines can be stored on reels on the vessel. For example, the hydraulic hoses and/or electrical transmission lines transmitting fluid and/or electrical signals between the vessel and the transport hub may be stored on one or more reels positioned on the vessel.

Details of various devices, systems, and/or assemblies for use in marine salvage can be found in U.S. patent application Ser. No. 16/356,398, now U.S. Pat. No. 11,014,639 entitled MARINE SALVAGE DRILL ASSEMBLIES AND SYSTEMS, which is herein incorporated by reference in its entirety.

FIGS. 1-9 depict an underwater drilling system 1000 according to one aspect of the present disclosure. The underwater drilling system 1000 comprises a frame 1100 configured to support various components of the underwater drilling system 1000, a plurality of attachment legs 1300 attached to the frame 1100 and configured to hold the underwater drilling system 1000 to a ship skin, and a drilling assembly 1400 configured to drill a primary hole in the ship skin and secure a flange connection assembly 1600 to the ship skin with a plurality of self-tapping connection studs 1200. The underwater drilling system 1000 further comprises a waste cartridge assembly 1800 mounted to the frame 1100 and configured to collect waste fluid and an automatic air-bleed valve assembly 1900 configured to automatically bleed air encountered through the ship skin.

The underwater drilling system 1000 further comprises various other components such as, for example, a hot stab connector assembly 1010 configured to provide a global connection point for fluidic and/or electrical line connections. In at least one instance, the ROV is configured to connect directly to the hot stab connector assembly 1010 and the ROV is connected to electrical and/or hydraulic supplies on the ship. In at least one instance, the ROV is configured to connect a tether from a ship to the hot stab connector assembly 1010. In at least one instance, the underwater drilling system 1000 further comprises one or more cameras, lights, power supplies, and ROV wrist mechanisms attached the frame 1100. In at least one instance, the ROV is configured to attach to the ROV wrist mechanisms to allow the ROV to manipulate the underwater drilling system 1000. In at least one instance, the underwater drilling system further 1000 further comprises a central valve box. In at least one instance, one or more hydraulic components of the underwater drilling system 1000 comprise individual supply and return lines connected to the central valve box and the central valve box comprises a main supply and return line. In at least one instance, the main supply and return line are fed to the ship through the hot stab connector assembly.

The underwater drilling system 1000 further comprises float members 1005 configured to be attached to and detached from the frame 1100 manually and/or by an ROV. In at least one instance, the float members 1005 are configured to aid in the transfer of the underwater drilling system 1000 from the ship to the ocean, for example, by allowing the underwater drilling system 1000 to float on the surface of the ocean. At this point, the ROV can be attached to the underwater drilling system 1000. Once the ROV is attached to the underwater drilling system 1000, the floats can be removed manually and/or by the ROV, allowing the underwater drilling system 1000 to be taken to a drilling location by the ROV and/or a diver, for example.

Figure 2:
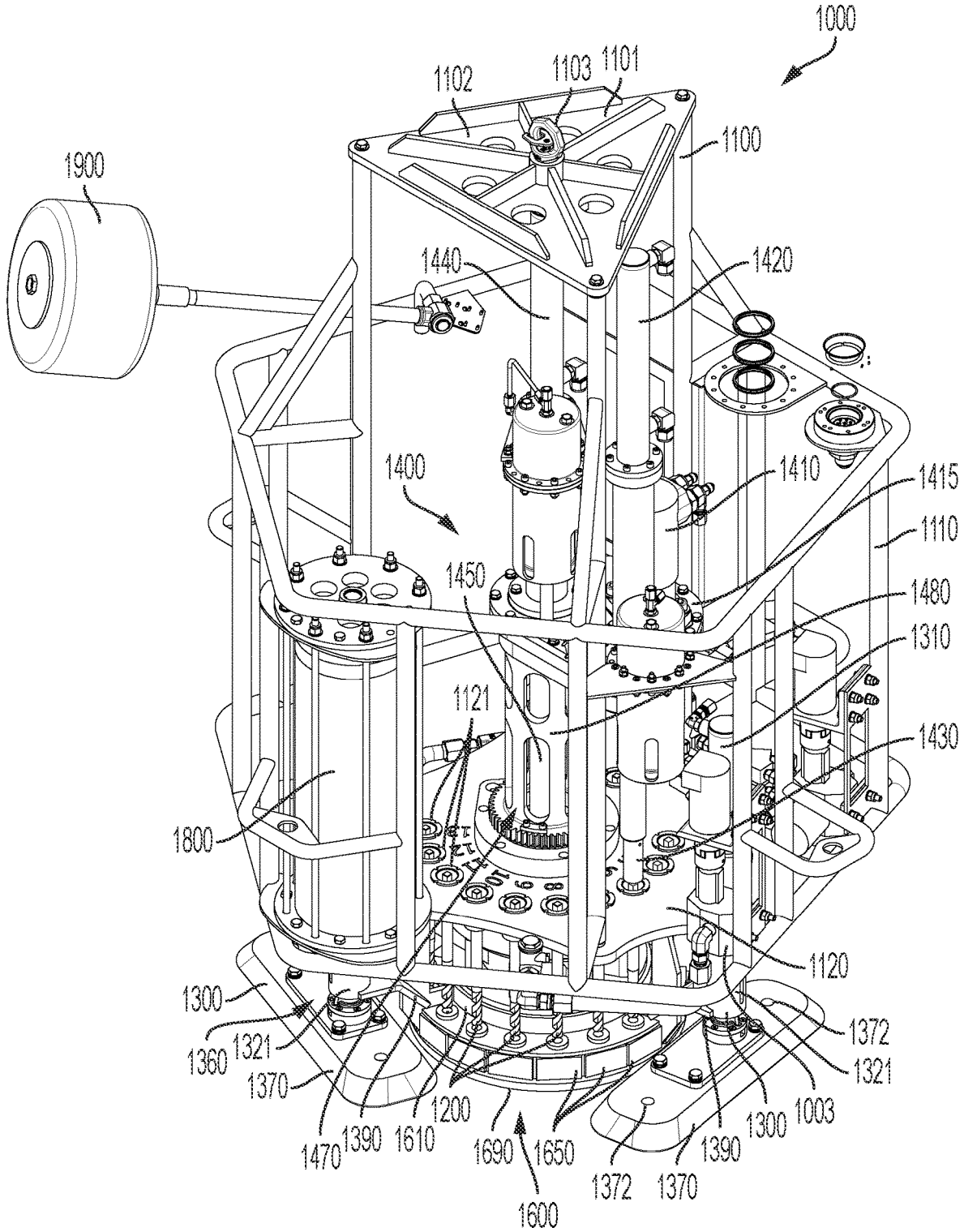
FIG. 2 is a partial perspective view of the underwater drilling system of FIG. 1, according to at least one aspect of the present disclosure.
Figure 3:
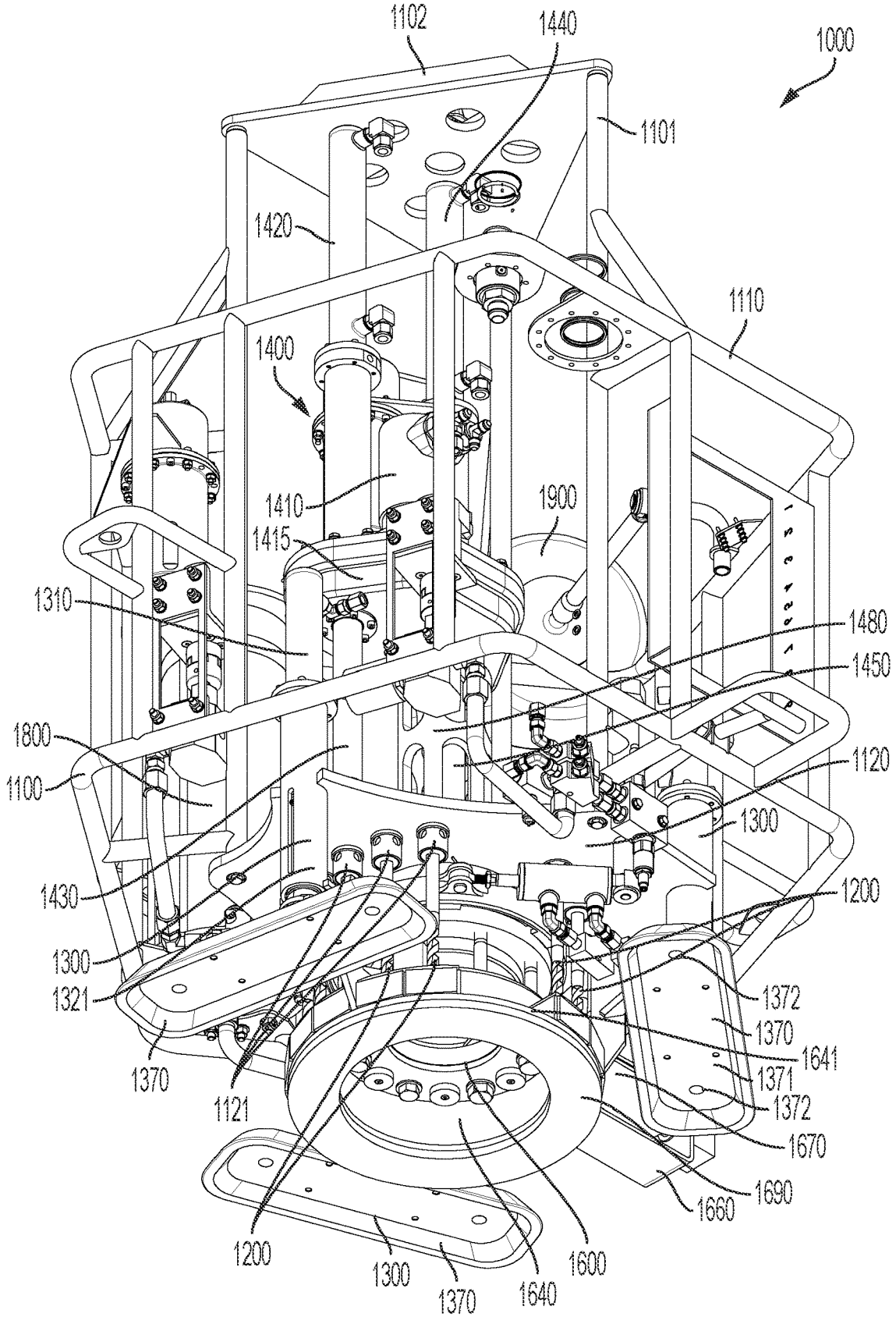
FIG. 3 is a partial perspective view of the underwater drilling system of FIG. 1, according to at least one aspect of the present disclosure.

Referring primarily to FIGS. 2 and 3 the frame 1100 is configured to support various components, subsystems, and assemblies of the underwater drilling system 1000. The frame 1100 can consist of any suitable material such as metal, plastic, and/or any combination thereof. The frame 1100 comprises a primary support structure, or protection cage, 1110, a central support structure 1101 positioned within and attached to the primary support structure 1110, and a lower platform 1120 attached to the central support structure 1101. The central support structure 1101 and the lower platform 1120 primarily support the drilling assembly 1400. Discussed in greater detail below, lower platform 1120 is configured to hold a plurality of self-tapping connection studs 1200 in a pre-staged configuration (as illustrated in FIGS. 2 and 3, for example) where the studs 1200 are aligned with corresponding apertures in the flange connection assembly 1600 so that the drilling assembly 1400 can drive the studs 1200 into the flange connection assembly 1600 to secure the flange connection assembly 1600 to the ship skin. In at least one instance, the studs 1200 are held within the lower platform 1120 by grommet structures 1121, for example, which are configured to provide a tight fit for each stud 1200 therein to hold the studs 1200 in the pre-staged configuration prior to being driven by the drilling assembly 1400.

The central support structure 1101 further comprises a top platform 1102. The top platform 1102 comprises a hook 1103 configured to be engaged by a crane to pick up and lower the underwater drilling system 1000.

Referring primarily to FIGS. 2, 3, and 7-9, the attachment legs 1300 are attached to the frame 1100 and are configured to hold the underwater drilling system 1000 to the ship skin. Each attachment leg 1300 is attached to the lower platform 1120. Each attachment leg 1300 comprises a linear fluidic actuator 1310, an expandable, or telescoping, leg assembly 1320 attached to the fluidic actuator 1310, and a suction cup base 1370 attached to the expandable leg assembly 1320 by way of a gimbal 1360. The suction cup base 1370 is configured to provide a holding force against the ship skin. The expandable leg assembly 1320 is configured to allow the underwater drilling system 1000 to float relative to the ship skin, discussed in greater detail below. The linear fluidic actuator 1310 comprises an output shaft 1311 configured to be moved up and down in response to fluidic actuation. The expandable leg assembly 1320 comprises an outer housing member 1321 fixedly attached to the linear fluidic actuator 1310, an upper leg portion 1330 slidably supported within the housing member 1321, and a lower leg portion 1350 slidably supported within the housing member 1321. The upper leg portion 1330 is attached to and is directly translatable by the output shaft 1311 up and down. The lower leg portion 1350 is spring loaded against the upper leg portion 1330 by way of spring mechanism 1340.

The spring mechanism 1340 comprises a plunger shaft 1341 slidably supported within the upper leg portion 1330. The plunger shaft 1341 comprises a plunger head 1342. The spring mechanism further comprises a spring 1343 and a fixed nut 1344 positioned within the upper leg portion 1330. The spring 1343 is positioned between the plunger head 1342 and the nut 1344 such that, when the suction cup base 1370 is engaged with the ship skin (suction force is applied by way of hydraulics, for example) as the upper leg portion 1330 is translated upwardly by the output shaft 1311, the upper leg portion 1330 expands relative to the lower leg portion 1350 owing to the holding force provided by the suction cup base 1370 and the spring 1343. The lower leg portion 1350 is pinned to the plunger shaft 1341 and a slot 1322 of the housing member 1321 by way of pin 1345. The pin 1345 holds the plunger shaft 1341 to the lower leg portion 1350 to allow the upper leg portion 1330 to be retracted by the fluidic actuator 1310. The upper leg portion 1330 is spring loaded against the nut 1344. Discussed in greater detail below, the attachment legs 1300 are configured to allow the underwater drilling system 1000 to float relative to the ship skin while still providing a holding force via the suction cup base 1370.

Each suction cup base 1370 is attached to the lower leg portion 1350 by way of gimbal 1360 to allow each attachment leg 1300 to conform to an uneven surface of the ship skin, discussed in greater detail below. The suction cup base 1370 comprises a suction cavity 1371 defined in the underside of the suction cup base 1370 and a plurality of suction holes 1372 fluidically coupleable to fluidic lines such that a vacuum can be created in the suction cavity 1371 to secure each attachment leg 1300 to the ship skin.

Figure 10:
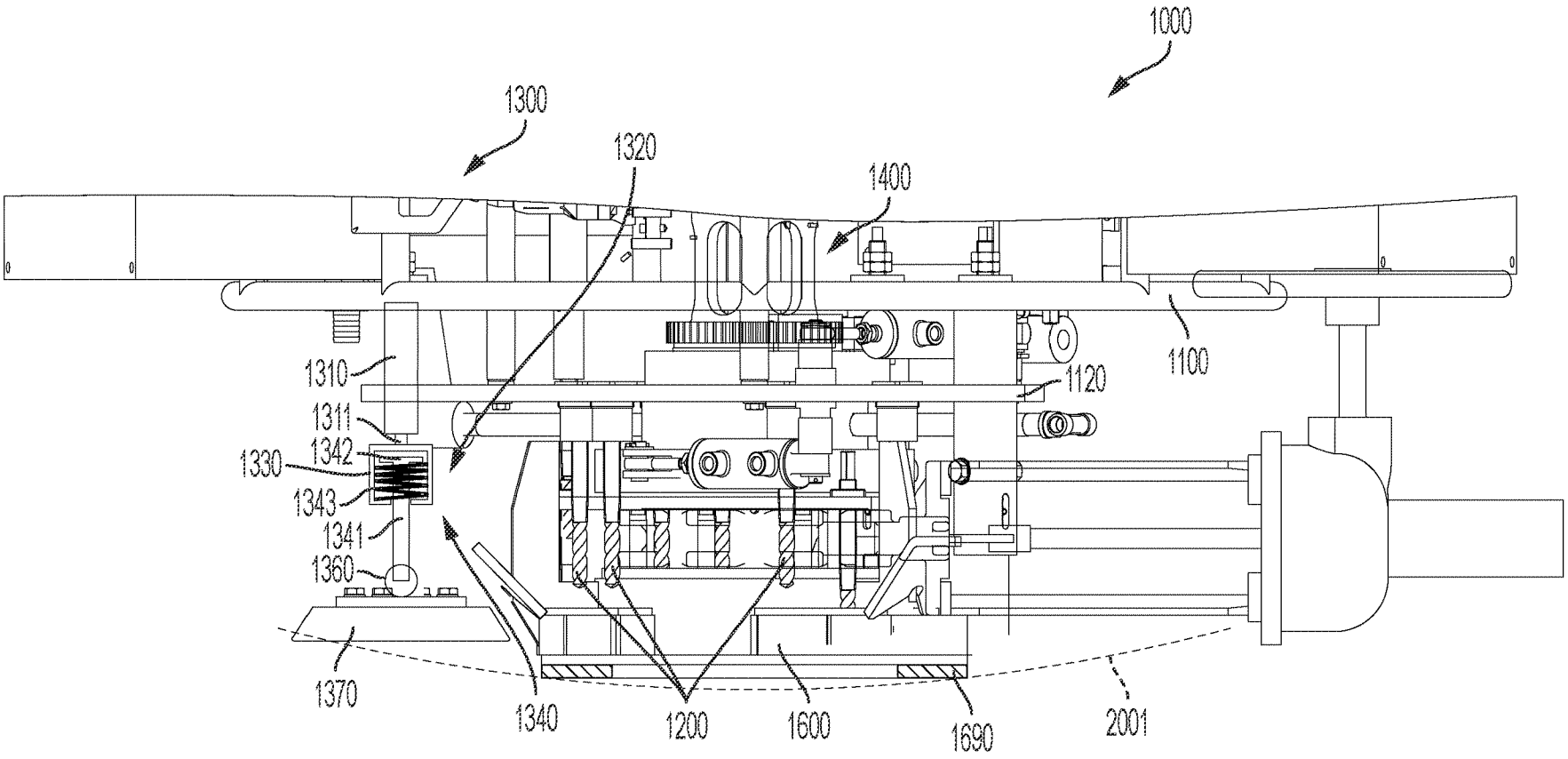
FIG. 10 is a schematic representation of the underwater drilling system of FIG. 1 and an attachment leg thereof configured to engage a concave ship skin surface, wherein the attachment leg is illustrated in a retracted configuration, according to at least one aspect of the present disclosure.
Figure 11:
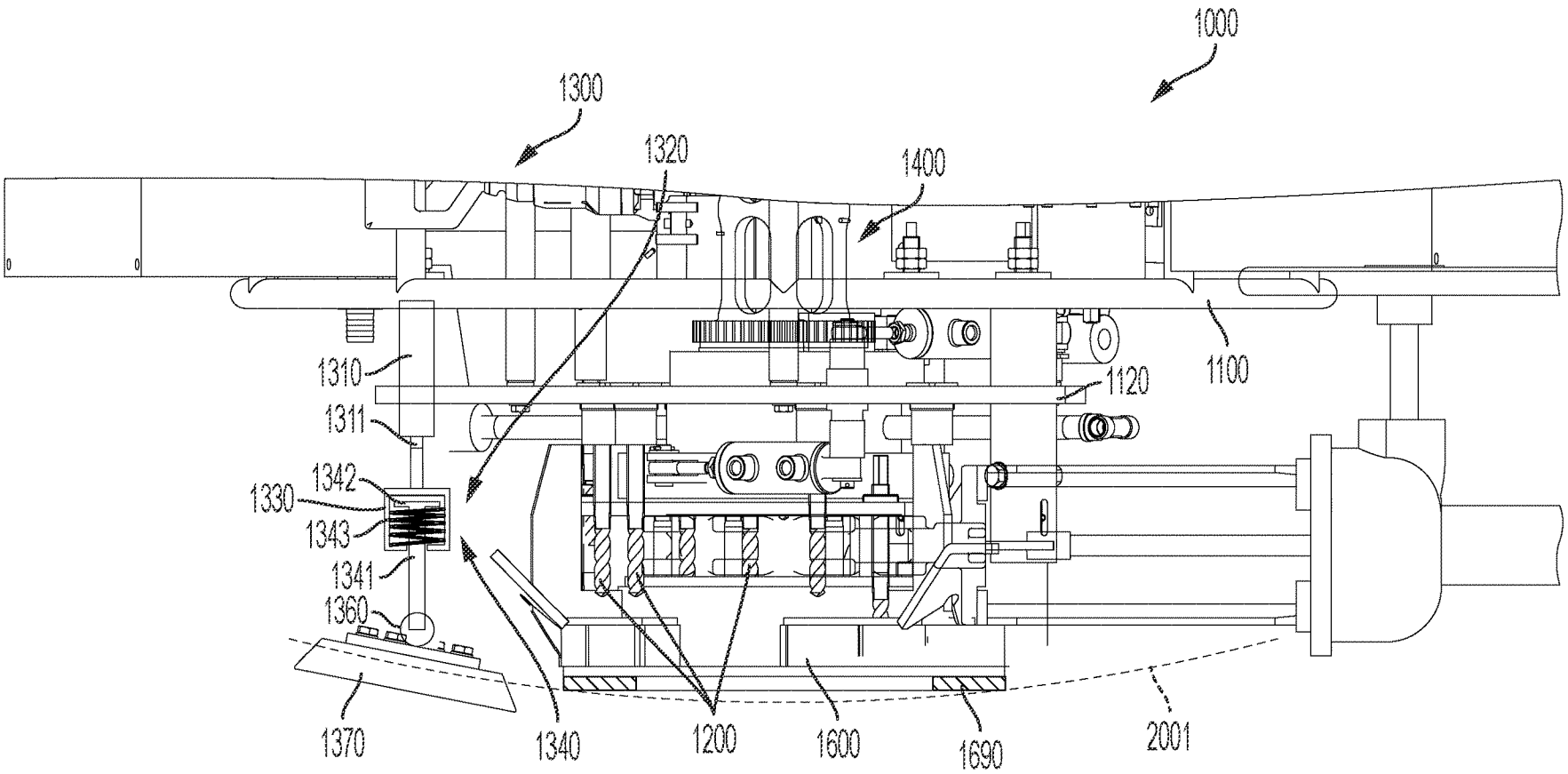
FIG. 11 is a schematic representation of the underwater drilling system and attachment leg of FIG. 10, wherein the attachment leg is illustrated in an extended configuration, according to at least one aspect of the present disclosure.

FIGS. 10-13 and FIGS. 14-17 are a schematic representation of the attachment of the underwater drilling system 1000 by way of attachment legs 1300 to a concave ship skin 2001 and a convex ship skin 2002, respectively. As can be seen in FIG. 10, the expandable leg assembly 1320 is illustrated in a retracted configuration. From the retracted configuration, the fluidic actuator 1310 is actuated to advance the output shaft 1311 and, thus, the expandable leg assembly 1320 and the suction cup base 1370 toward the concave ship skin 2001 and into an extended position illustrated in FIG. 11. As can be seen in FIG. 11, the suction cup base 1370 pivoted, or swiveled, to conform to the concave ship skin 2001 upon contact between the suction cup base 1370 and the concave ship skin 2001. After the suction cup base 1370 is in sufficient contact with the concave ship skin 2001, air and/or water is sucked out of the suction cavity 1371 defined in the suction cup base 1370 via the suction holes 1372 to secure the suction cup base 1370 to the concave ship skin 2001. In at least one instance, a suction, or vacuum, pump 1003 (FIG. 2) is utilized to achieve suction within the suction cavity 1371.

In at least one instance, sufficient contact between the suction cup base 1370 and the ship skin 2001 may be determined automatically by a pressure relief valve preconfigured to stop extension of the output shaft 1311 upon reaching a predetermined pressure. Such a configuration may prevent the fluidic actuator 1310 from lifting the underwater drilling system 1000 away from the ship skin 2001. In at least one instance, the ROV is configured to maintain the application of a predetermined amount of positive downward force against the underwater drilling system to hold the underwater drilling system 1000 against the ship skin 2001. In at least one instance, the gasket 1690 allows a degree of self-leveling of the underwater drilling system 1000.

Figure 12:
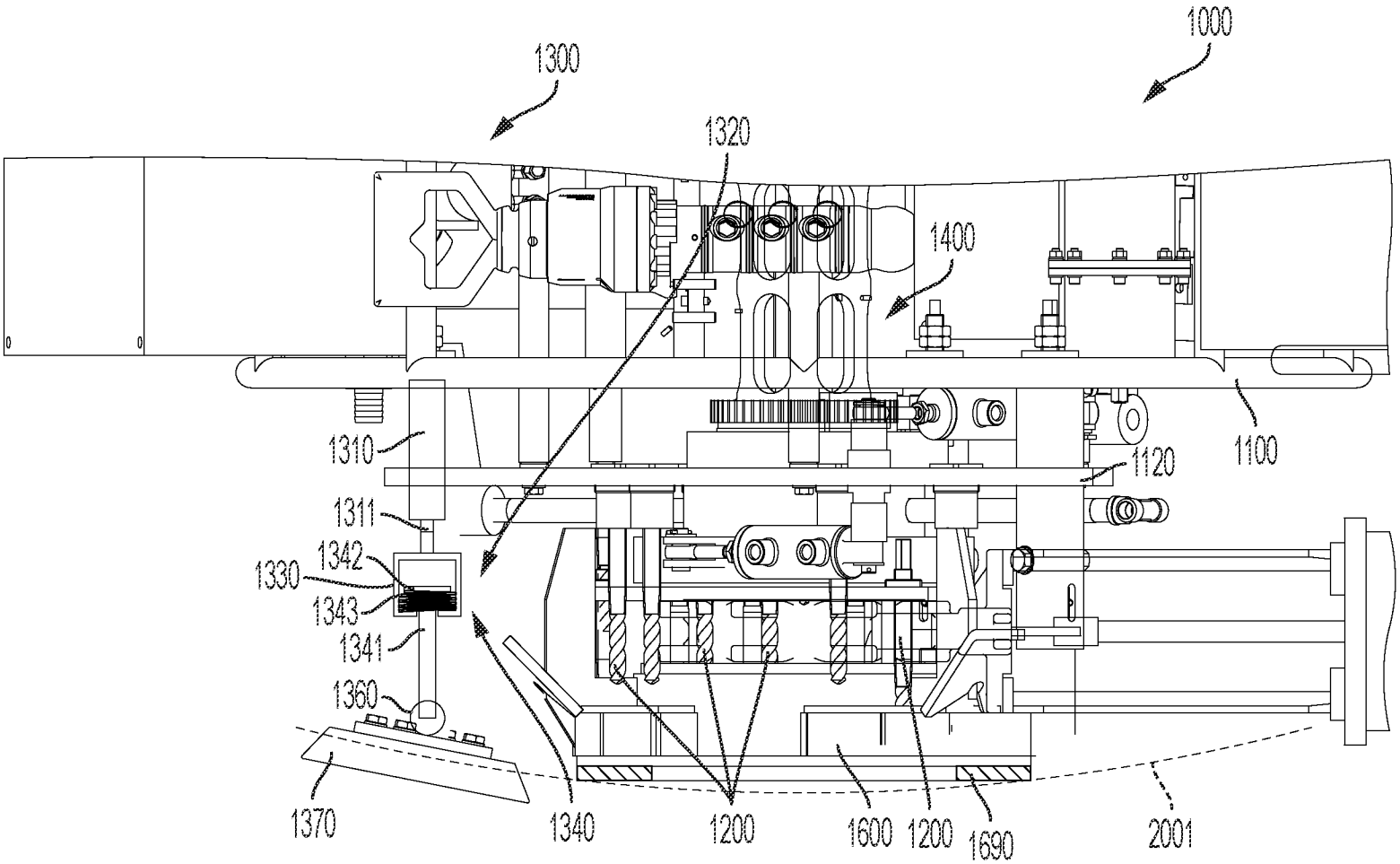
FIG. 12 is a schematic representation of the underwater drilling system and attachment leg of FIG. 10, wherein the attachment leg is illustrated in a first holding configuration, according to at least one aspect of the present disclosure.

After a suction force is established by the suction cup base 1370, the output shaft 1311 is retracted by the fluidic actuator 1310 to place the attachment leg in a first holding configuration as seen in FIG. 12. The output shaft 1311 is retracted to pull the upper leg portion 1330 upward relative to lower leg portion 1350 thereby expanding the expandable leg assembly 1320. This is achieved through the spring mechanism 1340. This holding configuration causes the attachment leg 1300 to pull the underwater drilling system 1000 against the ship skin 2001. In at least one instance, the output shaft 1311 is locked upon attaining this holding configuration. The expandable leg assembly 1320 allows the underwater drilling system to float, or move slightly, as the flange connection assembly 1600 is installed in the ship skin 2001 while maintaining a maximum suction holding force. In other words, the underwater drilling system 1000 is able to index toward the ship skin 2001 as the gasket 1690 is compressed because of the spring 1343. In at least one instance, this arrangement may eliminate the need for hydraulics to compensate for movement of the underwater drilling system 1000 relative to the ship skin 2001 as the gasket 1690 is compressed. In at least one instance, hydraulics (of the attachment leg 1300, for example) are used in addition to the spring mechanism 1340 to index the underwater drilling system 1000. In at least one instance, the output shaft 1311 is not locked after attaining the first holding configuration.

Figure 13:
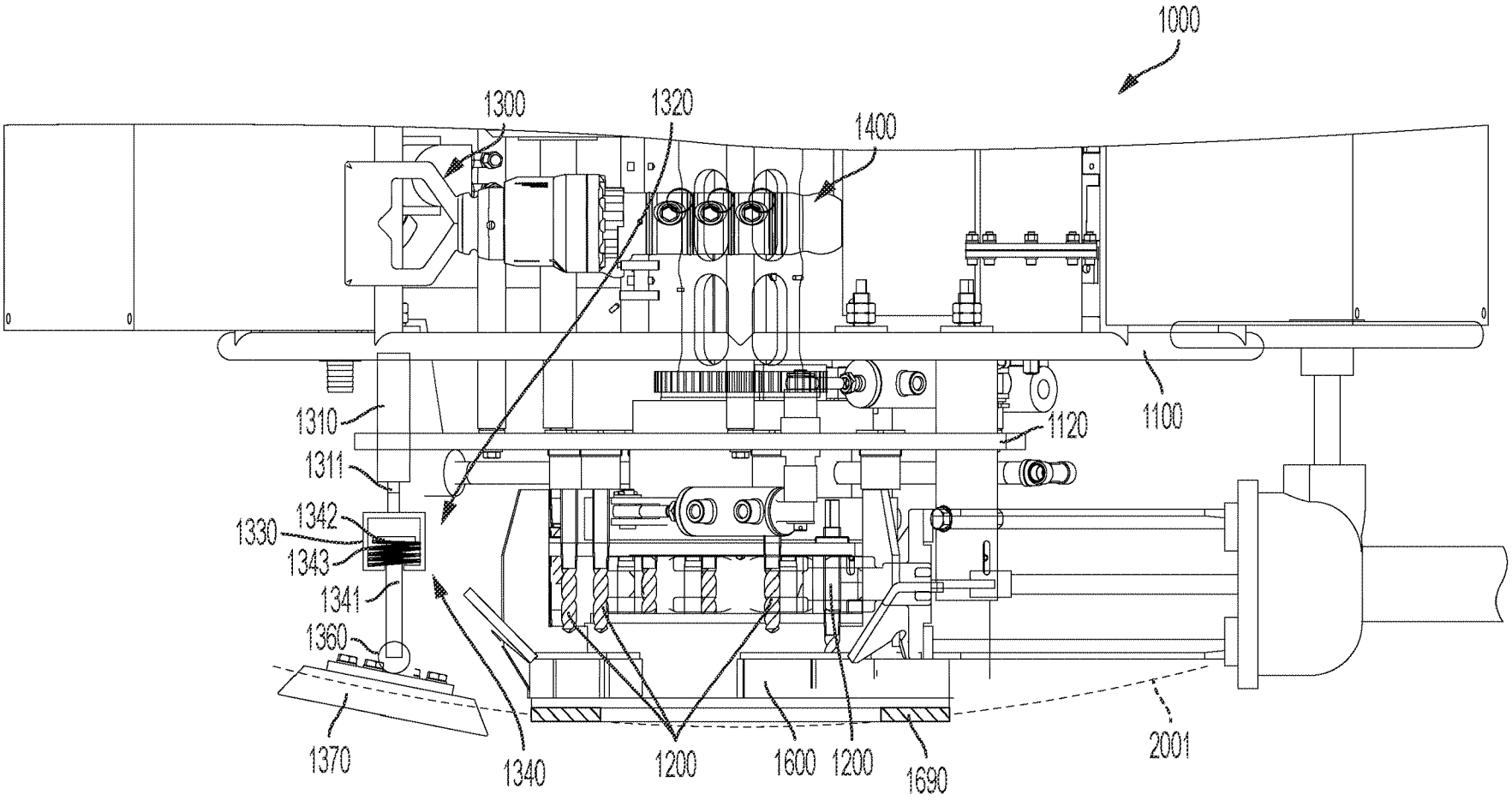
FIG. 13 is a schematic representation of the underwater drilling system and attachment leg of FIG. 10, wherein the attachment leg is illustrated in a second holding configuration, according to at least one aspect of the present disclosure.
Figure 14:
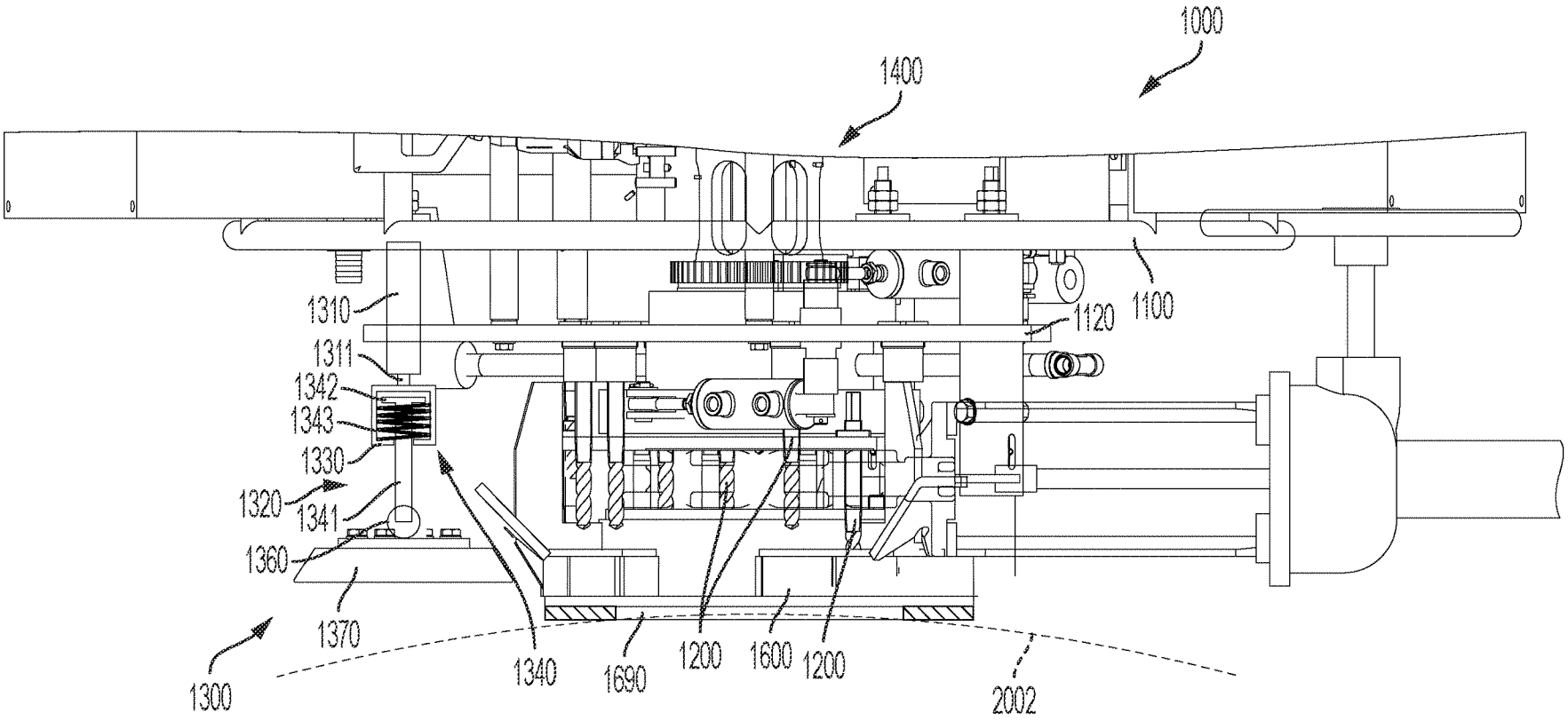
FIG. 14 is a schematic representation of the underwater drilling system of FIG. 1 and an attachment leg thereof configured to engage a convex ship skin surface, wherein the attachment leg is illustrated in a retracted configuration, according to at least one aspect of the present disclosure.
Figure 15:
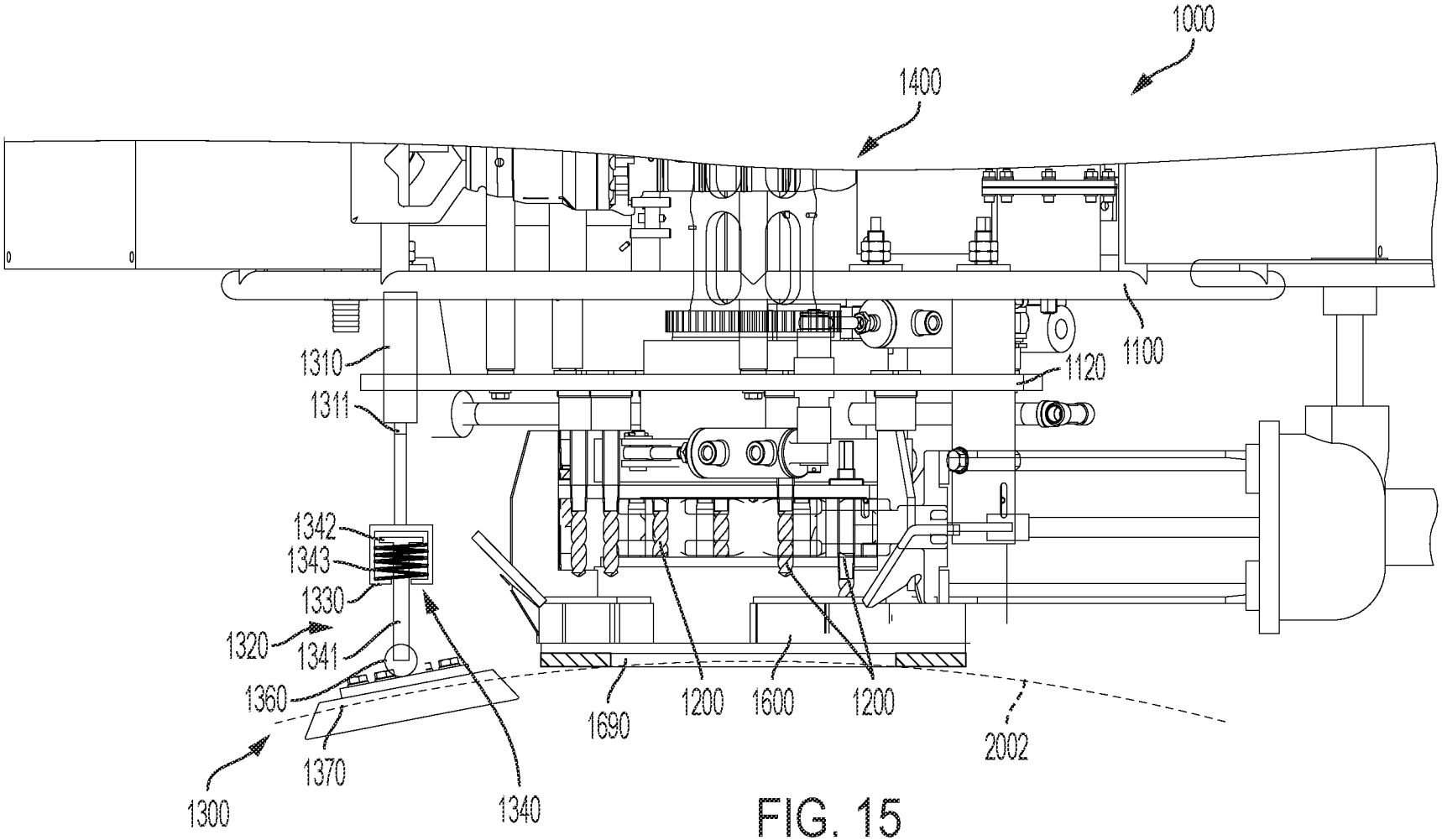
FIG. 15 is a schematic representation of the underwater drilling system and attachment leg of FIG. 14, wherein the attachment leg is illustrated in an extended configuration, according to at least one aspect of the present disclosure.
Figure 16:
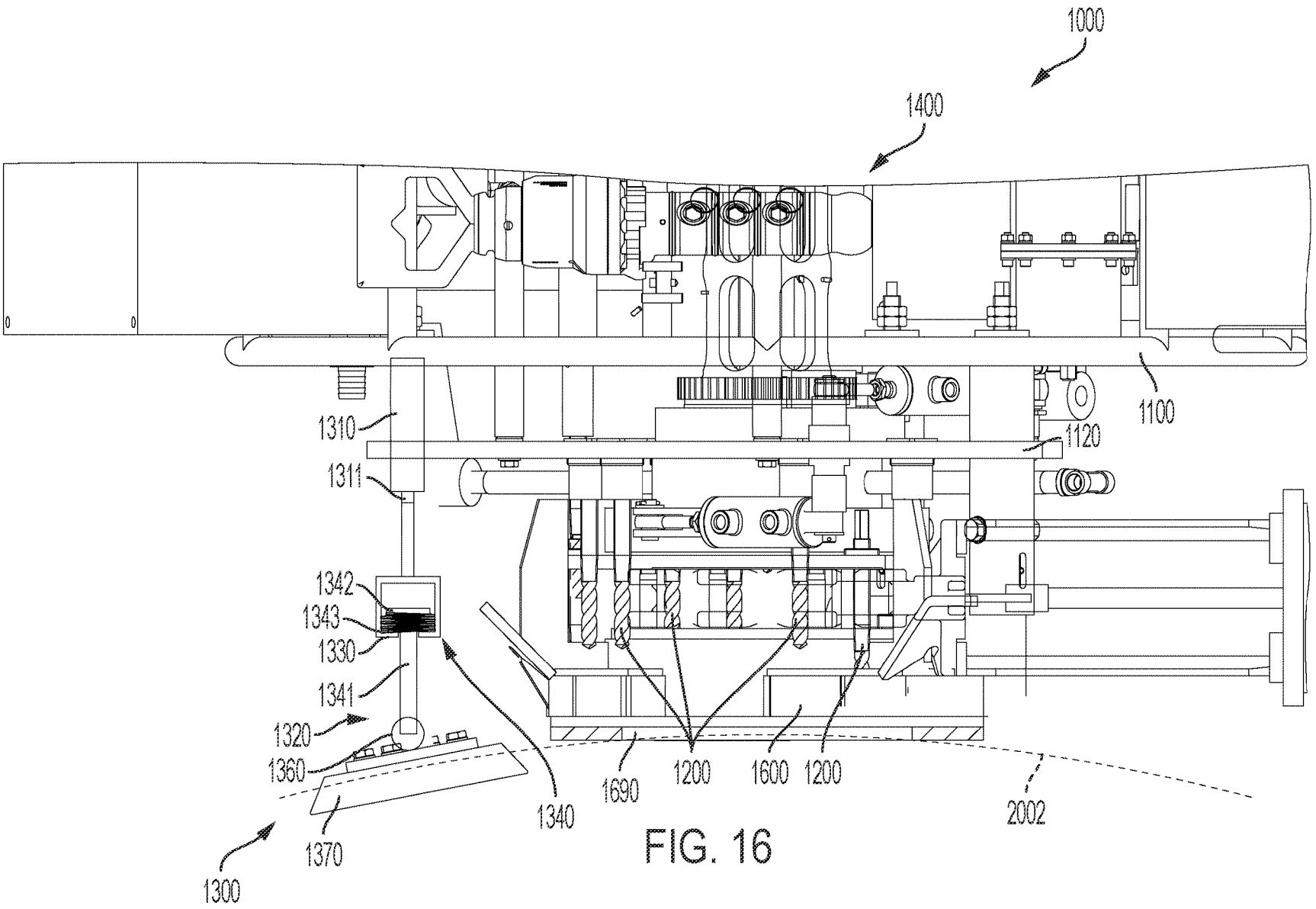
FIG. 16 is a schematic representation of the underwater drilling system and attachment leg of FIG. 14, wherein the attachment leg is illustrated in a first holding configuration, according to at least one aspect of the present disclosure.
Figure 17:
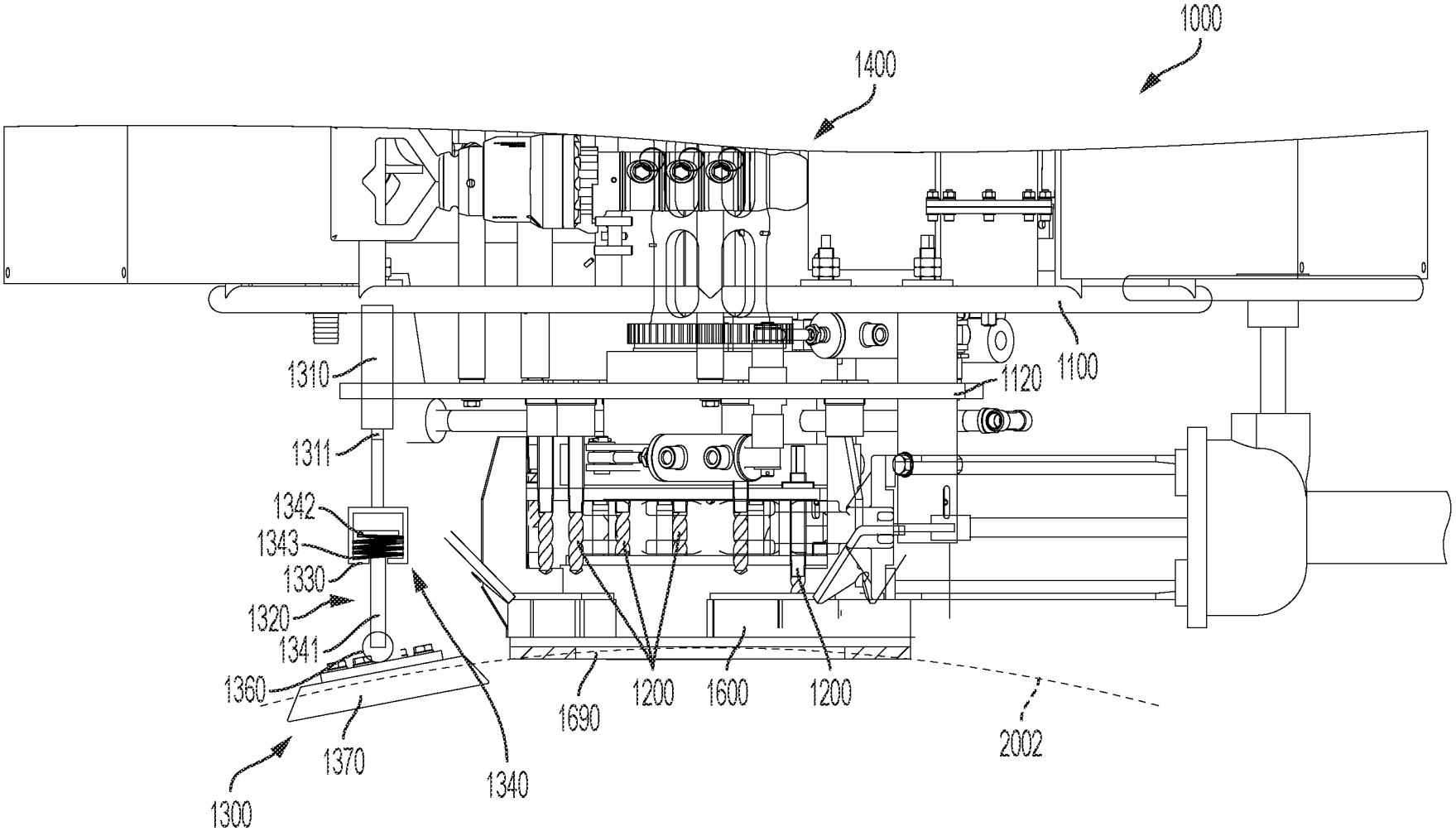
FIG. 17 is a schematic representation of the underwater drilling system and attachment leg of FIG. 14, wherein the attachment leg is illustrated in a second holding configuration, according to at least one aspect of the present disclosure.

Because the of the spring mechanism 1340, the underwater drilling system 1000 can float causing the attachment leg 1300 to attain a second holding configuration as illustrated in FIG. 13. In at least one instance, the underwater drilling system 1000 is pulled closer to the ship skin 2001 during installation of the flange connection assembly 1600 via the self-tapping connection studs 1200. This vertical approximation is a result of the compression of a gasket 1690 of the flange connection assembly 1600 between an outer rim of the flange connection assembly 1600 and the ship skin 2001 during engagement of threads 1230 of the self-tapping connection studs 1200 into the ship skin 2001. This engagement pulls the flange connection assembly 1600 against the ship skin 2001 thereby compressing the gasket 1690. Without an expandable leg assembly, vertical movement of an underwater drilling system 1000 relative to a ship skin after a holding force is applied by attachment legs of the underwater drilling system against the ship skin may cause instability in the magnitude of the holding force applied by the attachment legs. In at least one instance, this vertical approximation can cause loss in suction force supplied by attachment legs utilizing suction cups.

As discussed above, FIGS. 14-17 are a schematic representation of the attachment of the underwater drilling system 1000 by way of attachment legs 1300 to the convex ship skin 2002. The attachment legs 1300 are operable in a similar manner as discussed above in connection with FIGS. 10-13. In this instance, the gimbal 1360 allows the suction cup base 1370 to pivot in a direction different than a direction in which the suction cup base 1370 pivots when contacting the concave ship skin 2001.

As discussed above, the drilling assembly 1400 of the underwater drilling system 1000 is configured to drill a primary hole in the ship skin and secure the flange connection assembly 1600 to the ship skin with the plurality of self-tapping connection studs 1200. Referring again primarily to FIGS. 1-3, the drilling assembly 1400 comprises a rotary fluidic actuator 1410 operably coupled to a transmission 1415. The drilling assembly 1400 further comprises a first linear fluidic actuator 1420 configured to linearly translate an outer drill shaft 1430 and a second linear fluidic actuator 1440 configured to linearly translate a primary drill shaft 1450. The outer drill shaft 1430 is configured to be rotated by the rotary fluidic actuator 1410 through the transmission 1415 to drive the self-tapping connection studs 1200. The primary drill shaft 1450 is also configured to be rotated by the rotary fluidic actuator 1410 through the transmission 1415 to drill the primary hole in the ship skin for fluid extraction. In at least one instance, the transmission 1415 comprises a clutch configured to selectively drive each drill shaft 1430, 1450 independently. In at least one instance, each drill shaft 1430, 1450 rotates simultaneously when the rotary fluidic actuator 1410 is actuated.

Figure 3A:
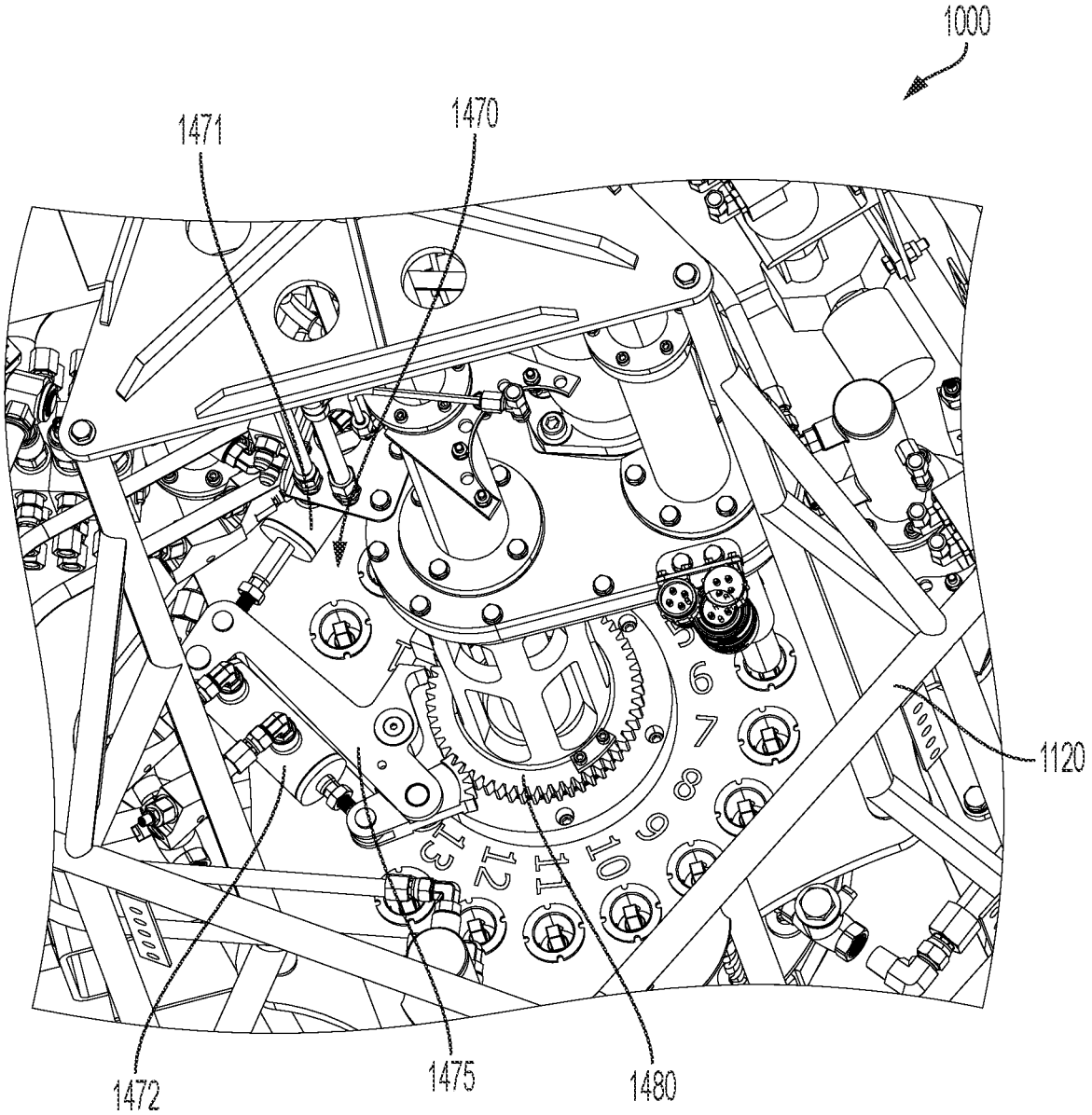
FIG. 3A is a partial perspective view of the underwater drilling system of FIG. 1, according to at least one aspect of the present disclosure.
Figure 4:
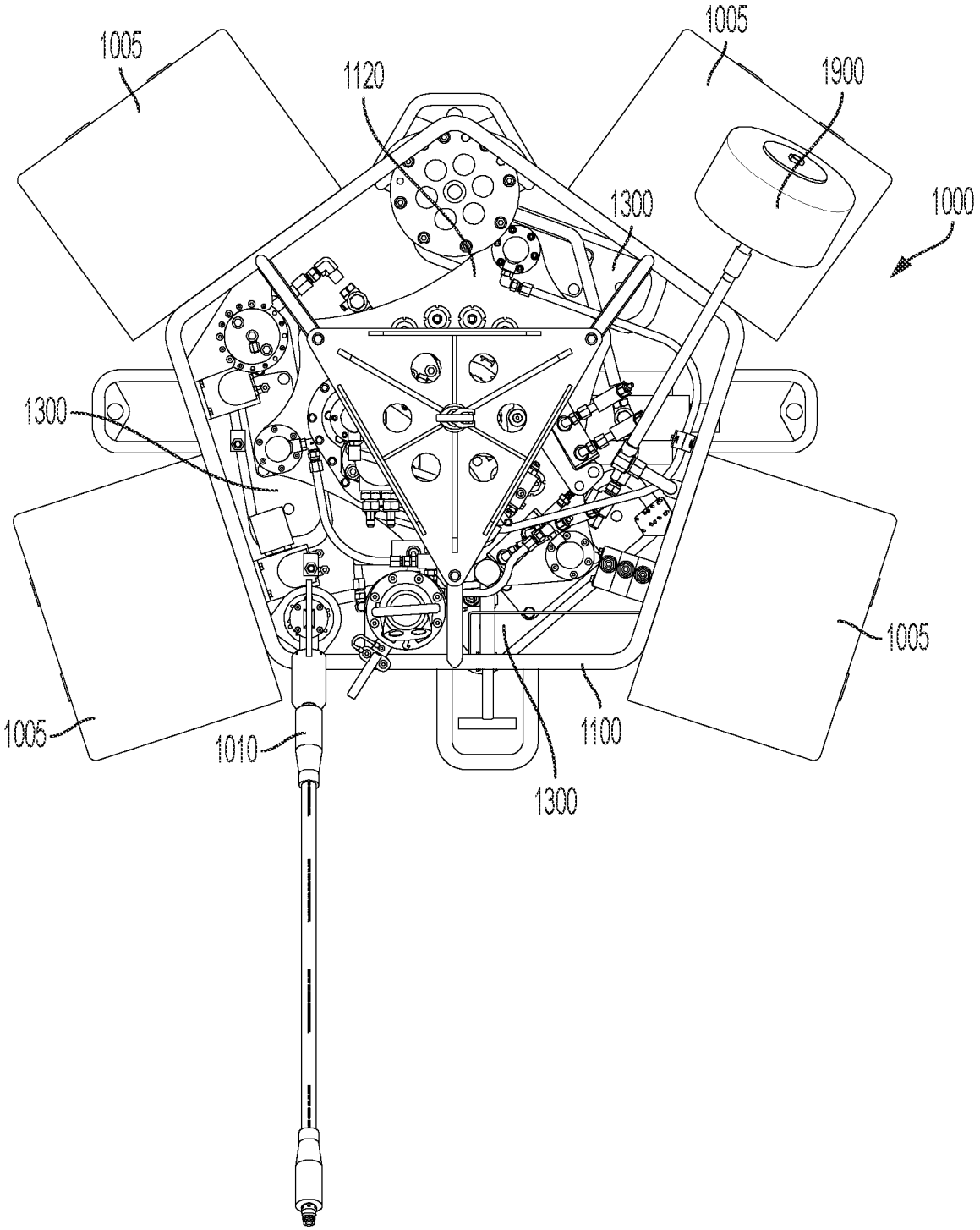
FIG. 4 is a top view of the underwater drilling system of FIG. 1, according to at least one aspect of the present disclosure.
Figure 5:
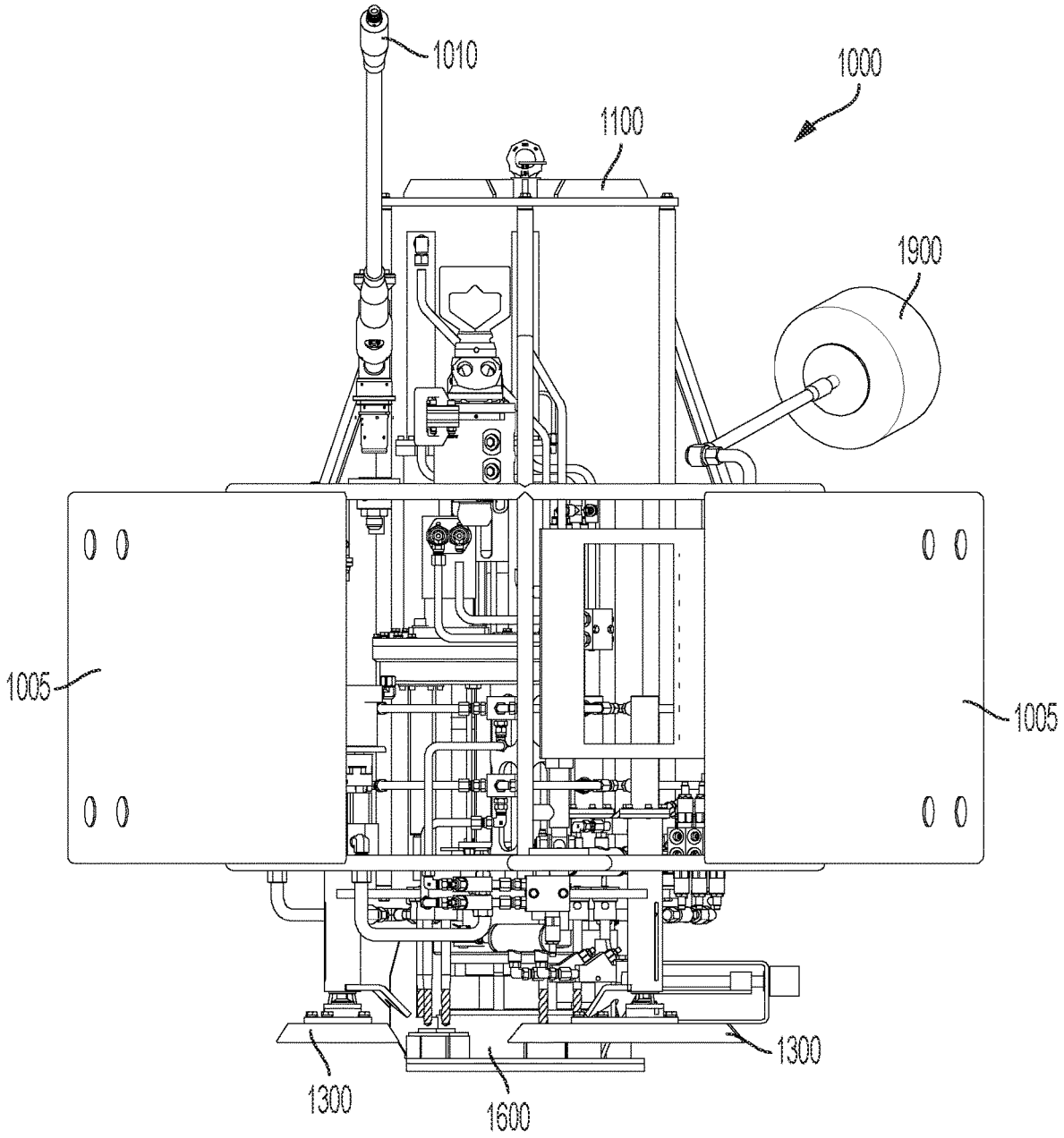
FIG. 5 is a front view of the underwater drilling system of FIG. 1, according to at least one aspect of the present disclosure.
Figure 6:
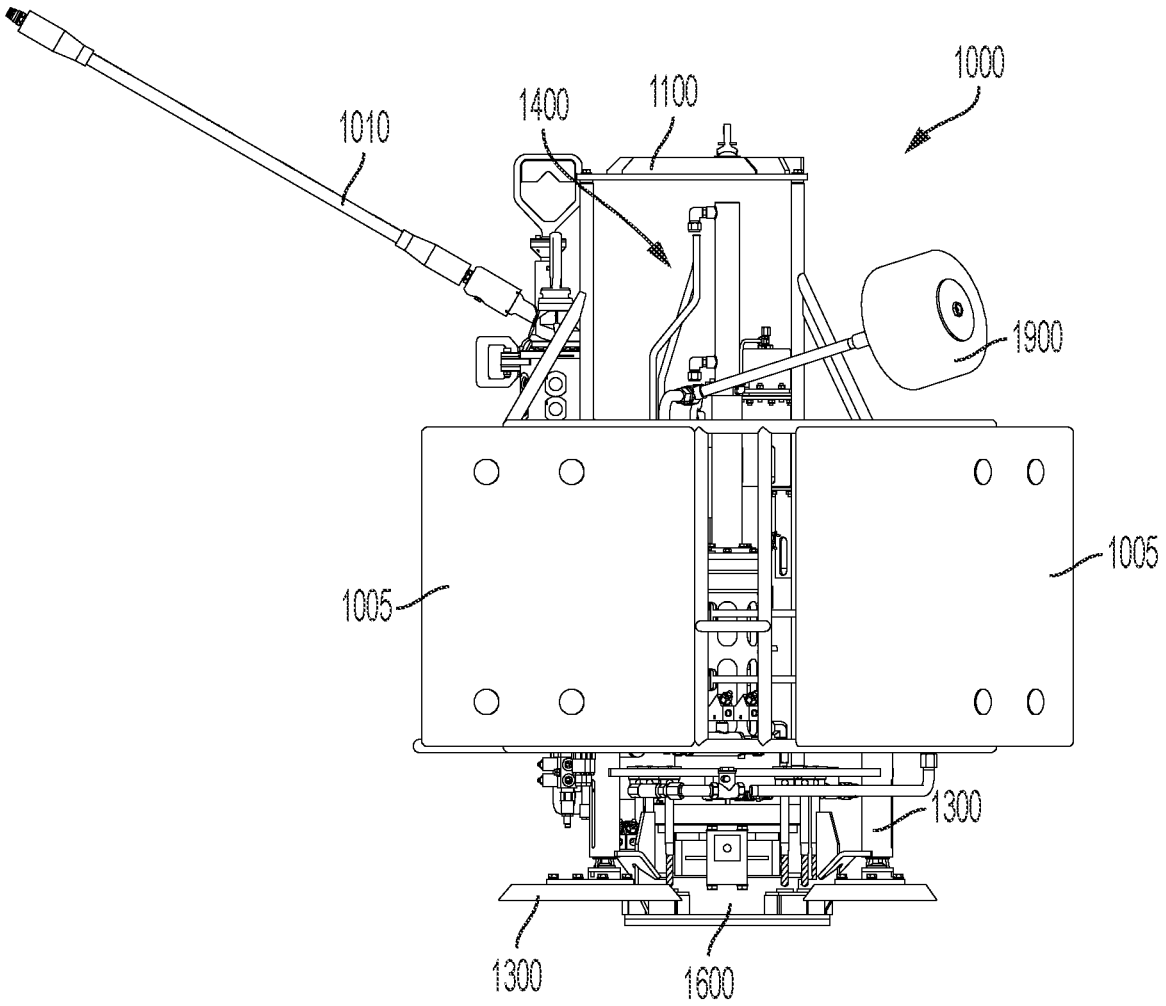
FIG. 6 is a side view of the underwater drilling system of FIG. 1, according to at least one aspect of the present disclosure.
Figure 7:
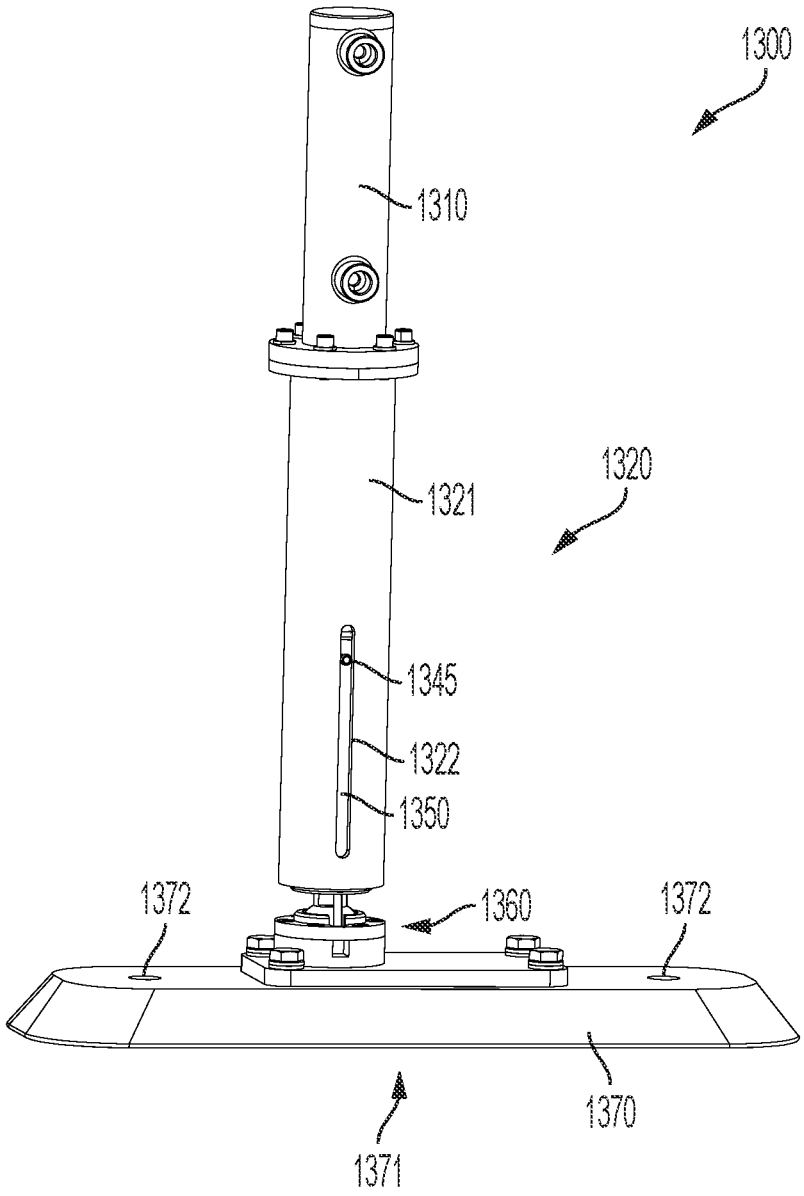
FIG. 7 is a perspective view of an attachment leg of the underwater drilling system of FIG. 1, wherein the attachment leg comprises a fluidic actuator, an expandable leg assembly attached to the fluidic actuator, and a suction cup base configured to be secured to a ship skin, according to at least one aspect of the present disclosure.
Figure 8:
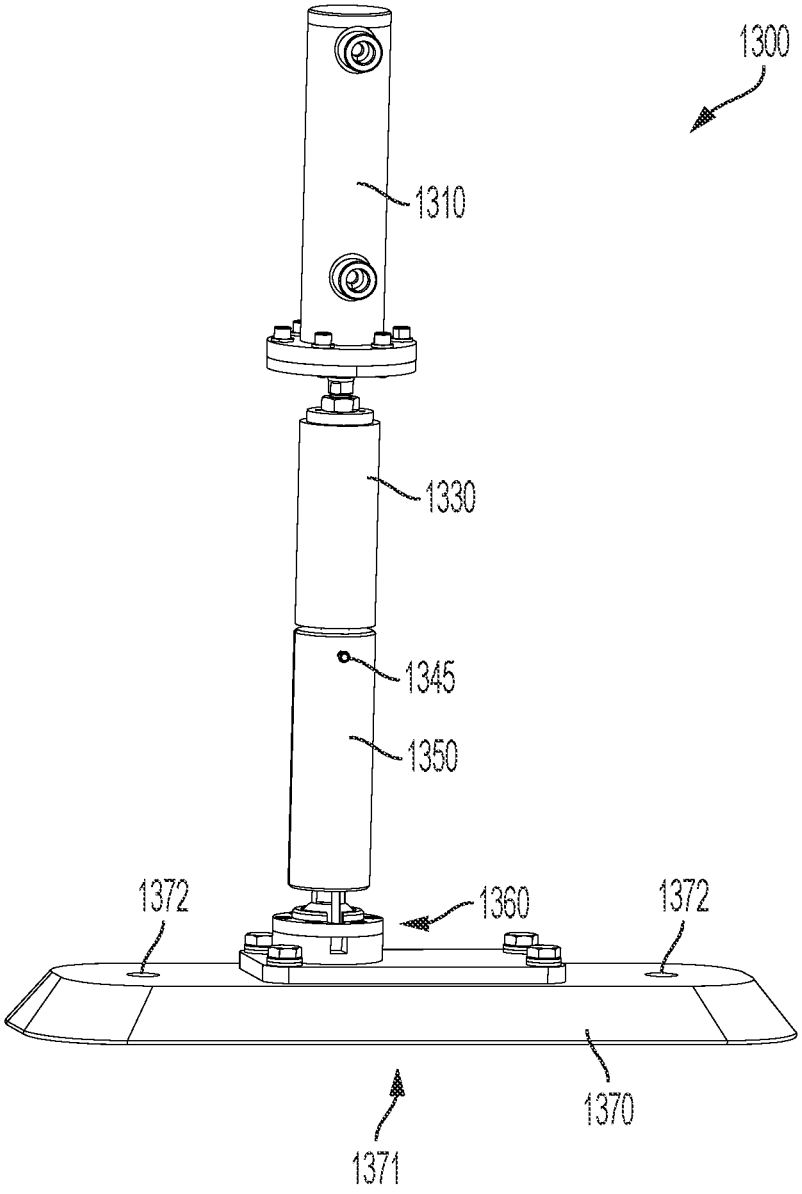
FIG. 8 is a partial perspective view of the attachment leg of FIG. 7, according to at least one aspect of the present disclosure.
Figure 9:
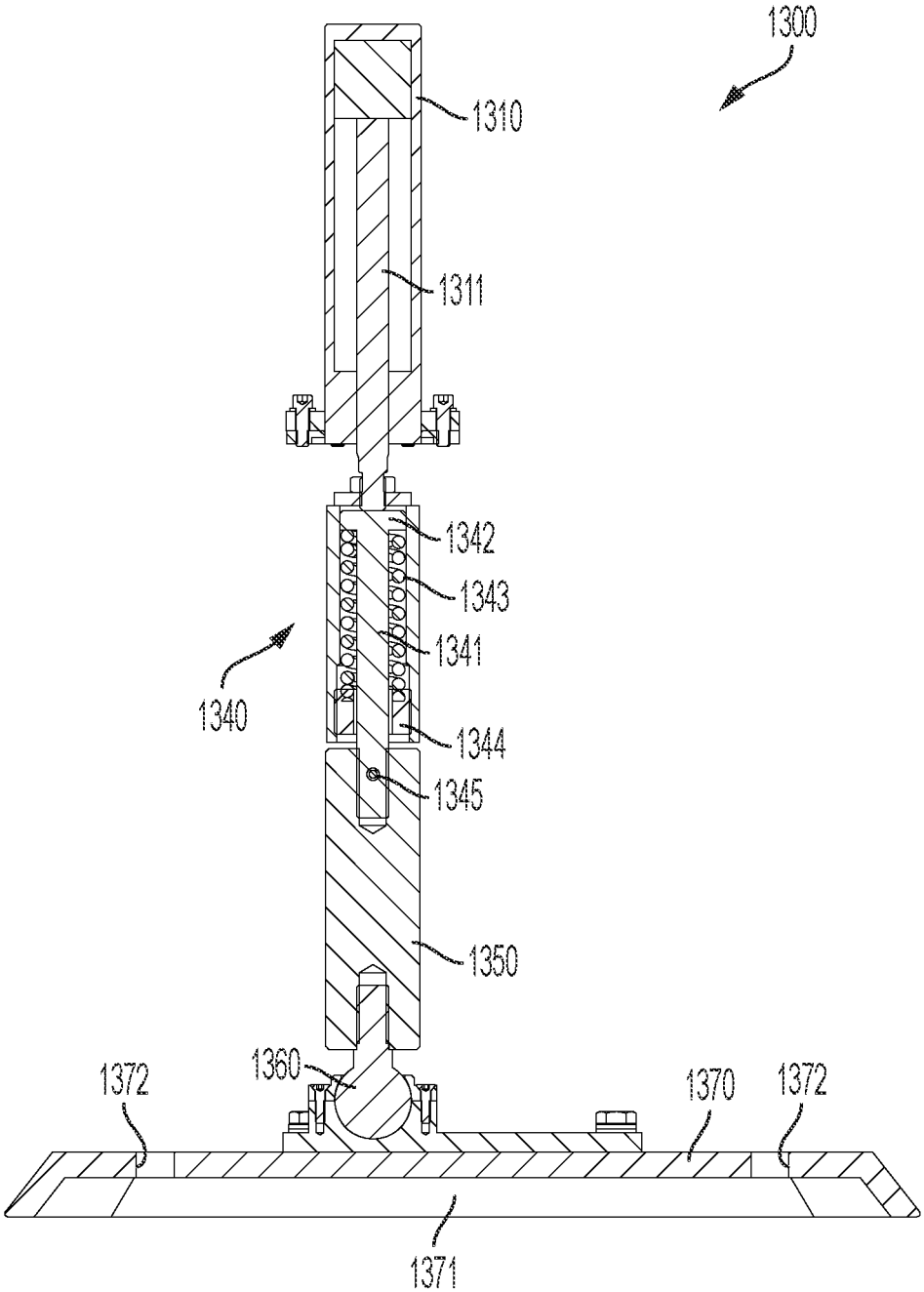
FIG. 9 is a cross-sectional view of a portion of the attachment leg of FIG. 7, wherein the expandable leg assembly comprises an upper leg portion attached to and translatable by the fluidic actuator and a lower leg portion spring loaded against the upper leg portion, according to at least one aspect of the present disclosure.

The drilling assembly 1400 further comprises a rotational carriage assembly 1470 (FIG. 3A) surrounding the primary drill shaft 1450. The rotational carriage assembly 1470 is configured to rotate the entire drilling assembly 1400 about a drill axis defined by the primary drill shaft 1450 so as to align the outer drill shaft 1430 with each self-tapping connection stud 1200. Referring primarily to FIG. 3A, the rotational carriage assembly 1470 comprises a first linear fluidic actuator 1471 attached to the lower platform 1120, a second linear fluidic actuator 1472, a drive linkage 1475 connected to the first linear fluidic actuator 1471 and the second linear fluidic actuator 1472, and a rotational carriage gear segment 1480 surrounding the primary drill shaft 1450. The drive linkage 1475 is operably engaged with the rotational carriage gear segment 1480. The linear fluidic actuators 1471, 1472 are cooperatively actuatable to rotate the rotational carriage gear segment 1480 to align the outer drive shaft 1430 with each self-tapping connection stud 1200.

When the outer drive shaft 1430 is aligned with one of the self-tapping connection studs 1200, the first linear fluidic actuator 1420 is actuated to advance the outer drive shaft 1430 toward a driving head 1211 of the self-tapping connection stud 1200 in its pre-staged configuration. Once the outer drive shaft 1430 is operably engaged with the driving head 1211, the linear fluidic actuator 1420 and the rotary fluidic actuator 1410 are cooperatively actuatable to linearly and rotationally drive the self-tapping connection stud 1200 into the ship skin from its pre-staged configuration. Once the self-tapping connection stud 1200 is installed or breaks, as discussed in greater detail below, the first linear fluidic actuator 1420 is actuated to retract the outer drill shaft 1430 to a home position. Once the outer drill shaft 1430 is in the home position, the rotational carriage gear segment 1480 is rotated to align the outer drill shaft 1430 with another self-tapping connection stud 1200. This process is repeated until all of the self-tapping connection studs 1200 are affixed to the ship skin and/or the flange connection assembly 1600 is adequately installed in the ship skin. In at least one instance, one or more of the self-tapping connections studs 1200 may break during attachment of the flange connection assembly 1600. In at least one instance, every self-tapping connection stud 1200 need not be fully driven into the ship skin to attain adequate attachment of the flange connection assembly 1600 to the ship skin.

Figure 27:
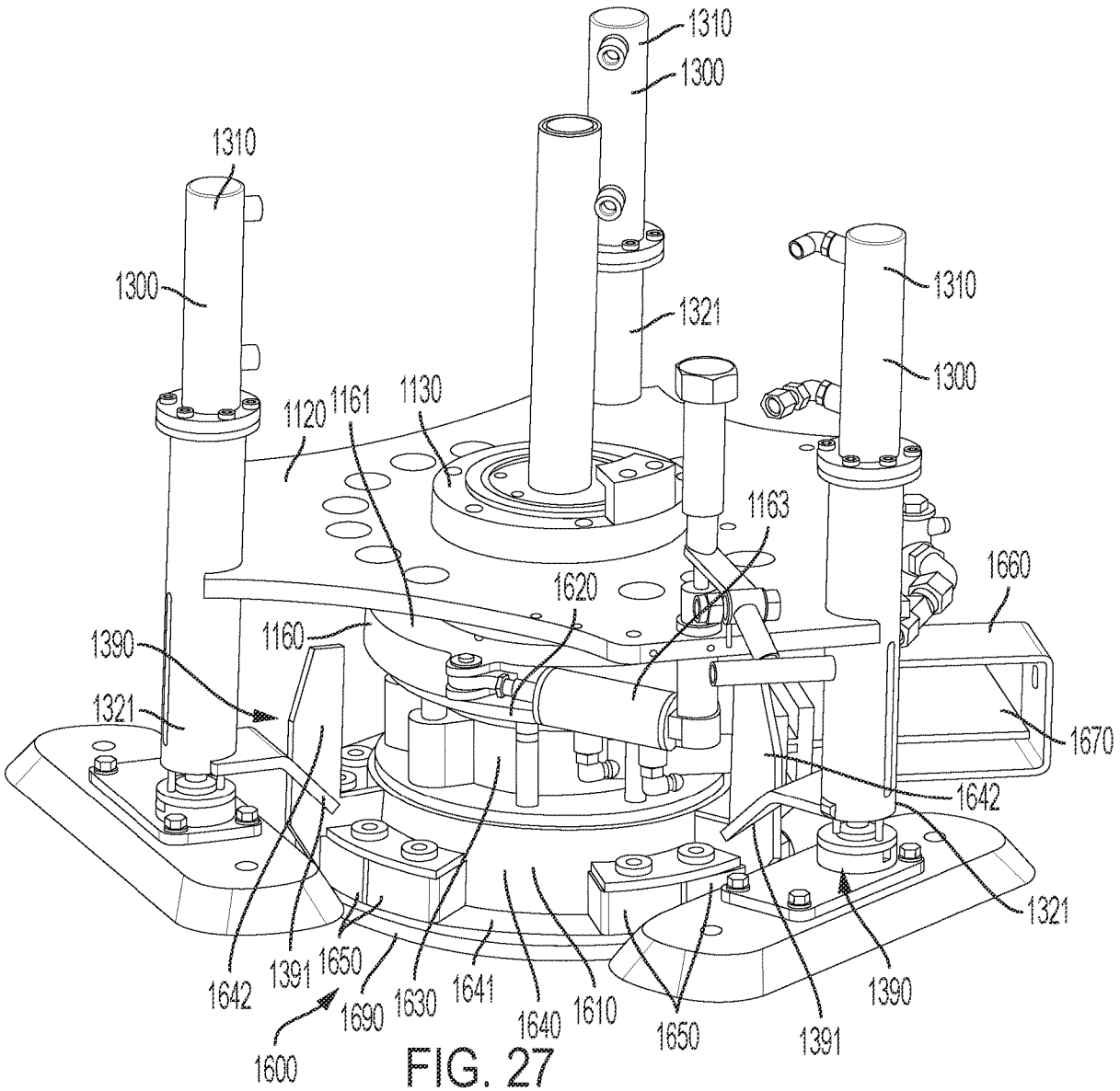
FIG. 27 is a partial perspective view of the underwater drilling system of FIG. 1, wherein the underwater drilling system further comprises a latching assembly configured to couple and decouple the connection flange assembly to and from the frame, according to at least one aspect of the present disclosure.

As discussed above, the flange connection assembly 1600 is secured to the ship skin by the self-tapping connection studs 1200. In various instances, debris and/or waste fluid may be urged to escape from the holes drilled and/or tapped by each self-tapping connection stud 1200. Thus, the flange connection assembly 1600 comprises a containment structure 1650 for each self-tapping connection stud 1200 in an attempt to remedy the issue of escaping debris and/or waste fluid. The containment structures 1650 and self-tapping connection studs will now be described in greater detail. As can be seen in FIGS. 2, 3, and 27 the flange connection assembly 1600 comprises an outer rim 1641. The outer rim 1641 comprises the plurality of containment structures 1650. Each containment structure 1650 is aligned with one of the self-tapping connection studs 1200.

Referring now to FIGS. 18-26, each self-tapping connection stud 1200 comprises a head portion 1210, a shank 1220, self-tapping threads 1230, and a cutting body 1240. The head portion 1210 comprises a driving head 1211 configured to be engaged and rotated by the outer drill shaft 1430. The head portion 1210 is configured to be secured within the grommet structures 1121 prior to engagement with the outer drill shaft 1430. The head portion 1210 further comprises an upper flange portion 1212. In at least one instance, the upper flange portion 1212 is also configured to be pushed downwardly by the outer drill shaft 1430 to linearly advance the self-tapping connection stud 1200. The head portion 1210 further comprises a primary head flange, or locking collar, 1213 configured to abut the flange connection assembly 1600 upon installation of the self-tapping connection stud 1200 into the ship skin.

Figure 18:
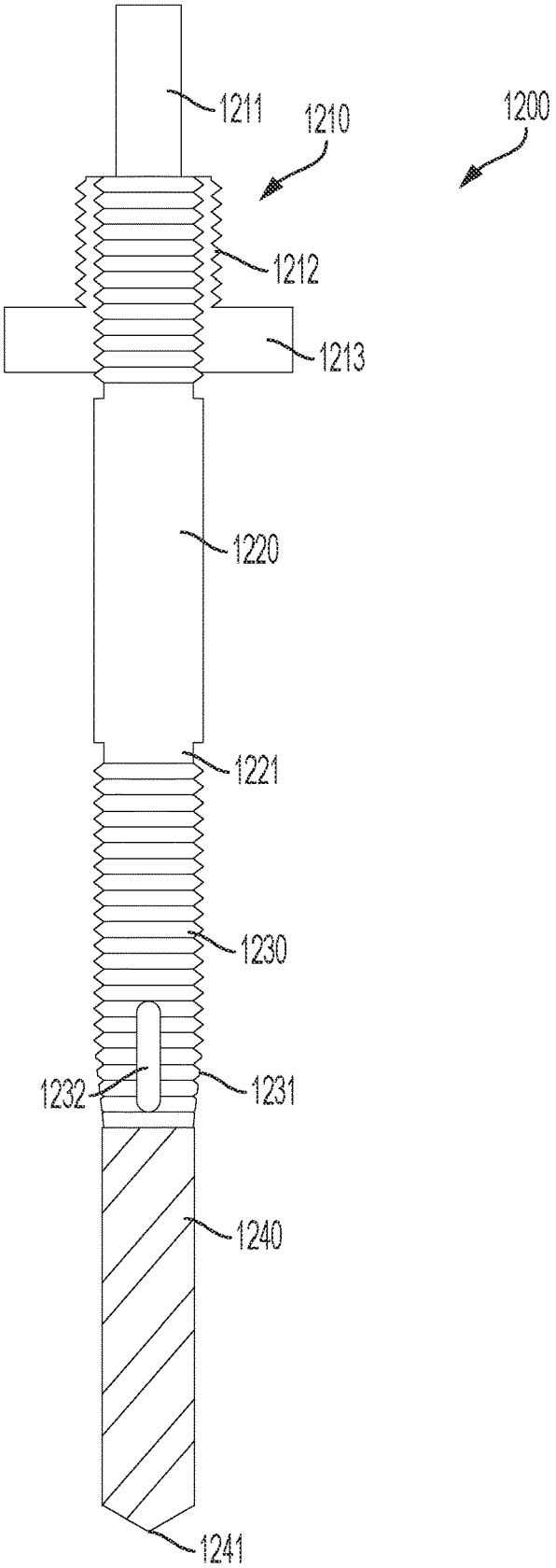
FIG. 18 is a partial cross-sectional view of a self-tapping connection stud of a plurality of self-tapping connection studs of the underwater drilling system of FIG. 1, wherein the self-tapping connection stud is configured to be drilled into a ship skin to affix the connection flange assembly of the underwater drilling system of FIG. 1 to the ship skin, and wherein the self-tapping connection stud comprises a cutting body, self-tapping threads, a shank portion, and a drivable head, according to at least one aspect of the present disclosure.

Referring primarily to FIG. 18, the shank 1220 extends downwardly from the primary head flange 1213 and to the self-tapping threads 1230. Between the shank 1220 and the self-tapping threads 1230, a break point, or discontinuity portion, 1221 is positioned, discussed in greater detail below. The self-tapping threads 1230 comprise a tapered threaded section 1231 and a relief slot 1232. The self-tapping threads 1230 are configured to be driven into the ship skin to secure the self-tapping connection stud 1200 and, thus, the flange connection assembly 1600, to the ship skin. The cutting body 1240 comprises a tip 1241 and is configured to cut a hole in the ship skin for the self-tapping threads 1230 to engage.

Each containment structure 1650 comprises a containment body 1651 and a grommet 1652 positioned on top of and within the containment body 1651. Collectively, the containment body 1651 and the grommet 1652 define a containment cavity 1653. In at least one instance, the containment body is a traditional metal pipe nipple, for example, to provide a rigid structure against which the self-tapping connection stud 1200 can be fastened. In at least one instance, the pipe nipple is welded to the outer rim 1641. Any suitable rigid structure can be used. In at least one instance, the grommet 1652 comprises a rubber material. Any suitable material can be used for the grommet 1652. The grommet 1652 is configured to retain its position illustrated in FIGS. 19-26 so as to maintain the containment cavity 1653 throughout the installation of the self-tapping connection stud 1200. Maintaining the containment cavity 1653 with a constant volume throughout the installation of the self-tapping connection stud 1200 can ensure room for debris and/or waste fluid, for example, from interfering with the installation of the self-tapping connection stud 1200. For example, as the self-tapping connection stud 1200 is driven into the ship skin 1001, debris can be free to float within the containment cavity 1653 during installation rather than getting jammed between the self-tapping connection stud 1200 and the ship skin 1001. In at least one instance, the volume of the containment cavity 1653 is based on the amount of predicted debris from installing the self-tapping connection stud 1200. For example, the volume of the containment cavity 1653 may at least be able to contain a volume of metal shavings equal to the resultant metal shavings from a ship skin having a maximum thickness through which a stud 1200 would be attempted to be installed.

In at least one instance, a grommet is rigidly supported within the containment body 1651 and not on top of and within the containment body 1651. In such an instance, the grommet may be configured to slide downwardly relative to the containment body 1651 during installation of the self-tapping connection stud 1200. In at least one instance, the grommet is positioned near and/or at the bottom of the containment body 1651 abutting the outer rim 1641 of the flange connection assembly 1600. In such an instance, downward force applied to the grommet bolsters the seal to prevent fluid and/or debris from escaping through the hole drilled in the ship skin by the self-tapping connection stud 1200.

Figure 19:
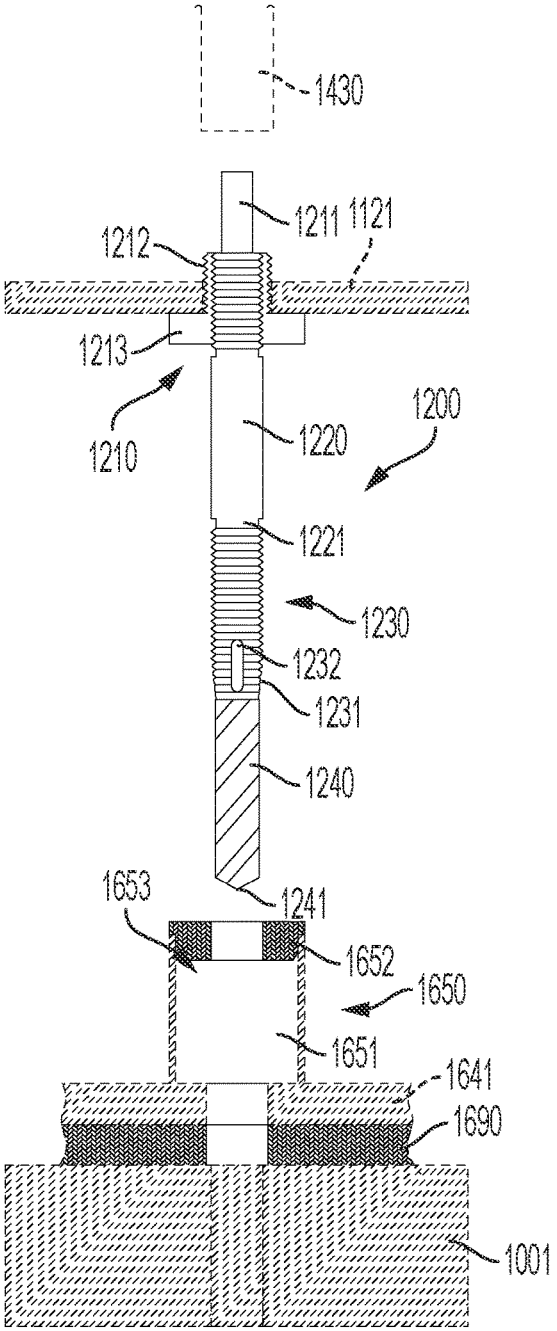
FIG. 19 is partial cross-sectional view of the self-tapping connection stud of FIG. 18 and a containment structure of the connection flange assembly of FIG. 1, wherein the self-tapping connection stud is illustrated in an initial, unactuated position, and wherein the containment structure comprises a sealing grommet and a containment cavity through which the self-tapping connection stud is configured to pass, according to at least one aspect of the present disclosure.
Figure 20:
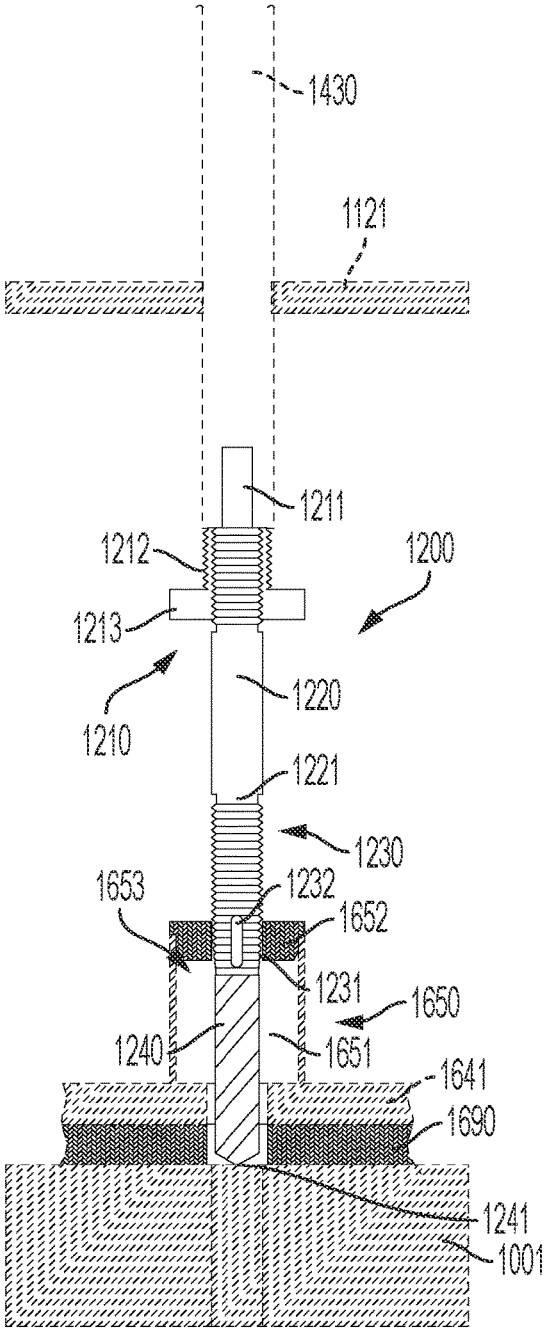
FIG. 20 is a partial cross-sectional view of the self-tapping connection stud of FIG. 18 and the containment structure of the connection flange assembly of FIG. 1, wherein the self-tapping connection stud is illustrated in an initial-contact position, according to at least one aspect of the present disclosure.
Figure 21:
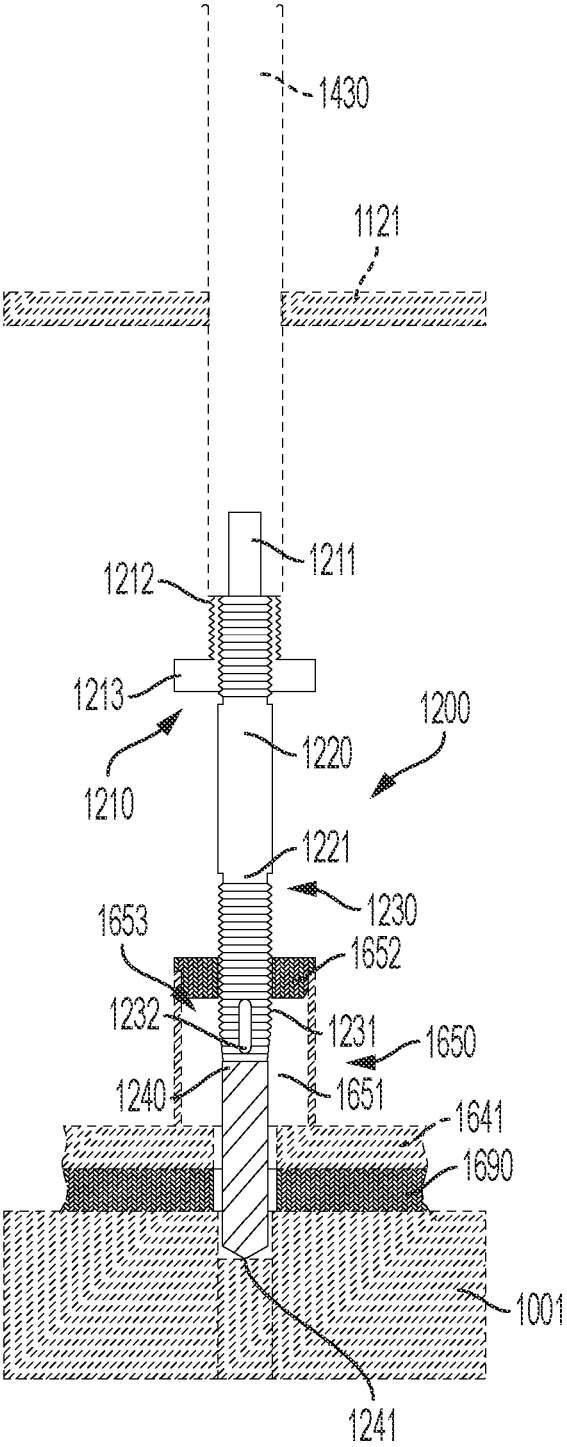
FIG. 21 is a partial cross-sectional view of the self-tapping connection stud of FIG. 18 and the containment structure of the connection flange assembly of FIG. 1, wherein the self-tapping connection stud is illustrated in a first partially-drilled position, according to at least one aspect of the present disclosure.
Figure 22:
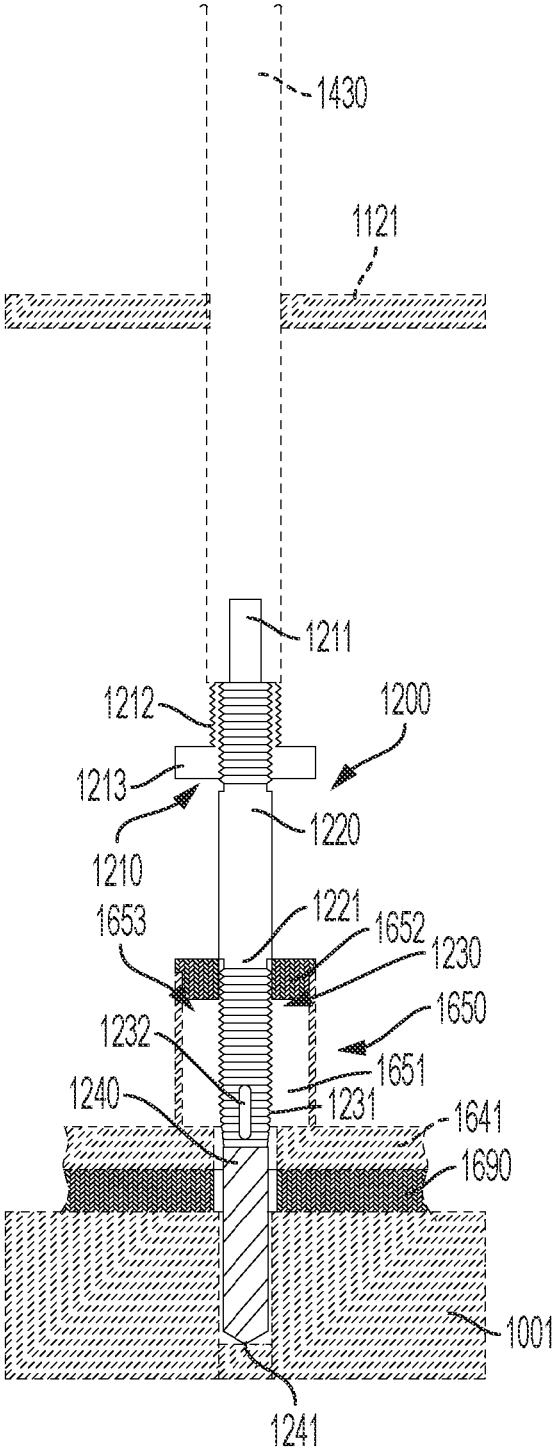
FIG. 22 is a partial cross-sectional view of the self-tapping connection stud of FIG. 18 and the containment structure of the connection flange assembly of FIG. 1, wherein the self-tapping connection stud is illustrated in a second partially-drilled position, according to at least one aspect of the present disclosure.

FIGS. 18-24 illustrate the process of fully driving, or installing, the self-tapping connection stud 1200 into a ship skin 1001 utilizing the containment structures 1650. FIG. 19. illustrates the self-tapping connection stud 1200 in an unactuated position as does FIGS. 2 and 3, for example. To drive the self-tapping connection stud 1200 into the ship skin 1001, the outer drill shaft 1430 is brought into driving engagement with the driving head 1211 (FIG. 20) and the self-tapping connection stud 1200 is driven down through the containment structure 1650 to bring the cutting tip 1241 into contact with the ship skin 1001. At this location, the self-tapping threads 1230 are in sealing engagement with the grommet 1652 thereby initiating the seal between the grommet 1652 and the ship skin 1001. Once in contact with the ship skin 1001, rotation and downward axial translation of the self-tapping connection stud 1200 is continued to cut a hole in the ship skin 1001 where the self-tapping threads 1230 maintain sealing engagement with the grommet 1652 to prevent debris and/or waste fluid from escaping the containment cavity 1653 (FIG. 21).

Figure 23:
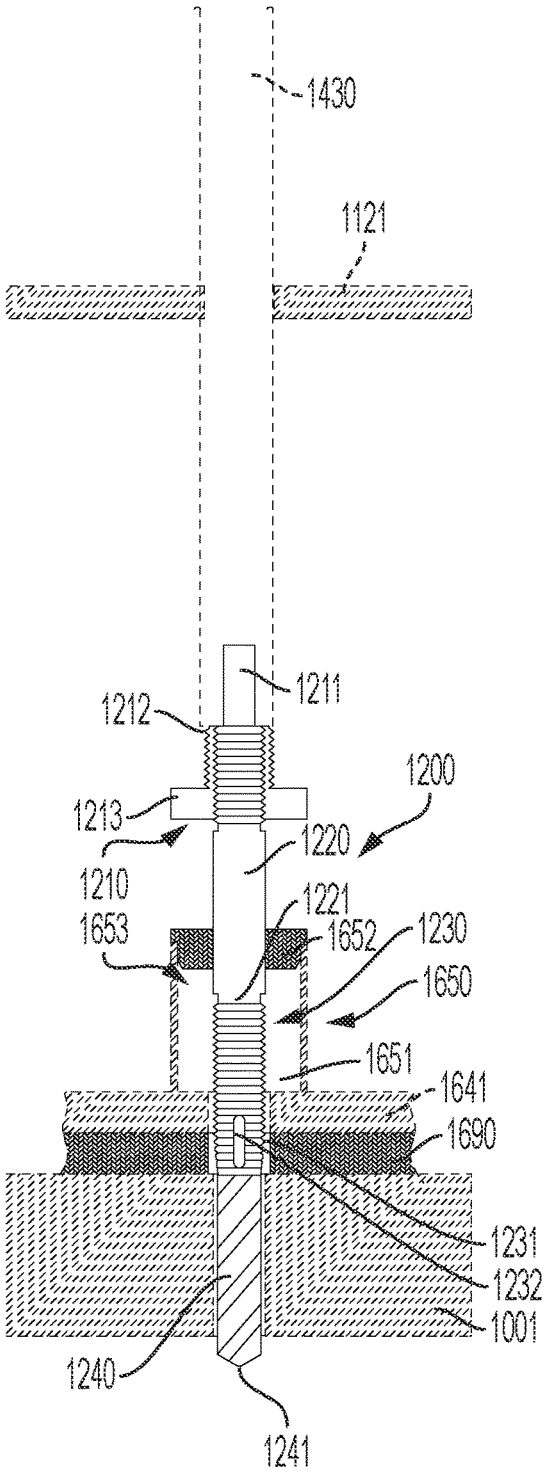
FIG. 23 is a partial cross-sectional view of the self-tapping connection stud of FIG. 18 and the containment structure of the connection flange assembly of FIG. 1, wherein the self-tapping connection stud is illustrated in a fully-drilled position, according to at least one aspect of the present disclosure.
Figure 24:
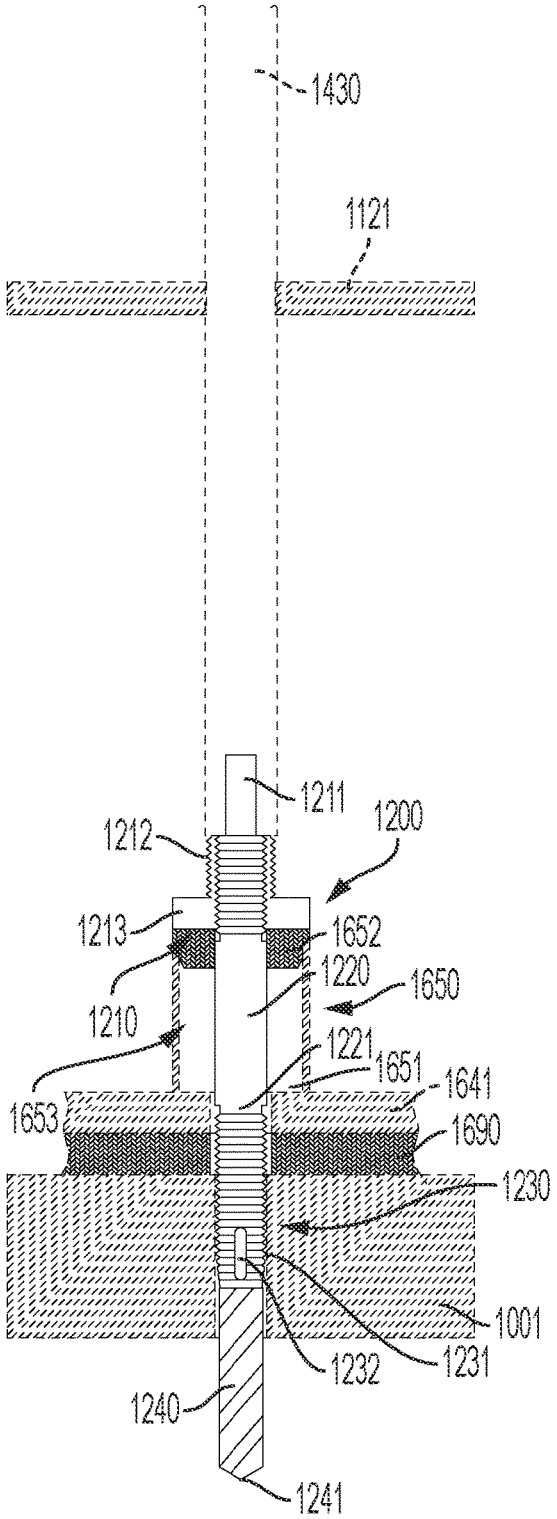
FIG. 24 is a partial cross-sectional view of the self-tapping connection stud of FIG. 18 and the containment structure of the connection flange assembly of FIG. 1, wherein the self-tapping connection stud is illustrated in a fully-installed position, according to at least one aspect of the present disclosure.

As the self-tapping connection stud 1200 is driven further into the ship skin 1001, the sealing engagement between the self-tapping connection stud 1200 and the grommet 1652 transfers (FIG. 22) from the self-tapping threads 1230 to the shank 1220. Further axial translation and rotary actuation of the self-tapping connection stud provides a sealing engagement between the shank 1220 and the grommet 1652 (FIG. 23). Finally, upon driving the self-tapping connection stud 1200 fully against (FIG. 24) the containment structure 1650 to secure the outer rim 1641 to the ship skin 1001, the outer drill shaft 1430 can be retracted and repositioned to drive another self-tapping connection stud 1200 through another containment structure 1650. The containment cavity 1653 may have collected waste fluid and/or debris during the installation of self-tapping connection stud 1200 where the fluid and/or debris will be trapped to prevent the release of the fluid and/or debris into the surround ocean water, for example.

As discussed above, the self-tapping connection studs 1200 may break and/or fail during installation. The studs 1200 may break and/or fail for any number of reasons. For example, unpredictable ship skin material (tougher-than-expected ship skin), unpredictable ship skin thickness (thicker-than-expected ship skin), manufacturing irregularities of the self-tapping connection stud, and/or interfering objects within the ship skin and/or hull into which the cutting tip 1241 crashes, may all increase the risk of the failure of self-tapping connection stud during installation of the stud. Failure of the stud may cause unintended waste fluid and/or debris escaping. The self-tapping connection studs 1200 and containment structures 1650 are configured to remedy these issues.

Figure 25:
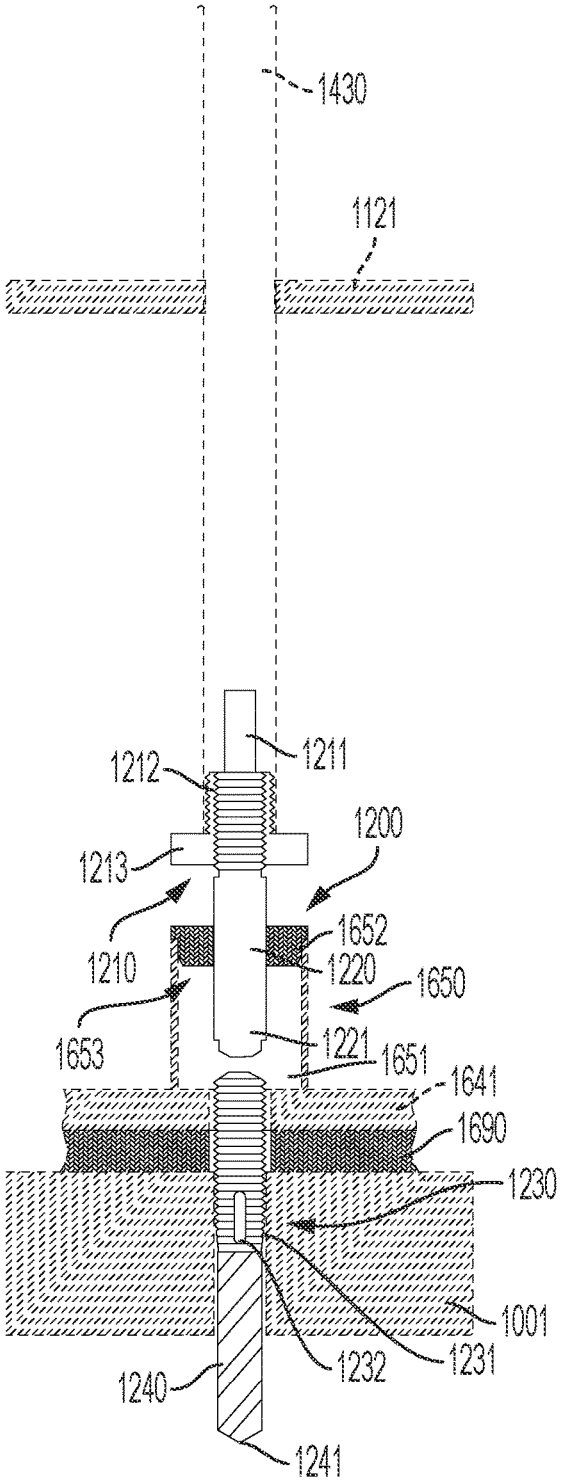
FIG. 25 is a partial cross-sectional view of the self-tapping connection stud of FIG. 18 and the containment structure of the connection flange assembly of FIG. 1, wherein the self-tapping connection stud is illustrated in a first failed configuration, according to at least one aspect of the present disclosure.

Turning to FIG. 25, the self-tapping connection stud 1200 is illustrated in a first failed configuration. The break point 1221 is provided on the connection stud 1200 so as to direct, or isolate, mechanical failure of the self-tapping connection stud 1200 to the location of the break point 1221 should the self-tapping connection stud 1200 fail. Isolating the failure of the self-tapping connection can reduce the likelihood of failure of the self-tapping connection stud 1200 at other locations which may increase the risk of waste fluid and/or debris leakage. Further to the above, the grommet 1652 is configured to hold the head portion 1210 and shank 1220 after the failure so as to maintain the sealed containment cavity 1653 and trap any waste fluid and/or debris which escaped during the installation of the self-tapping connection stud 1200.

Figure 26:
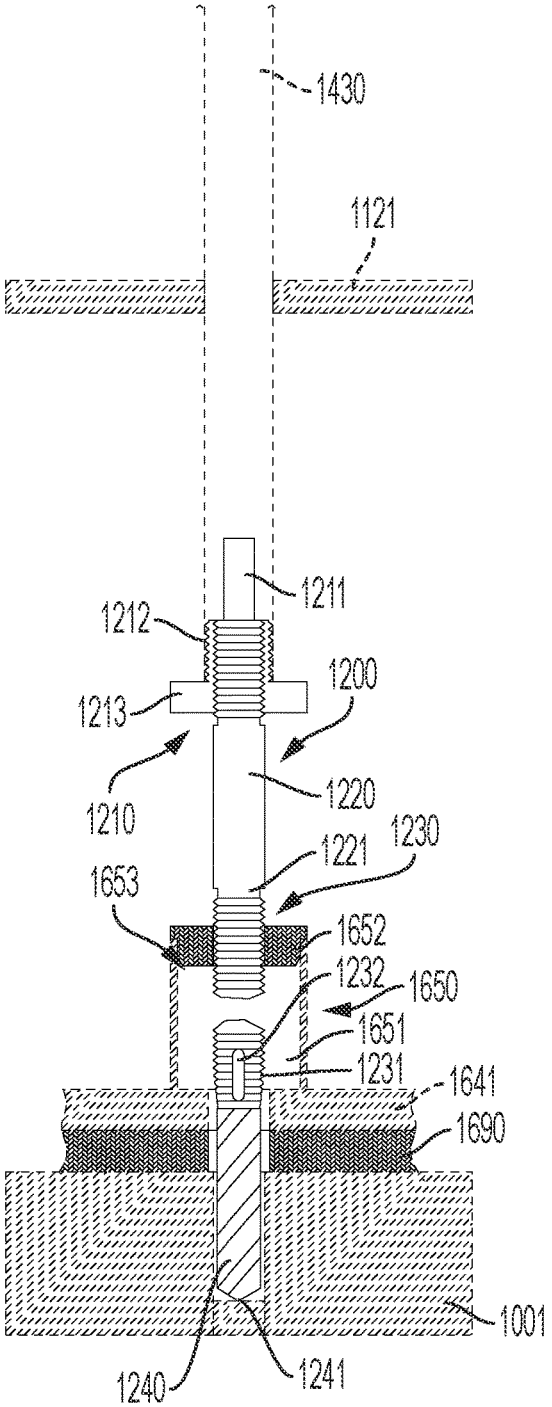
FIG. 26 is a partial cross-sectional view of the self-tapping connection stud of FIG. 18 and the containment structure of the connection flange assembly of FIG. 1, wherein the self-tapping connection stud is illustrated in a second failed configuration, according to at least one aspect of the present disclosure.

Turning to FIG. 26, the self-tapping connection stud 1200 is illustrated in a second fail configuration. The break point in this instance is within the self-tapping threads 1230. This failure may also be less disastrous than other locations for similar reasons as to the reasons listed above regarding the first failed configuration. The sealing engagement is maintained between the grommet 1652 and the self-tapping threads 1230 and the grommet 1652 holds the failed portion of the self-tapping connection stud 1200 in position after the failure. While the hole was not completely drilled during this failure, the metal shavings produced during the drilling of the portion of the hole illustrated can be trapped in the containment cavity 1653.

Referring again to FIGS. 1-3, after the flange connection assembly 1600 is secured to the ship skin by the self-tapping connection studs 1200, the rotary fluidic actuator 1410 and the second linear fluidic actuator 1440 are cooperatively actuated to linearly advance and rotate the primary drill shaft 1450. Discussed in greater detail below, the primary drill shaft 1450 is configured to cut, or drill, a primary hole in the ship skin with a guide bit 1451 and an annular cutter 1452. In at least one instance, the primary drill shaft 1450 is geared within the transmission 1415 according to the torque and speed requirements for drilling a primary hole in the ship skin for fluid extraction while the outer drill shaft 1430 is geared within the transmission 1415 according to different torque and speed requirements for driving self-tapping connection studs 1200 into the ship skin. In at least one instance, more torque and less speed is optimal for the primary hole while limited torque and more speed is optimal for driving the self-tapping connection studs 1200 into the ship skin. Any suitable combination of torque and speed specifications can be used.

In at least one instance, multiple flange connection assemblies 1600 are configured to be used with the underwater drilling system 1000 so as to provide multiple fluidic access points through a ship skin. As a result, referring again to FIGS. 1-3 and also FIGS. 27-30, the flange connection assembly 1600 is coupleable to and decouplable from, and/or latchable to and de-latchable from, a frame coupling assembly 1130 of the frame 1100 by way of a latching assembly 1160 of the frame 1100. In at least one instance, this occurs on the ship. In at least one instance, this occurs at the drilling site. In at least one instance, this manually performed. In at least one instance, this is performed by the ROV.

Referring primarily to FIGS. 27-30, the frame coupling assembly 1130 comprises a male coupling portion 1140 fixedly attached to the lower platform 1120. The male coupling portion 1140 comprises a supporting flange 1141 and a male pipe end 1142 configured to be received within the flange connection assembly 1600 as discussed in greater detail below.

Figure 29:
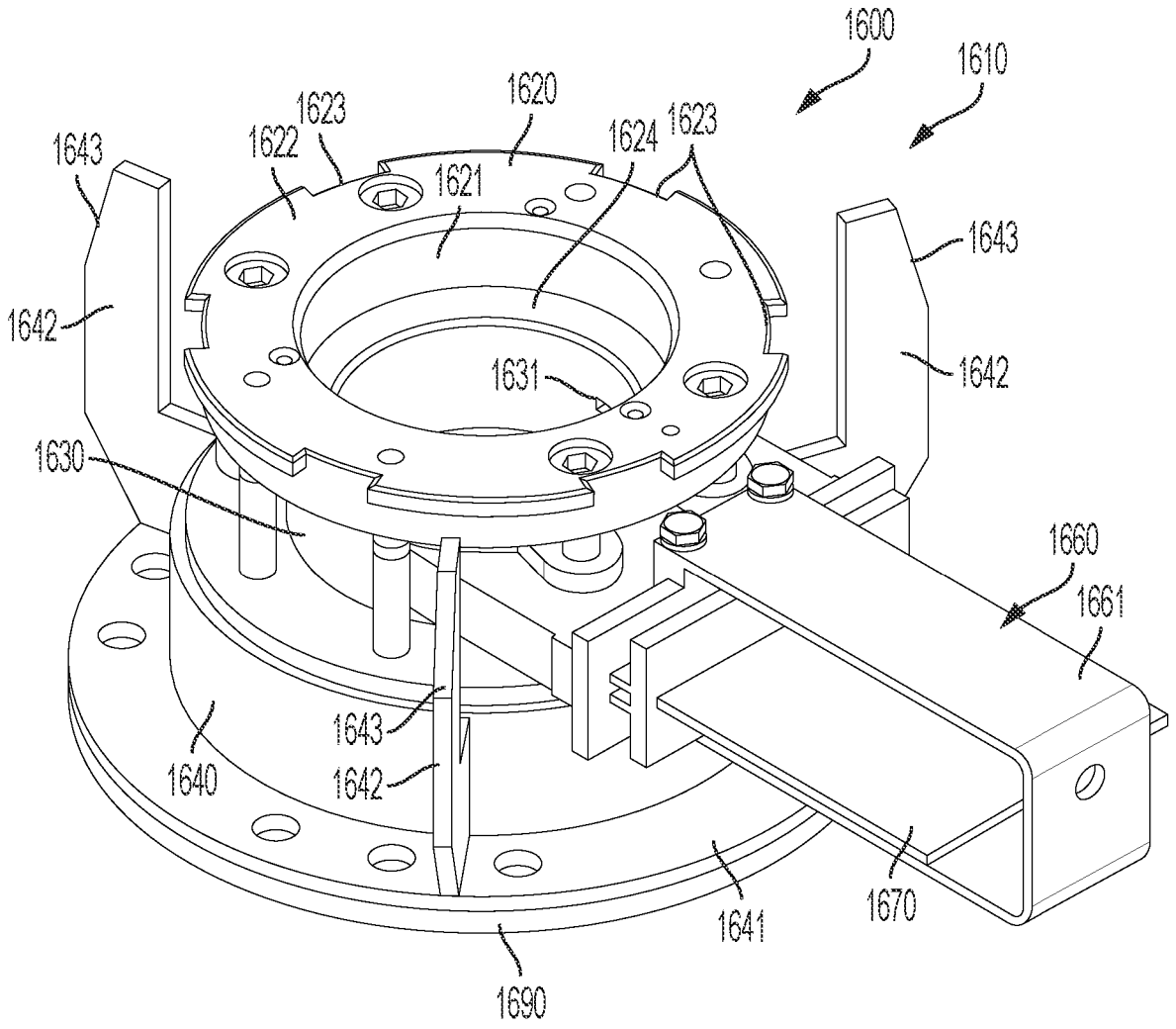
FIG. 29 is a perspective view of the connection flange assembly of the underwater drilling system of FIG. 1, wherein the connection flange assembly comprises a knife gate configured to provide an actuatable seal between a lower drill cavity and an upper drill cavity defined within the connection flange assembly, according to at least one aspect of the present disclosure.

Referring primarily to FIG. 29, the flange connection assembly 1600 comprises a female coupling portion 1610 configured to receive the male coupling portion 1140 therein, a knife gate bore 1630, and a lower coupling portion 1640 comprising the outer rim 1641. The female coupling portion 1610 comprises a coupling flange 1620 and a central bore section 1621 configured to receive the male pipe end 1142 of the male coupling portion 1140. In at least one instance, the central bore section 1621 comprises a machined inner surface configured to matingly seal with an outer surface of the male coupling portion 1140. In at least one instance, the outer surface of the male coupling portion 1140 is also machined to ensure a tight, sealing interface between the inner surface of the central bore section 1621 and the outer surface of the male coupling portion 1140. A gasket 1695 is also provided between male coupling portion 1140 and the central bore section 1621. In at least one instance, the gasket 1695 is positioned within a groove of the male coupling portion 1140. In at least one instance, the gasket 1695 is positioned within a groove of the inner surface of the central bore section 1621. The coupling flange 1620 comprises a mating face 1622 configured to mate with a corresponding mating face 1143 of the male supporting flange 1141. The coupling flange 1620 further comprises a plurality of slots 1623 defined therein.

To attach the flange connection assembly 1600 to the frame coupling assembly 1130, the latching assembly 1160 is placed in its unlocked configuration. The latching assembly 1160 comprises a linear fluidic actuator 1163 and a locking ring 1161 comprising a plurality of locking tabs 1162. The locking ring 1161 is axially fixed to the frame coupling assembly 1130; however, the locking ring 1161 is free to rotate relative to the frame coupling assembly 1130 between a locked position and an unlocked position. The linear fluidic actuator 1163 is actuated to rotate the locking ring 1161 relative to the frame coupling assembly 1130 between the locked position and the unlocked position.

Once the locking ring 1161 is in its unlocked position, the slots 1623 of the coupling flange 1620 are axially aligned with the locking tabs 1162 of the locking ring 1161 and the flange connection assembly 1600 is brought into abutting engagement with the supporting flange 1141 passing the locking tabs 1162 through the slots 1623. At this point, referring primarily to FIG. 28, the linear fluidic actuator 1163 is actuated to rotate the locking ring 1161 into the locked position, thereby rotating the locking tabs 1162 relative to the coupling flange 1620 and, thus, the slots 1623 thereby un-aligning the tabs 1162 and the slots 1623. When in its locked position, the locking ring 1161 is positioned such that the locking tabs 1162 axially constrain the flange connection assembly 1600 relative to the frame coupling assembly 1130. To remove the flange connection assembly 1600 from the frame coupling assembly 1130, the locking ring 1161 is rotated by the linear fluidic actuator 1163 into its unlocked position to axially re-align the locking tabs 1162 and the slots 1623 so that the male coupling portion 1140 may be removed from the female coupling portion 1610.

Figure 28:
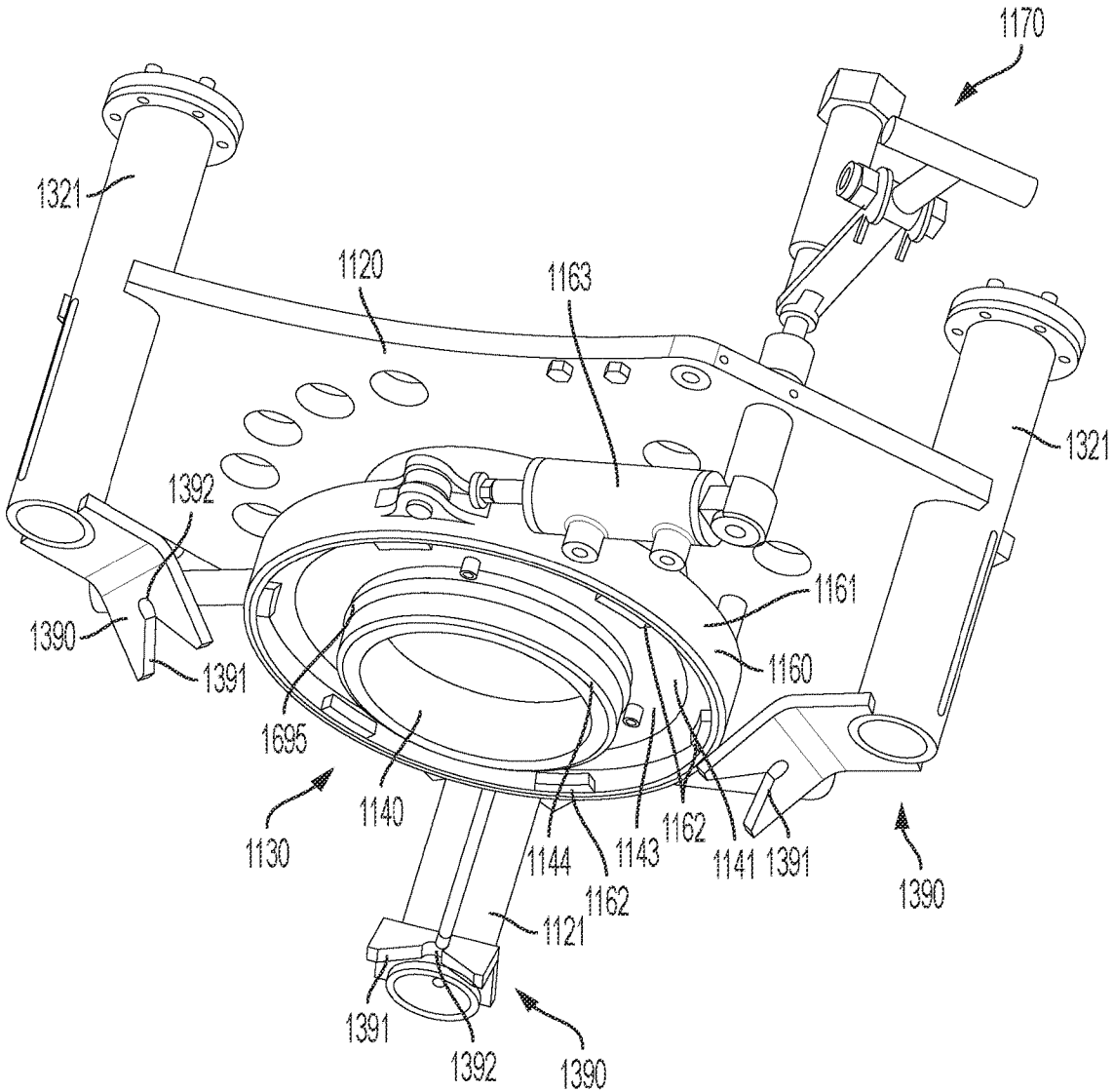
FIG. 28 is a partial perspective view of the underwater drilling system of FIG. 1, wherein the frame comprises a lower platform and a male coupling portion attached to a lower platform, wherein the male coupling portion is configured to be received by a female coupling portion of the connection flange assembly, and wherein the latching assembly comprises a locking ring configured to be rotated to lock and unlock the male coupling portion and the female coupling portion, according to at least one aspect of the present disclosure.

As can be seen in FIG. 28, the male coupling portion 1140 comprises a chamfered edge 1144. Such a chamfered edge may aid in inserting the male coupling portion 1140 into the female coupling portion 1610. In at least one instance, the male coupling portion 1140 is axially constrained by a ledge 1624 defined within the coupling flange 1620 in addition to by the mating face 1143 of the male supporting flange 1141. In at least one instance, the male coupling portion 1140 is axially constrained solely by the ledge 1624.

To prevent the flange connection assembly 1600 and the rest of the underwater drilling system 1000 from rotating relative to each other, a guiding system is employed. Referring primarily to FIGS. 27-29, the guiding system comprises a guiding tab 1390 extending from each outer housing member 1321 and corresponding guiding posts 1642 extending from the lower coupling portion 1640. Each tab 1390 comprises a lead-in slot portion 1391 configured to catch the post 1642 and a holding slot portion 1392. The lead-in slot portion 1391 comprises a tapered profile to lead into a tighter fit between the post 1642 and the tab 1390. Each post 1642 comprises a lead in surface 1643 configured to aid in aligning the post 1642 with the lead-in slot portion 1391. When the posts 1642 are positioned within the holding slot portion 1392, relative rotation between the attachment legs 1300 and the flange connection assembly 1600 is prevented. When removing the underwater drilling system 1000 from the installed flange connection assembly 1600, the tabs 1390 slide off of the posts 1642.

Referring to FIG. 28, in various instances, a manual unlatch actuator 1170 is connected to the latching assembly 1160 so as to permit manual rotation of the locking ring 1161. Such an actuator can be used in the event of an emergency, for example, requiring the decoupling, or de-latching, of the frame coupling assembly 1130 and the flange connection assembly 1600. In at least one instance, the unlatch actuator 1170 is configured to release hydraulic pressure from the linear fluidic actuator 1163 to automatically rotate the locking ring 1161 back into its unlocked position.

Referring primarily to FIG. 29, after the flange connection assembly 1600 is secured to the ship skin and the primary hole is drilled, a knife gate 1660 of the flange connection assembly 1600 is actuated to seal the flange connection assembly 1600 to one, prevent additional fluid from escaping out of the primary hole from the sunken ship beyond waste fluid and/or debris that may have escaped from the ship during the drilling of the primary hole and, two, permit purging of the waste fluid within the flange connection assembly 1600, discussed in greater detail below. The knife gate 1660 divides a drill cavity through which the drill shaft passes to drill the primary hole into an upper drill cavity and a lower drill cavity when the knife gate 1660 is actuated. In at least one instance, the knife gate 1660 is actuated by a linear fluidic actuator.

The knife gate 1660 comprises a gate frame 1661 and a knife gate bore 1630 extending from the gate frame 1661. The knife gate bore 1630 is fastened between the coupling flange 1620 and the lower coupling portion 1640. In at least one instance, the female coupling portion 1610, the knife gate bore 1630, and the lower coupling portion 1640 are made as a unitary body. The knife gate bore 1630 comprises a knife slot 1631 extending laterally through half of the knife gate bore 1630. The knife gate 1660 further comprises a sealing knife 1670 slidably supported within the gate frame 1661 and configured to be received within the slot 1631 to provide a fluidic seal between the female coupling portion 1610 and the lower coupling portion 1640. In at least one instance, the knife 1670 comprises a half moon end so as to save space within the flange connection assembly 1600 and maximize the effectiveness of the seal provided by the knife gate 1660 by limiting the profile of the knife 1670 to correspond to the inside of the knife gate bore 1630 and allow an edge of the half moon end to press against the inside of the knife gate bore 1630. In at least one instance, a rubber cap is provided on the half moon end to further bolster the fluidic seal of the knife 1670 within the knife gate bore 1630. The sealing knife 1670 may comprise any suitable material such as, for example, metal, plastic, wood, and/or rubber.

After the knife gate 1660 is closed, waste fluid and/or debris which escaped from the primary hole during the drilling of the primary hole is trapped in the upper drill cavity defined in a male coupling portion 1140. The waste fluid and/or debris trapped in the upper drill cavity is now purged from the upper drill cavity into the waste cartridge assembly 1800 of the underwater drilling system 1000 in an attempt to reduce or eliminate waste fluid and/or debris from escaping into the surrounding medium such as, for example, ocean water when the rest of the underwater drilling system 1000 is separated from the installed connection flange assembly 1600. The waste cartridge Purging the waste fluid and/or debris from the upper drill cavity into the waste cartridge assembly 1800 will now be described. Referring primarily to FIGS. 31-36, waste fluid "WF" and/or debris is configured to be purged from the upper drill cavity into the waste cartridge assembly 1800. As can be seen in FIGS. 31-36, a drill cavity 1850 is defined within the frame coupling assembly 1130 and the flange connection assembly 1600 upon their operable connection to each other via the latch assembly 1160 described above. The drill cavity 1850 is defined as the cavity within the frame coupling assembly 1130 and the flange connection assembly 1600 through which the drill passes to drill the primary hole in the ship skin 1001.

The waste cartridge assembly 1800 comprises a waste cartridge 1810 mounted to the frame 1100. The waste cartridge 1810 is configured to collect and store waste fluid WF and/or debris purged from the drill cavity 1850. The waste cartridge 1810 comprises vents 1811 and a volume rod 1820. The volume rod 1820 is configured to move relative to an outer shell of the waste cartridge 1810 as waste fluid WF and/or debris pushes the volume rod 1820 upward relative to the outer shell.

Figure 31:
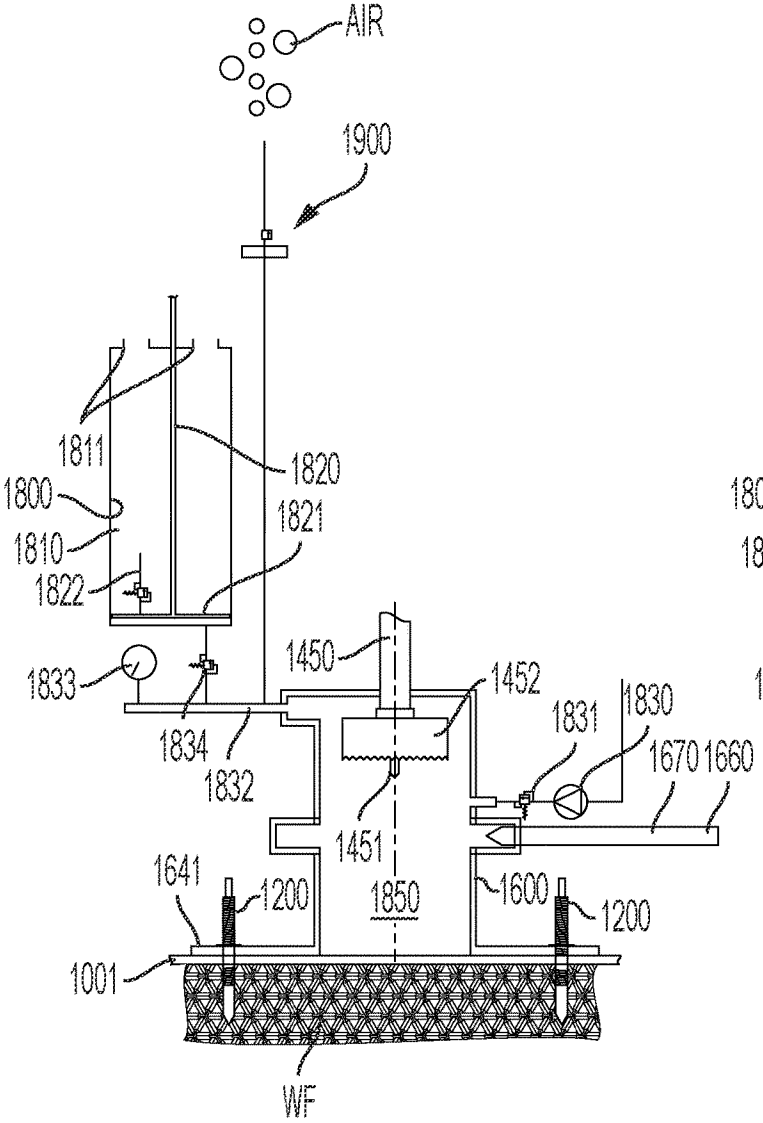
FIG. 31 is a schematic representation of a drill shaft of the drilling assembly, the male coupling portion of the frame, the connection flange assembly, and a waste cartridge of the underwater drilling system of FIG. 1 fluidically coupled to a drill cavity within the male coupling portion, wherein the waste cartridge is configured to collect waste fluid, and wherein the drill shaft is illustrated in an initial position, a according to at least one aspect of the present disclosure.

As can be seen in FIG. 31, the primary drill shaft 1450 is illustrated in an unactuated position and the primary hole has not yet been drilled. Prior to the drilling of the primary hole, the primary drill shaft 1450 is linearly translated toward the ship skin 1001 slightly (FIG. 32) to increase pressure within the drill cavity 1850 by increasing the volume of material of the primary drill shaft 1450 within the drill cavity 1850. The pressure is increased at this stage to test the seal of the drill cavity 1850. The pressure is indicated by a pressure gauge 1833. In at least one instance, fluid such as ocean water, for example, is pumped into the drill cavity 1850 while the primary drill shaft 1450 remains in an unactuated position to increase the pressure in the drill cavity 1850 and test the seal. In at least one instance, the pressure within the drill cavity 1850 is regulated and/or controlled by a check valve.

Figure 34:
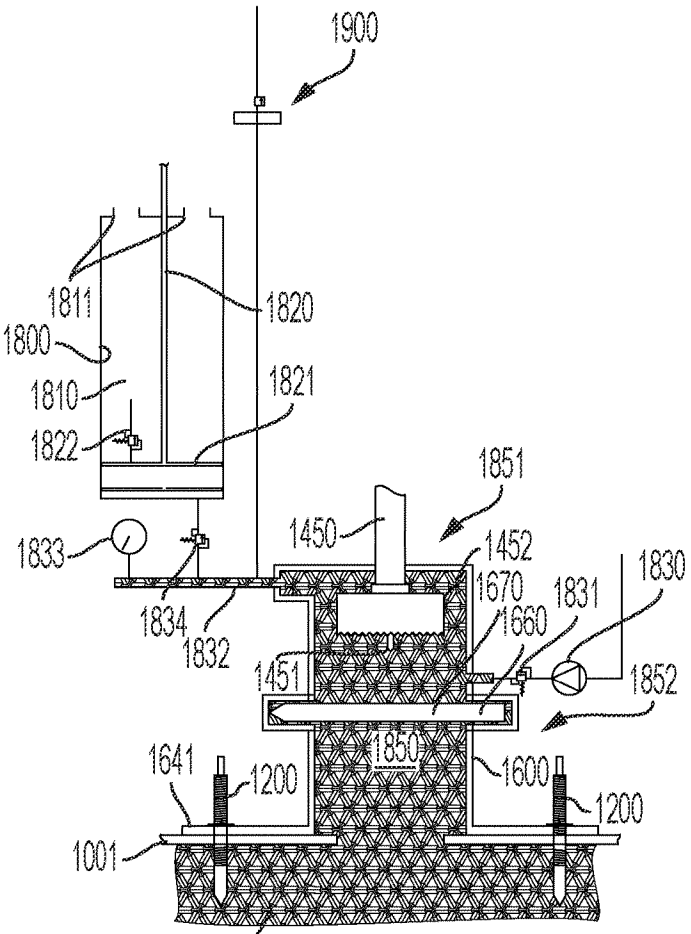
FIG. 34 is a schematic representation of the drill shaft, the male coupling portion, the connection flange assembly, and the waste cartridge of FIG. 31, wherein the drill shaft is illustrated in a retracted position and the knife gate of the connection flange assembly is illustrated in an actuated configuration to provide a seal between an upper drill cavity portion of the male coupling portion and a lower drill cavity portion of the connection flange assembly, according to at least one aspect of the present disclosure.
Figure 33:
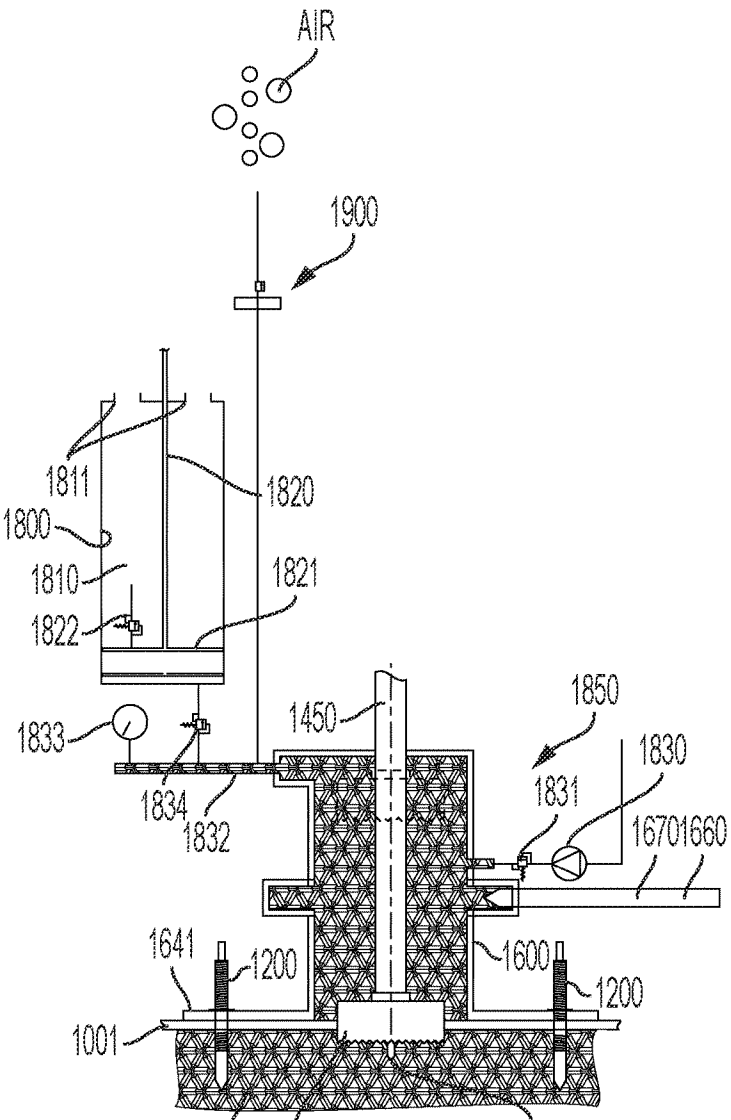
FIG. 33 is a schematic representation of the drill shaft, the male coupling portion, the connection flange assembly, and the waste cartridge of FIG. 31, wherein the drill shaft is illustrated in a hole-cutting position where fluid passes through the ship skin and into the drill cavity, according to at least one aspect of the present disclosure.
Figure 36:
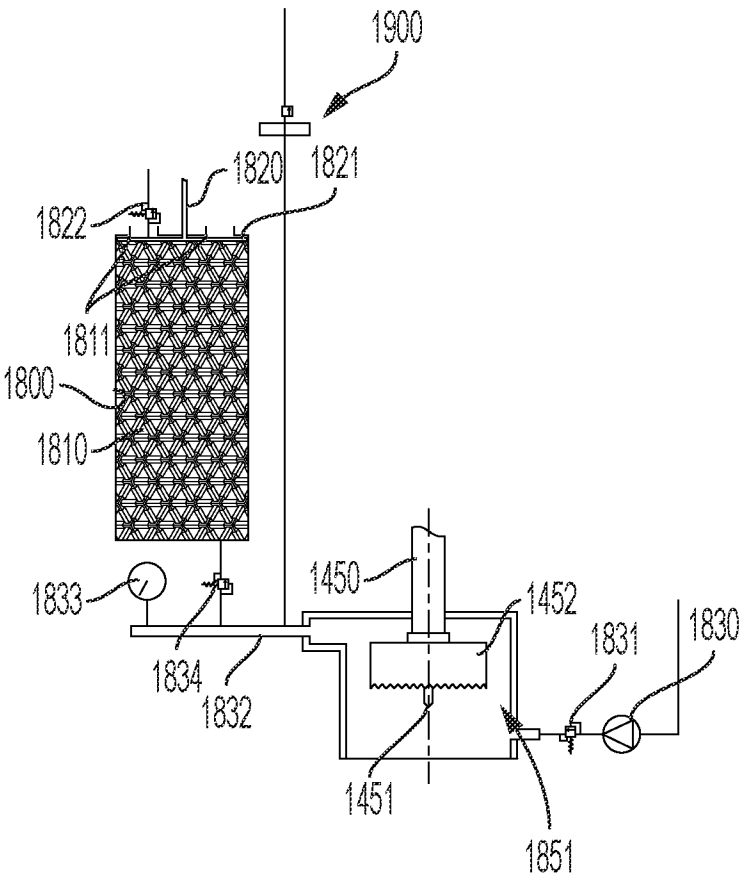
FIG. 36 is a is a schematic representation of the drill shaft, the male coupling portion, and the waste cartridge of FIG. 31 decoupled from the connection flange assembly of FIG. 31, wherein the waste cartridge is full of waste fluid, according to at least one aspect of the present disclosure.

Once a sufficient seal is detected, the primary drill shaft 1450 is driven through the drill cavity 1850 and into the ship skin 1001 (FIG. 33) to drill the primary hole in the ship skin 1001 with the guide bit 1451 and annular cutter 1452. In at least one instance, drilling of the primary hole and retraction of the primary drill shaft 1450 back into the home position causes waste fluid WF and/or debris to leak into the drill cavity 1850. Once the primary hole is drilled, the primary drill shaft 1450 is retracted into its home position (FIG. 34) and the knife gate 1660 is actuated to sealingly divide the drill cavity 1850 into an upper drill cavity 1851 and a lower drill cavity 1852. As can be seen in FIG. 34, waste fluid WF and/or debris is present within the upper drill cavity 1851 and the lower drill cavity 1852. The waste fluid WF and/or debris can now be purged from the upper drill cavity 1851 and into the waste cartridge 1810.

Figure 35:
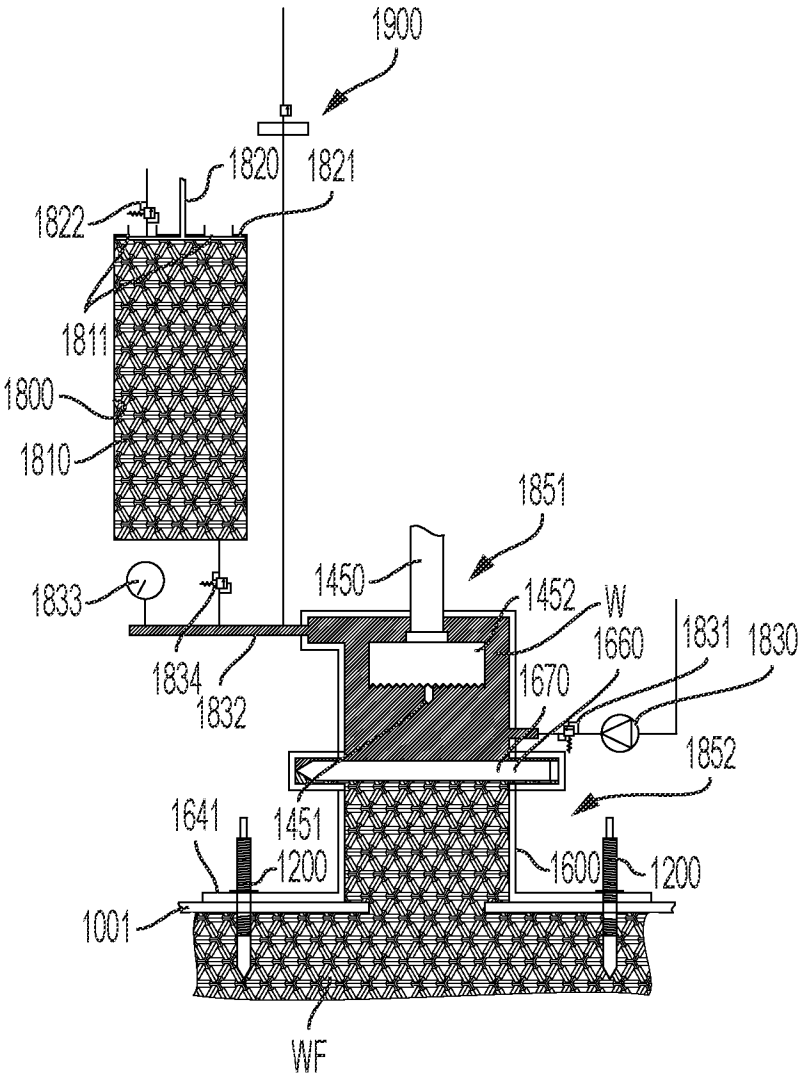
FIG. 35 is a schematic representation of the drill shaft, the male coupling portion, the connection flange assembly, and the waste cartridge of FIG. 31, wherein the drill shaft is illustrated in a retracted position and the knife gate of the connection flange assembly is illustrated in an actuated configuration, wherein a pump is configured to purge waste fluid within the drill cavity into the waste cartridge, according to at least one aspect of the present disclosure.

Referring to FIG. 35, to purge the waste fluid WF and/or debris within the upper drill cavity 1851, a pump 1830 pumps ocean water "W" into the upper drill cavity 1851 through a check valve 1831 configured to prevent backflow of fluid toward the pump from the upper drill cavity 1851. In at least one instance, the primary drill shaft 1450 is rotated to agitate the waste fluid WF and ocean water W in the upper drill cavity 1851 before, during, and/or after ocean water W is pumped into the upper drill cavity 1851. In at least one instance, the primary drill shaft 1450 is rotated constantly as the waste cartridge 1810 is filled with waste fluid WF.

Pumping ocean water W into the upper drill cavity 1851 causes the waste fluid WF and/or debris to be purged into the waste cartridge 1810 via outlet 1832 fluidically coupled to the frame coupling assembly. In at least one instance, the outlet 1832 is fluidically coupled to the male coupling portion 1140. The outlet 1832 comprises a check valve 1834 configured to prevent backflow of fluid toward the upper drill cavity 1851 from the waste cartridge 1810. In at least one instance, the check valve 1834 is also configured to regulate and/or control the pressure within the drill cavity 1850 and/or upper drill cavity 1851.

Still referring to FIG. 35, as waste fluid WF and/or debris flows into the waste cartridge 1810, the volume rod 1820 is pushed upwardly by a plunger head 1821 of the volume rod 1820 as the waste cartridge 1810 fills with waste fluid WF. In at least one instance, air can be trapped within the waste cartridge 1810 below the plunger head 1821. The plunger head 1821 comprises a check valve 1822 configured to automatically purge air trapped within the waste cartridge 1810. In at least one instance, air trapped within the waste cartridge 1810 may expand as the underwater drilling system 1000 is brought to the surface. The air will expel through the check valve 1822. The vents 1811 are further configured to purge fluid such as ocean water, for example, from the waste cartridge 1810 as the volume rod 1820 is pushed upwardly by the waste fluid WF.

In at least one instance, the volume rod 1820 is configured to be pulled upwardly during the purging of fluid from the upper drill cavity 1851 by a fluidic linear actuator to suck the waste fluid WF from the upper drill cavity 1851. The sucking force can be applied by the plunger head 1821 and can complement the pumping of water into the upper drill cavity 1851 by the pump 1830. In at least one instance, a pump is not used and ambient water can be sucked into the upper drill cavity 1851 through a check valve by the cartridge 1810. In at least one instance, a vacuum pump is utilized within the waste cartridge 1810 to apply further suction force to the fluid in the upper drill cavity 1851.

In at least one instance, the waste cartridge 1810 is sized to receive three times the volume of the upper drill cavity 1851. In such an instance, the waste fluid WF within the upper drill cavity can be purged three times to ensure a clean residual fluid (as close to 100% ocean water as possible, for example) remains within the upper drill cavity 1851 prior to removal of the underwater drilling system 1000 from the flange connection assembly 1600. The waste cartridge 1810 can comprise any suitable size. The waste cartridge 1810 further comprises a transparent shell so as to permit visual inspection of the contents of the waste cartridge during the purging of the upper drill cavity 1851. In at least one instance, the contents of the waste cartridge 1810 can be monitored by and/or through the ROV.

Once the waste cartridge 1810 is full and/or the purging process is complete, the male coupling portion 1140 and the flange connection assembly 1600 are decoupled to remove the underwater drilling system 1000 from the flange connection assembly 1600. The underwater drilling system 1000, containing the full waste cartridge 1810, can be taken to the surface to have the waste cartridge emptied and/or flushed out for a subsequent use. In at least one instance, the waste cartridge 1810 allows for a sample to be taken of the waste fluid WF collected prior to a full fluid extraction process. Also, at this point, a hose assembly can be connected to the flange connection assembly 1600, the knife gate 1660 can be opened, and fluid can be extracted from the ship hull, for example, through a full fluid extraction process.

In various instances, air trapped within the ship hull may be encountered during the drilling of the primary hole by the underwater drilling system 1000. This air can flow into subsea hoses and/or components of the underwater drilling system 1000 and, when the underwater drilling system 1000 is brought to the surface, the air can rapidly expand and possible cause an over-pressurization of the subsea hoses and/or components of the under water drilling system 1000. This rapid expansion can rupture the subsea hoses and/or components of the under water drilling system 1000.

Figure 30:
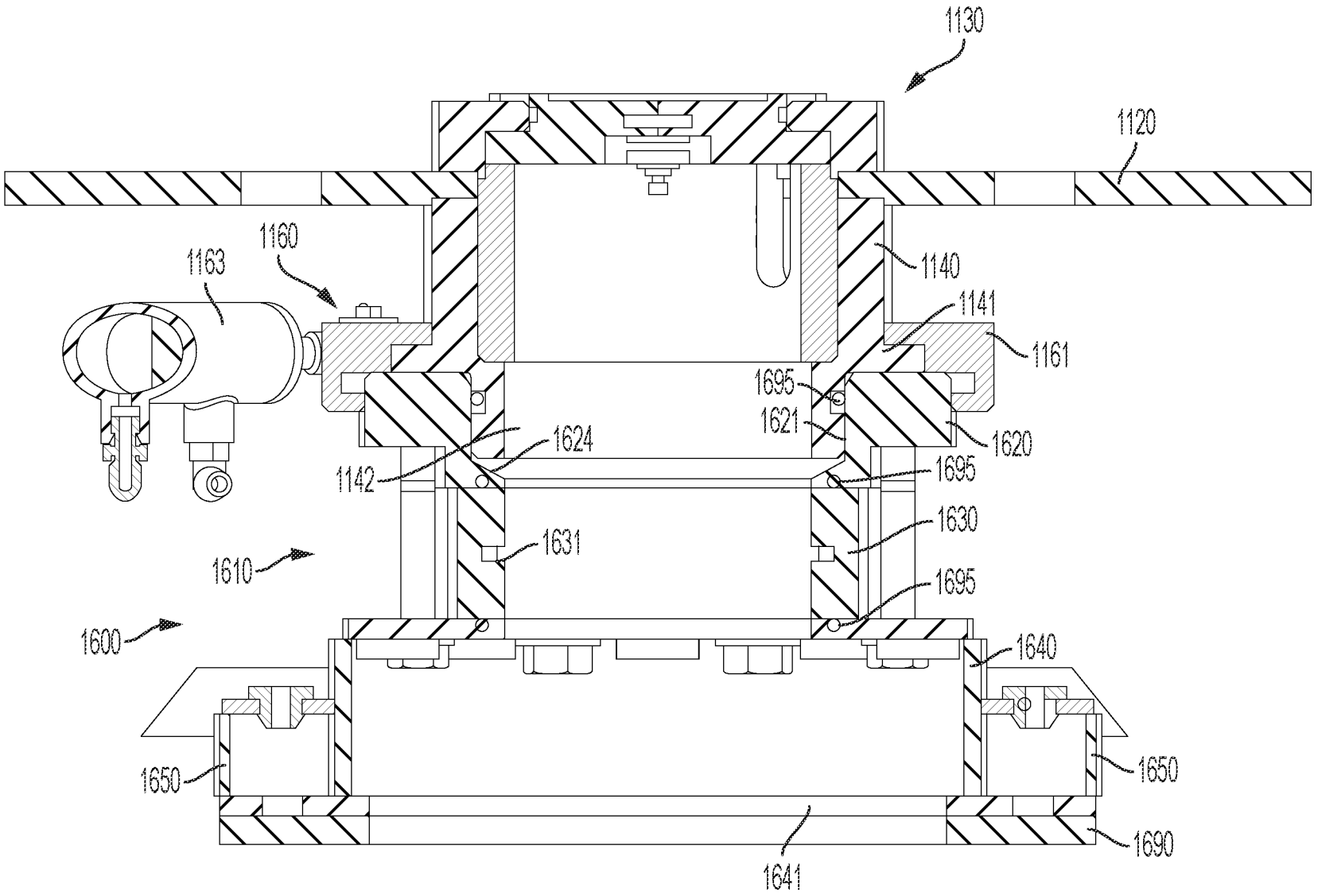
FIG. 30 is a cross-sectional view of the connection flange assembly, the lower platform of the frame, and the latching assembly of the underwater drilling system of FIG. 1, according to at least one aspect of the present disclosure.
Figure 32:
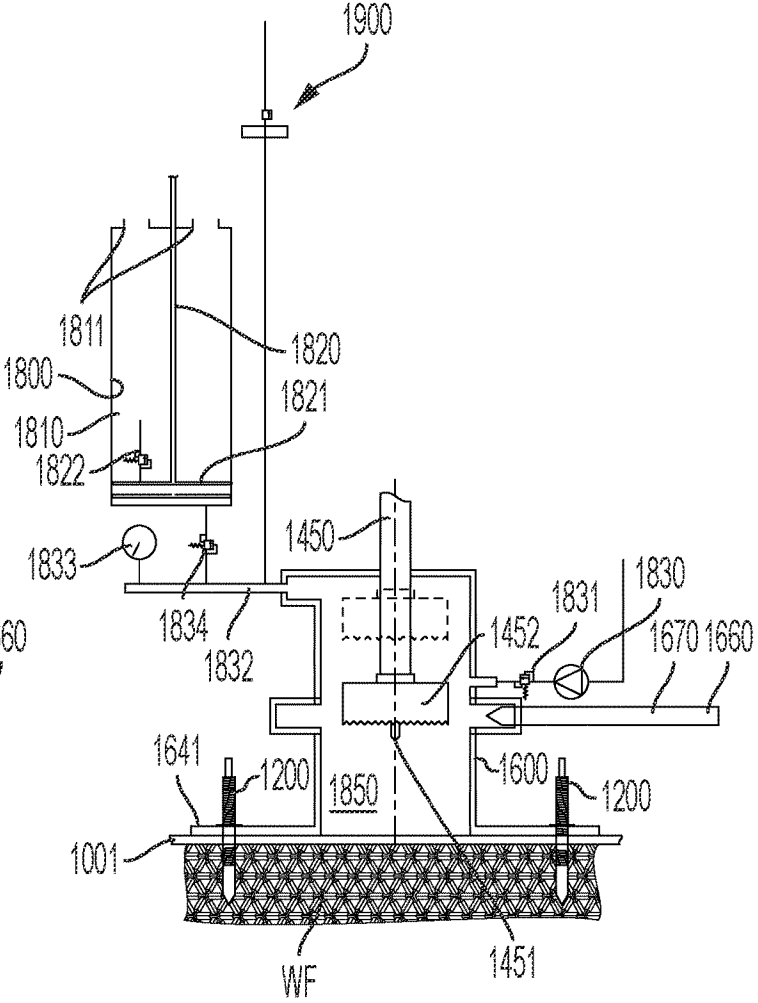
FIG. 32 is a schematic representation of the drill shaft, the male coupling portion, the connection flange assembly, and the waste cartridge of FIG. 31, wherein the drill shaft is illustrated in a cavity-pressurizing position, according to at least one aspect of the present disclosure.
Figure 37:
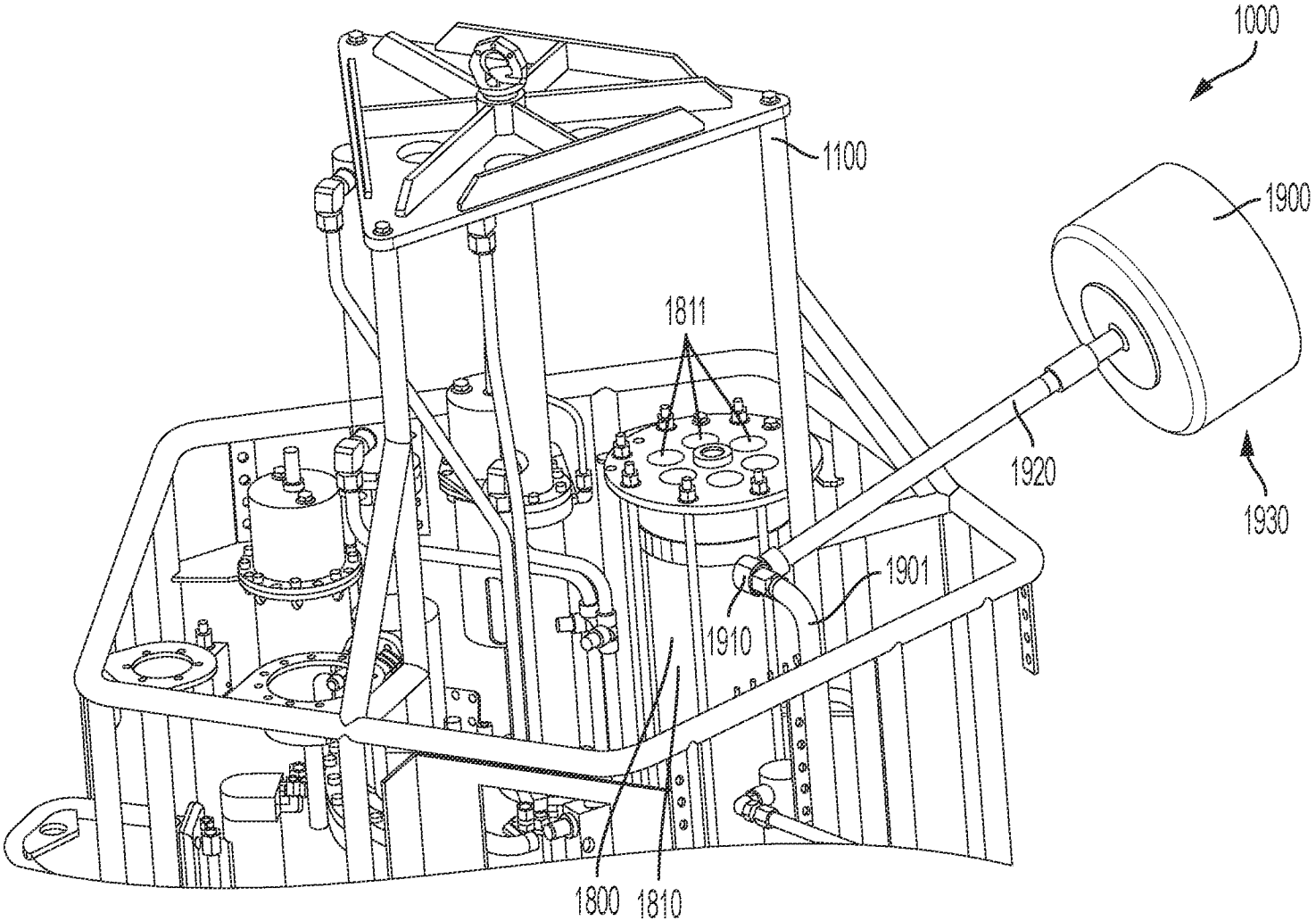
FIG. 37 is a partial perspective view of the underwater drilling system of FIG. 1, wherein the underwater drilling system comprises an automatic air-bleed valve assembly configured to automatically bleed air within the drill cavity, and wherein the automatic air-bleed valve assembly comprises a fluidic pivot coupling, a float, and an inner auto-bleed valve, according to at least one aspect of the present disclosure.
Figure 38:
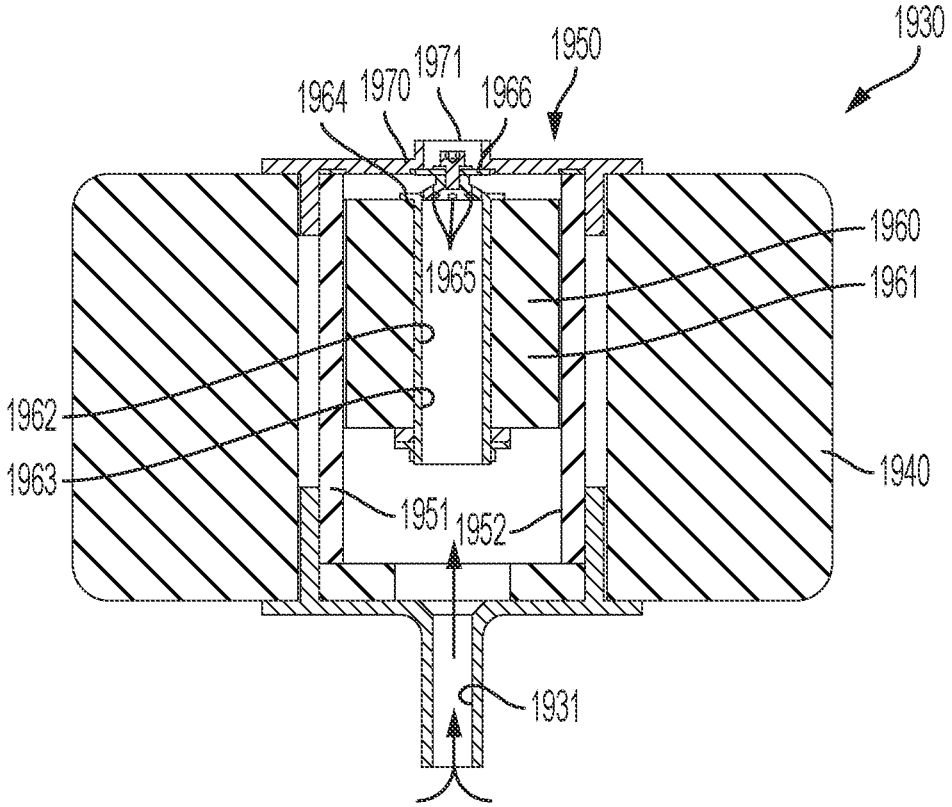
FIG. 38 is a cross-sectional view of the automatic air-bleed valve assembly of FIG. 37, according to at least one aspect of the present disclosure.

Referring primarily to FIGS. 37 and 38, the underwater drilling system 1000 utilizes the automatic air-bleed valve assembly 1900 to automatically vent, or bleed, air encountered during the drilling of the primary hole in the ship skin. The automatic air-bleed valve assembly 1900 is fluidically coupled to the upper drill cavity 1851 through the outlet 1832 (FIG. 31). In at least one instance, the automatic air-bleed valve assembly 1900 is fluidically coupled to the upper drill cavity 1851 through the female coupling portion 1610 (FIG. 30) and/or the male coupling portion 1140 (FIG. 30). At any rate, air which flows from the ship hull and into the upper drill cavity 1851 is configured to automatically bleed out of the outlet 1832 through an inlet bleed line 1901.

The automatic air-bleed valve assembly 1900 comprises an inlet shaft 1920 fluidically coupled to the inlet bleed line 1901 and a head portion 1930 fluidically coupled to the inlet shaft 1920 through which the air from the inlet bleed line 1901 is configured to bleed. The inlet shaft 1920 and head portion 1930 are pivotally connected to the frame 1100 and/or the inlet bleed line 1901 by way of a fluidic pivot coupling 1910 so as to permit the inlet shaft 1920 and the head portion 1930 to allow the head portion 1930 to align to a shallowest-possible location by way of external float member 1940 while remaining fluidically coupled. In at least one instance, the inlet bleed line 1901 comprises a rigid fluidic line and/or a flexible fluidic line. In at least one instance, the inlet shaft 1920 comprises a rigid fluidic shaft and/or a flexible fluidic shaft. In at least one instance, the fluidic pivot coupling 1910 comprises a hydraulic swivel elbow.

Referring primarily to FIG. 38, the head portion 1930 comprises the external float member 1940 configured to encourage the head portion 1930 toward an equalized pressure position such as, for example, the shallowest-possible location within the ocean while the underwater drilling system 1000 is attached to a ship skin. The head portion 1930 further comprises an internal valve chamber 1950 and a shuttle valve body 1960 translatable up and down within the internal valve chamber 1950. The internal valve chamber 1950 comprises a chamber wall 1951 defining a chamber cavity 1952. The shuttle valve body 1960 is free to move within the chamber cavity 1952 and relative to the chamber wall 1951. As can be seen in FIG. 38, the head portion 1930 comprises a fluidic inlet through which waste fluid and air can pass from the inlet shaft 1920 and into the chamber cavity 1952.

The shuttle valve body 1960 comprises an internal float member 1961 and an internal passageway 1962 comprising a passageway wall 1963. The passageway 1962 is configured to allow fluid and/or air to pass freely therethrough from the chamber cavity 1952. The shuttle valve body 1960 further comprises an upper vent head 1964 comprising vents 1965 defined therein configured to allow air in the passageway 1962 to pass therethrough and into an upper portion of the chamber cavity 1952. The head portion 1930 further comprises a bottom plate 1931 and a vented top plate 1970 comprising a vent 1971 configured to be sealed an unsealed by a flange plug head 1966 of the shuttle valve body 1960, as discussed in greater detail below.

Air and/or waste fluid is configured to flow into the chamber cavity 1952 during the automatic bleeding of air from the drill cavity. Because the waste fluid is denser than air, the waste fluid is configured to collect in the bottom of the chamber cavity 1952 while the air escapes through the waste fluid, into the chamber cavity 1952, up into the passageway 1962, and into the upper portion of the chamber cavity 1952 through the vents 1965. The waste fluid is configured to push the shuttle valve body 1960 upward within the chamber cavity 1953. When the buildup of pressure from the air egressing into the upper portion of the chamber cavity 1952 exceeds the pushing pressure applied to the shuttle valve body 1960 by way of the internal float member 1961, the air pressure pushes the shuttle valve body 1960 downwardly. This downward motion of the shuttle valve body 1960 moves the flange plug head 1966 from the top plate 1970 allowing the trapped air to vent out into ocean and/or ambient air through the vent 1971. In at least one instance, any air encountered within the ship hull during the drilling of the primary hole is configured to continuously bleed out of the system through the automatic air-bleed valve assembly 1900.

In at least one instance, waste fluid is prevented from flowing into the head portion 1930 by way of a check, or non-return, valve. In such an instance, the automatic air-bleed valve assembly 1900 works similarly to the manner discussed above; however, the air pressure build up in the upper portion of the chamber cavity 1952 need only exceed the air pressure build up below the shuttle valve body 1960 to move the shuttle valve body 1960 downwardly to release the trapped air. In at least one instance, when the chamber cavity 1952 is filled with air, the shuttle valve body 1960 is configured to slide to the bottom of the head portion 1930 and air releases through the vent 1971. At any rate, waste fluid is prevented from escaping the automatic air-bleed valve assembly.

Once removed from the installed flange connection assembly 1600, the rest of the underwater drilling system 1000 may be transported back to the surface, for example, by the ROV to have the float members 1005 reinstalled, to be reloaded with an additional flange connection assembly, to have the waste cartridge assembly 1800 cleaned out and/or flushed, and to be prepared for the next installation of a flange connection assembly. In at least one instance, the float members 1005 are re-installed back onto the frame 1100 prior to the occurrence of the aforementioned steps. In at least one instance, another flange connection assembly is aligned with the male coupling portion 1140 of the frame 1100 and the latching assembly 1160 latches the male coupling portion 1140 and the new flange connection assembly.

The fluidic actuators disclosed herein can comprise any suitable fluidic actuator such as for example, a rotary hydraulic actuator, a linear hydraulic actuator, a rotary pneumatic actuator, linear pneumatic actuator, a hydraulic drill, and/or a pneumatic drill, for example. In at least one instance, any of the fluid actuators disclosed herein can be substituted with electrical actuators such as for example, a rotary electric actuator, a linear electric actuator, and/or an electric drill.

The fluids used within the fluidic actuators may comprise any suitable actuator fluid such as hydraulic fluid and/or air, for example.

Figure 39:
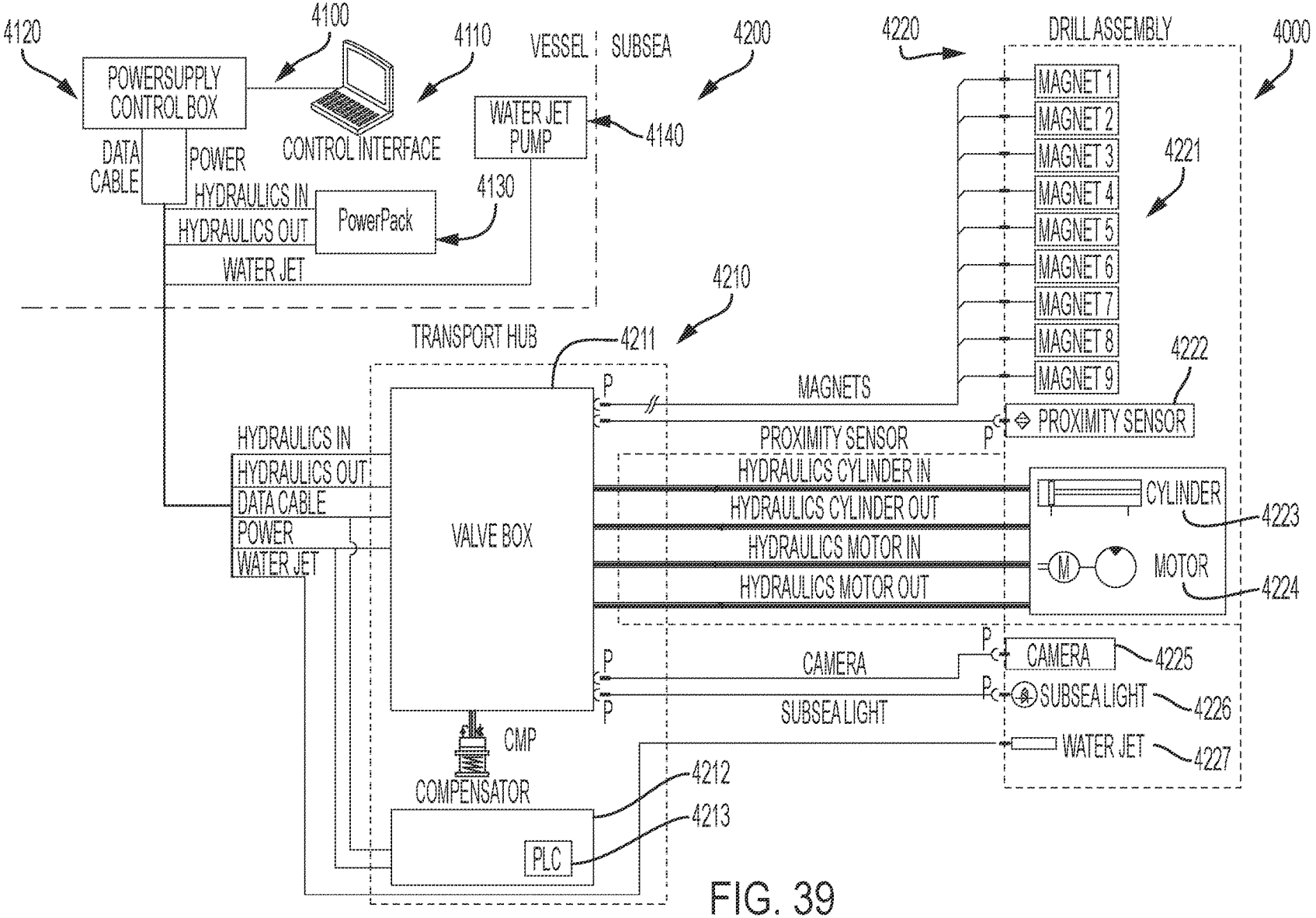
FIG. 39 is a schematic of a system including a drill assembly and various components to operate the drill assembly, according to at least one aspect of the present disclosure.

FIG. 39 is a schematic of a control system 4000 comprising above-sea components 4100 and sub-sea components 4200 of a drill assembly 4220. The above-sea components 4100 and the sub-sea components 4200 cooperate to permit a user to operate the drill assembly 4220 from aboard a vessel, for example. The above-sea components 4100 are positioned aboard the vessel, for example, and are configured to send power, send and receive hydraulic fluid, and send and receive data signals to and from the sub-sea components 4200. The sub-sea components 4200 comprises a transport hub 4210 configured to transport the drill assembly 4220 from the vessel to a drilling site and also control the transmission of fluid flow, electrical signals, and data signals between the above-sea components 4100 and the drill assembly 4220. Once the transport hub 4210 is positioned on the sea floor, for example, near the drilling site, the drill assembly 4220 is removed from the transport hub 4210 and positioned on a target drilling location on a sunken ship haul, for example.

The above-sea components 4100 comprise a control interface 4110, a power supply control box 4120, and a hydraulic power pack 4130 configured to deliver power, hydraulic fluid, and data signals to the sub-sea components 4200. The control interface 4110 may comprise a computer, for example. An operator uses the control interface 4110 to send commands in the form of data signals to the power supply control box 4120 which communicates the commands and power to the sub-sea components 4200. The hydraulic power pack 4130 is positioned in a hydraulic circuit of the system 4000 to control the flow of hydraulic fluid through the sub-sea components 4200. The above-sea components 4100 further comprise an optional system including a pump 4140 configured to deliver a fluid to the drilling location to spray away debris at the drilling location. All electrical and fluidic transmission between the above-sea components 4100 and the sub-sea components 4200 is achieved through transmission cables and hoses. The data signals may be communicated through an Ethernet cable, fiber optic cable, and/or coaxial cable, for example.

The transport hub 4210 is tethered to the above-sea components 4100 and the drill assembly 4220 to control the transmission of power, hydraulic fluid, data signals, and electric signals between the above-sea components 4100 and the drill assembly 4220. The transport hub 4210 comprises a valve box 4211 configured to house the non-fluid sensitive transmission components and an isolated electrical pod, or cavity, 4212 configured to house the fluid-sensitive transmission components. The valve box 4211 comprises internal fluidic valves and electronics such as proportional valves, pressure release valves, pressure sensors, a valve control module, and solid state relays. The isolated electrical pod 4212 comprises a dry environment in which to house a control circuit 4213 such as a programmable logic controller, for example. The programmable logic controller 4213 is connected to the electronics such as the relays, sensors, and valve control module, for example, inside the valve box 4211. The programmable logic controller 4213 is also connected to the above-sea components to send and receive data signals to and from the control interface 4110 so that the programmable logic controller 4213 can communicate with the control interface 4110 to receive instructions from and deliver information to the control interface 4110. Instructions may be received from the control interface 4110 telling the programmable logic controller 4213 to activate the relays and/or adjust the valves inside the valve box 4211 with a remote control module. Information may be delivered to the control interface 4110 corresponding to the information gathered by the sensors inside the valve box 4211.

The control circuit may comprise a microcontroller comprising one or more processors (e.g., microprocessor, microcontroller) coupled to at least one memory circuit. The memory circuit stores machine-executable instructions that, when executed by the processor, cause the processor to execute machine instructions to implement various processes described herein. The processor may be any one of a number of single-core or multicore processors known in the art. The memory circuit may comprise volatile and nonvolatile storage media. The processor may include an instruction processing unit and an arithmetic unit. The instruction processing unit may be configured to receive instructions from the memory circuit.

The drill assembly 4220 comprises several components some of which require power, electrical signal transmission, fluidic transmission, and/or data transmission. The drill assembly 4220 comprises a mounting system comprising a plurality of magnets 4221 which may be, for example, electromagnets to affix the drill assembly 4220 to a magnetic material such as a ship skin, for example, as further described herein. The electromagnets 4221 receive power from the power supply control box 4120 through the valve box 4211. To activate the electromagnets 4221, power can be delivered when instructions from the control interface 4110 are sent to the programmable logic controller 4213 to switch the relays in the valve box 4211 on. Similarly, to de-activate the electromagnets 4221 and detach the drill assembly 4220 from the ship skin, power can be cut off when instructions from the control interface 4110 are sent to the programmable logic controller 4213 to switch the relays in the valve box 4211 off.

The drill assembly 4220 further comprises a drilling system, as discussed in greater detail herein, comprising a linear actuator system 4223 and a bit drive system 4224 configured to be moved up and down by the linear actuator system 4223 and configured to drill a self-tapping bit assembly into the ship skin. The linear actuator system 4223 may comprise a hydraulic cylinder, for example, requiring hydraulic fluid to flow to and from the hydraulic cylinder to move the hydraulic cylinder and, thus, the bit drive system 4224 up and down. Hydraulic fluid is configured to flow between the hydraulic power pack 4130, the valve box 4211 in the transport hub 4210, and the hydraulic cylinder. To control the position of the bit drive system 4224, the valve control module in the valve box 4211 can adjust the valve configurations inside the valve box 4211 based on instructions received from the programmable logic controller 4213 to adjust the flow of fluid to the hydraulic cylinder to actuate the hydraulic cylinder. The position of the bit drive system 4224 can be monitored by monitoring the pressure in the hydraulic cylinder fluid circuit with a pressure sensor in the valve box 4211. This monitored pressure can be communicated to the control interface 4110 so that an operator is provided the position of the bit drive system 4224 during operation of the drill assembly 4220.

The bit drive system 4224 is configured to drill a self-tapping bit assembly into the ship skin. The bit drive system 4224 may comprise a hydraulic drill, for example, requiring hydraulic fluid to flow to and from the hydraulic drill to actuate the hydraulic drill and, thus, rotate the self-tapping bit assembly clockwise and counterclockwise. Hydraulic fluid is configured to flow between the hydraulic power pack 4130, the valve box 4211 in the transport hub 4210, and the hydraulic drill. To control the rotation of the hydraulic drill, the valve control module in the valve box 4211 can adjust the valve configurations inside the valve box 4211 based on instructions received from the programmable logic controller 4213 to adjust the flow of fluid to the hydraulic drill to actuate the hydraulic drill. The pressure required to drive the bit assembly into the ship skin can be monitored by monitoring the pressure in the hydraulic drill fluid circuit with a pressure sensor in the valve box 4211 to determine the amount of resistance the hydraulic drill is experiencing during the drilling process. This monitored pressure can be communicated to the control interface 4110 so that an operator can adjust the bit drive system 4224 and/or the linear actuator system 4223 accordingly. For example, the operator may reduce the speed of the hydraulic drill and/or raise the bit drive system 4224 to reduce the resistance experienced by the hydraulic drill.

The drill assembly 4220 comprises various other components. For example, the drill assembly 4220 comprises an underwater camera 4225 to allow an operate to see the drilling location, a subsea light 4226 to illuminate the drilling location for camera visibility, and one or more proximity sensors 4222 configured to determine the relative position between the drill assembly 4220 and the ship skin and/or the relative position between the bit assembly and the ship skin during the drilling process. The underwater camera 4225, subsea light 4226, and one or more proximity sensors 4222 require power from the transport hub 4210. The underwater camera 4225 requires data signal transmission between the underwater camera 4225 and the control interface 4110 so that an operator can see the drilling location via the control interface 4110. The one or more proximity sensors 4222 require electrical signal and/or data signal transmission so that the programmable logic controller 4213 can communicate the relative position between components to the control interface 4110.

Various components of the system 4000 may comprise analog components and/or digital components. Where analog sensors are used, for example, the need to transmit digital data from and to the analog sensors is not required and thus, may simplify the system 4000. Where digital sensors are used, digital data is required to be transmitted to and from the digital sensors. In various instances, both analog components and digital components are used, however, any suitable arrangement of analog components and digital components can be employed. Some analog components may provide greater simplicity to a system. Some digital components may provide a greater degree of accuracy than their analog counterparts, for example. Moreover, where digital components are used, the required analog to digital conversions of the signals can take place in converters placed aboard the vessel to further simplify a system containing digital components.

The drill assembly 4220 may further comprise a water jet nozzle 4227 configured to receive fluid, such as water, for example, from the pump 4140 to spray away debris at the drilling location. This system bypasses the transport hub 4210 and the control interface 4110 to increase the simplicity of the system 4000; however, the water jet nozzle 4227 and pump 4140 may be integrated with the other components to increase controllability of the water jet nozzle 4227 and pump 4140, for example.

Any transmission lines in the system 4000, such as the electrical cables and fluidic hoses, for example, may be attachable to and detachable from the components to which they are connected such that components can be quickly and/or easily swapped out if a component needs to be replaced and/or repaired. The system 4000 may also comprise various non-detachable transmission lines to decrease the possibility of leaking that may be caused by some detachable/attachable interfaces. The system 4000 may comprise both detachable/attachable transmission lines as well as non-detachable transmission lines.

EXAMPLES

Example Set 1

Example 1—An underwater drilling assembly comprising a drill assembly, a connection flange assembly configured to be attached to a ship skin by the drill assembly, wherein the connection flange assembly comprises a plurality of guide tabs, and a frame supporting the drill assembly. The frame comprises a lower platform comprising attachment legs extending therefrom, wherein the attachment legs are configured to attach the underwater drill assembly to a ship skin. Each attachment leg comprises a fluidic actuator comprising an output shaft, an expandable leg assembly attached to the output shaft, a suction cup base attached to the expandable leg assembly by way of a ball and socket joint; and a guide flange comprising a slot configured to receive one of the guide tabs of the connection flange assembly.

Example 2—The underwater drilling assembly of Example 1, wherein the expandable leg assembly comprises an upper leg portion attached to and translatable by the output shaft and a lower leg portion spring loaded against the upper leg portion to permit a retraction movement of the upper leg portion relative to the lower leg portion upon retraction of the output shaft.

Example 3—The underwater drilling assembly of Examples 1 or 2, wherein the expandable leg assembly further comprises an outer housing comprising a slot defined therein, and wherein the lower leg portion comprises a plunger attached to the lower leg by way of a pin, and wherein the pin extends radially outward from the plunger and is received within the slot.

Example 4—The underwater drilling assembly of Examples 1, 2, or 3, wherein the outer housing is fixedly attached to the lower platform.

Example 5—The underwater drilling assembly of Examples 1, 2, 3, or 4, wherein the connection flange assembly comprises a guide fin, wherein the outer housing comprises a guide bracket extending from a lower end of the outer housing, wherein the guide bracket comprises a slot, and wherein the guide fin is positionable within the slot to guide the frame relative to the connection flange assembly.

Example 6—The underwater drilling assembly of Examples 1, 2, 3, 4, or 5, wherein the lower leg portion comprises a plunger, wherein the plunger comprises a head slidably supported within the upper leg portion, and wherein a coil spring is positioned between the head and a bottom of the upper leg portion.

Example 7—The underwater drilling assembly of Examples 1, 2, 3, 4, 5, or 6, wherein the fluidic actuator comprises a hydraulic actuator.

Example 8—The underwater drilling assembly of Examples 1, 2, 3, 4, 5, 6, or 7, wherein the lower leg portion comprises a ball portion extending therefrom, wherein the suction cup base comprises a socket, and wherein the ball portion is positioned within the socket.

Example 9—An underwater drilling assembly frame comprising a frame and a plurality of legs configured to secure the frame to a ship skin, wherein each leg comprises a suction cup base, a piston, an outer column fixedly attached to the frame, and an inner column positioned within the outer column, wherein the inner column comprises an upper tube fixedly attached to the piston and a lower leg vertically constrained relative to the suction cup base, wherein the piston is actuatable to expand the upper tube relative to the lower leg to pull the upper tube away from the ship skin.

Example 10—The underwater drilling assembly frame of Example 9, wherein the lower leg is spring loaded against the upper tube.

Example 11—The underwater drilling assembly frame of Examples 9 or 10, wherein the outer column comprises a slot defined therein, and wherein the lower leg comprises a plunger attached to the lower leg by way of a pin, and wherein the pin extends radially outward from the plunger and is received within the slot.

Example 12—The underwater drilling assembly frame of Examples 9, 10, or 11, further comprising a flange mountable to the ship skin, wherein the flange comprises a guide fin, wherein the outer column comprises a guide bracket extending from a lower end of the outer column, wherein the guide bracket comprises a slot, and wherein the guide fin is positionable within the slot to guide the frame relative to the flange.

Example 13—The underwater drilling assembly frame of Examples 9, 10, 11, or 12, wherein the lower leg comprises a plunger, wherein the plunger comprises a head slidably supported within the upper tube, and wherein a coil spring is positioned between the head and a bottom of the upper tube.

Example 14—The underwater drilling assembly frame of Examples 9, 10, 11, 12, or 13, wherein the piston is actuatable by a hydraulic actuator.

Example 15—The underwater drilling assembly frame of Examples 9, 10, 11, 12, 13, or 14, wherein the lower leg comprises a ball extending therefrom, wherein the suction cup base comprises a socket, and wherein the ball is positioned within the socket.

Example 16—A method for attaching an underwater drilling assembly to a ship skin, wherein the underwater drilling assembly comprises a frame, a drill assembly attached to the frame, and a connection flange assembly comprising a gasket, wherein the frame comprises a plurality of legs, wherein each leg comprises a suction cup base and an expandable leg assembly, the method comprising lowering the underwater drill assembly onto a ship skin and pressing the gasket against the ship skin to provide a seal against the ship skin with the connection flange assembly, positioning each suction cup base of the plurality of legs against the ship skin, initiating a suction force to secure each suction cup base to the ship skin, actuating a fluidic actuator of each leg to pull an upper leg portion of the expandable leg assembly of each leg to increase a holding force of the plurality of legs, attaching the connection flange assembly to the ship skin, and drilling a hole in the ship skin.

Example 17—The method of Example 16, wherein actuating the fluidic actuator of each leg to pull the upper leg portion of the expandable leg assembly of each leg comprises pulling the upper leg portion upwardly relative to the ship skin and a lower leg portion of the expandable leg assembly.

Example 18—The method of Examples 16 or 17, wherein actuating the fluidic actuator of each leg to pull the upper leg portion of the expandable leg assembly of each leg comprises applying a pulling force to the suction cup base which is less than a suction force applied by the suction cup base.

Example 19—The method of Examples 16, 17, or 18, the method further comprising actuating a spring mechanism within the legs to permit independent vertical movement of each leg relative to the ship skin.

Example Set 2

Example 1—An underwater drilling assembly comprising a frame, a drilling assembly supported by the frame, and a self-tapping connection stud actuatable by the drilling assembly, wherein the self-tapping connection stud comprises a cutting body, self-tapping threads configured to affix the self-tapping connection stud to a ship skin, a shank portion, and a drivable head. The underwater drilling assembly further comprises a connection flange assembly attachable to the ship skin by the self-tapping connection stud, wherein the connection flange assembly comprises a gasket, a central bore, and an outer rim comprising a containment structure, wherein the gasket is positioned between the outer rim and the ship skin. The containment structure comprises a sealing grommet and a containment cavity through which the self-tapping connection stud is configured to pass as the self-tapping connection stud is actuated by the drilling assembly to affix the outer rim to the ship skin, wherein the sealing grommet seals the containment cavity as the self-tapping connection stud passes through the sealing grommet.

Example 2—The underwater drilling assembly of Example 1, wherein the self-tapping connection stud comprises a discontinuity portion configured to isolate mechanical failure of the self-tapping connection stud to the discontinuity portion.

Example 3—The underwater drilling assembly of Examples 1 or 2, wherein the discontinuity portion is positioned to ensure that the discontinuity portion is within the containment cavity should the self-tapping connection stud fail.

Example 4—The underwater drilling assembly of Examples 1, 2, or 3, wherein the containment cavity is configured to contain debris leakage during the actuation of the self-tapping connection stud into the ship skin.

Example 5—The underwater drilling assembly of Examples 1, 2, 3, or 4, further comprising a plurality of the self-tapping connection studs, and wherein the outer rim comprises a plurality of the containment structures.

Example 6—The underwater drilling assembly of Examples 1, 2, 3, 4, or 5, wherein the drilling assembly is rotatable relative to the frame to drive each self-tapping connection stud into the ship skin.

Example 7—The underwater drilling assembly of Examples 1, 2, 3, 4, 5, or 6, wherein the frame comprises a plurality of grommet structures attached to the frame, and wherein each of the self-tapping connections studs are held in a starting position by one of the grommet structures of the plurality of grommet structures.

Example 8—The underwater drilling assembly of Examples 1, 2, 3, 4, 5, 6, or 7, wherein the containment structure comprises a self-sealing grommet to seal an internal chamber of the containment structure from ambient water upon the actuation of the self-tapping connection stud through the self-sealing grommet and into the containment structure.

Example 9—The underwater drilling assembly of Examples 1, 2, 3, 4, 5, 6, 7, or 8, wherein the outer rim comprises a first predefined aperture, wherein the gasket comprises a second predefined aperture aligned with the first predefined aperture, and wherein the self-tapping connection stud is actuatable through the first predefined aperture and the second predefined aperture to engage the ship skin.

Example 10—A fastening system for an underwater drilling assembly, wherein the fastening system comprises a fastener and a port assembly comprising a gasket positionable against a ship skin and a body. The body comprises an outer rim, a sealing grommet, and a containment enclosure, wherein a containment void is defined by the containment enclosure and the sealing grommet, wherein the fastener is movable through the sealing grommet, the containment void, and the gasket, and wherein, while at least a portion of the fastener is positioned within the containment void, the containment void is sealed.

Example 11—The fastening system of Example 10, wherein the fastener comprises a discontinuity configured to isolate mechanical failure of the fastener to the discontinuity.

Example 12—The fastening system of Examples 10 or 11, wherein the containment void is configured to contain debris leakage during the actuation of the fastener into the ship skin.

Example 13—The fastening system of Examples 10, 11, or 12, further comprising a plurality of fasteners, and wherein the outer rim comprises a plurality of the containment enclosures aligned with the plurality of the fasteners.

Example 14—The fastening system of Examples 10, 11, 12, or 13, wherein the outer rim comprises a first predefined aperture, wherein the gasket comprises a second predefined aperture aligned with the first predefined aperture, and wherein the fastener is actuatable through the first predefined aperture and the second predefined aperture to engage the ship skin.

Example 15—A method for extracting fluid from a vessel using an underwater drilling assembly, the method comprising positioning the underwater drilling assembly on a hull of the vessel, actuating leg assemblies of the underwater drill assembly to attach the underwater drilling assembly to the hull, driving, with a fluidic drill of the underwater drilling assembly, at least one self-tapping stud into the hull through a connection flange assembly of the underwater drilling assembly comprising a containment housing to secure the connection flange assembly to the hull, drilling, with the fluidic drill, a hole in the vessel within an inner void defined in the connection flange assembly, sealing, with the connection flange assembly, the contents inside of the hole drilled by the fluidic drill from ambient water, disconnecting a portion of the underwater drilling assembly from the connection flange assembly, and extracting fluid through connection flange assembly and the hole drilled by the fluidic drill.

Example 16—The method of Example 15, wherein driving, with a fluidic drill of the underwater drilling assembly, at least one self-tapping stud further comprises driving the at least one self-tapping stud into the containment housing to seal internal contents of the containment housing from ambient water and driving the at least one self-tapping stud through the ship skin until the at least one self-tapping stud is fully secured to the ship skin, wherein the containment housing contains the internal contents of the containment housing throughout the driving of the at least one self-tapping stud.

Example 17—The method of Examples 15 or 16, wherein the at least one self-tapping stud comprises a starting position where no portion of the self-tapping stud is positioned within the corresponding containment cavity and an ending position where a discontinuity of the self-tapping stud is positioned within the corresponding containment cavity.

Example 18—The method of Examples 15, 16, or 17, further comprising driving, with the fluidic drill of the underwater drilling assembly, another self-tapping stud into the ship skin through another containment housing.

Example Set 3

Example 1—An underwater drilling assembly comprising a drilling assembly, a connection flange assembly configured to be attached to a ship skin by the drilling assembly, wherein the connection flange assembly comprises an upper flange and a female coupling portion, and a frame supporting the drill assembly. The frame comprises a lower platform, attachment legs extending from the lower platform and configured to attach the underwater drilling assembly to a ship skin, a male coupling portion attached to the lower platform, wherein the male coupling portion is configured to be received by the female coupling portion, wherein the male coupling portion comprises a lower flange, and a latching assembly attached to the frame, wherein the latching assembly is configured to latch and de-latch the upper flange and the lower flange to couple and decouple the male coupling portion and the female coupling portion.

Example 2—The underwater drilling assembly of Example 1, wherein the latching assembly comprises a locking ring configured to be rotated to couple and decouple the upper flange and the lower flange.

Example 3—The underwater drilling assembly of Examples 1 or 2, wherein the locking ring comprises a plurality of radial locking tabs, wherein the lower flange comprises a plurality of slots configured to receive the radial locking tabs, and wherein the locking ring is rotatable relative to the upper flange to axially lock the male coupling portion and the connection flange assembly.

Example 4—The underwater drilling assembly of Examples 1, 2, or 3, wherein the latching assembly further comprises a hydraulic actuator configured to rotate the locking ring relative to the frame, the male coupling portion, and the connection flange assembly.

Example 5—The underwater drilling assembly of Examples 1, 2, 3, or 4, wherein the male coupling portion comprises a seal ring configured to fluidically seal the male coupling portion and the female coupling portion.

Example 6—The underwater drilling assembly of Examples 1, 2, 3, 4, or 5, wherein the connection flange assembly further comprises guiding posts extending therefrom configured to engage the attachment legs to prevent relative rotation between the connection flange assembly and the lower platform.

Example 7—The underwater drilling assembly of Examples 1, 2, 3, 4, 5, or 6, wherein the male coupling portion comprises a machined outer surface and the female coupling portion comprises a machined inner surface configured to interface with the machined outer surface.

Example 8—The underwater drilling assembly of Examples 1, 2, 3, 4, 5, 6, or 7, wherein the male coupling portion comprises a chamfered pipe edge receivable within the female coupling portion Example 9—An assembly comprising a frame defining a first bore, a connection flange defining a second bore, wherein an axis extends through said first bore and said second bore, and wherein a drill is movable along the axis, and a latch mounted to the frame, wherein the latch is rotatable about the axis between a latched position where the connection flange is secured to the frame and an unlatched position where the connection flange is disengaged from the frame such that the frame can be pulled away from the connection flange upon fastening the connection flange to a ship skin.

Example 10—The assembly of Example 9, wherein the latch comprises a locking ring configured to be rotated to couple and decouple the connection flange and the frame.

Example 11—The assembly of Examples 9 or 10, wherein the locking ring comprises a plurality of radially-extending locking tabs, wherein the connection flange comprises a plurality of slots configured to receive the radial locking tabs, and wherein the locking ring is rotatable relative to the frame and the connection flange to axially lock the frame and the connection flange together.

Example 12—The assembly of Examples 9, 10, or 11, further comprising a hydraulic actuator configured to rotate the locking ring relative to the frame and the connection flange.

Example 13—The assembly of Examples 9, 10, 11, or 12, wherein the frame comprises a male coupler comprising a seal configured to fluidically seal the frame and the connection flange.

Example 14—The assembly of Examples 9, 10, 11, 12, or 13, wherein the frame comprises a plurality of legs, wherein the connection flange further comprises guiding posts extending therefrom configured to engage the plurality of legs to prevent relative rotation between the connection flange and the frame.

Example 15—The assembly of Examples 9, 10, 11, 12, 13, or 14, wherein the frame comprises a male coupler comprising a machined outer surface, wherein the connection flange comprises a female coupler comprising a machined inner surface configured to interface with the machined outer surface.

Example 16—The assembly of Examples 9, 10, 11, 12, 13, 14, or 15, wherein the male coupler comprises a chamfered pipe edge receivable within the female coupler.

Example 17—A method for extracting fluid from a sunken vessel using an underwater drilling assembly comprising a frame, a drilling assembly attached to the frame, and a connection flange assembly, the method comprising attaching the connection flange assembly to the frame with a hydraulic actuator, lowering the underwater drilling assembly onto an exterior of the sunken vessel, actuating leg assemblies of the underwater drilling assembly to hold the frame of the underwater drilling assembly to the exterior, driving, with a fluidic drill of the underwater drilling assembly, at least one self-tapping stud through the connection flange assembly and into the exterior to secure the connection flange assembly to the exterior, drilling, with the fluidic drill, a hole in the sunken vessel within an inner void defined in the connection flange assembly, sealing, with the connection flange assembly, a cavity defined inside the connection flange assembly from ambient water, disconnecting the connection flange assembly from the frame with the hydraulic actuator, and extracting fluid through connection flange assembly and the hole drilled by the fluidic drill.

Example 18—The method of Example 17, wherein disconnecting the flange connection assembly from the frame with the hydraulic actuator comprises rotating a locking ring from a locked position to an unlocked position such that the frame can be separated from the flange connection assembly upon moving the locking ring into the unlocked position.

Example 19—The method of Examples 17 or 18, wherein the locking ring comprises a plurality of radial locking tabs extending inwardly therefrom, and wherein disconnecting the flange connection assembly from the frame with the hydraulic actuator comprises rotating the radial locking tabs into alignment with corresponding tab slots defined in the flange connection assembly.

Example 20—The method of Examples 17, 18, or 19, further comprising lifting, after rotating the radial locking tabs into alignment with the corresponding tab slots, the frame vertically away from the flange connection assembly such that the radial locking tabs pass through the corresponding tab slots.

Example Set 4

Example 1—A method for flushing a drill cavity within an underwater drilling system, wherein the underwater drilling system comprises a connection flange assembly configured to be attached to a ship skin, wherein the connection flange assembly comprises an upper coupling portion, a lower coupling portion, and a knife gate, and wherein the method comprises placing an underwater drilling system against a ship skin, securing the underwater drilling system to the ship skin, drilling self-tapping studs into the ship skin to affix the connection flange assembly to the ship skin, pressurizing the drill cavity to test a first seal between the connection flange assembly and the ship skin, advancing a primary drill shaft toward the ship skin to drill a primary hole in the ship skin, retracting the primary drill shaft through the ship skin, closing a knife gate of the connection flange assembly to provide a second seal between the upper coupling portion and the lower coupling portion, and purging fluid in the drill cavity into a waste cartridge.

Example 2—The method of Example 1, further comprising decoupling the upper coupling portion from lower coupling portion.

Example 3—The method of Examples 1 or 2, further comprising actuating the primary drill shaft to agitate fluid within the upper coupling portion during the purging of the fluid in the drill cavity.

Example 4—The method of Examples 1, 2, or 3, wherein pressurizing the drill cavity comprises advancing the primary drill shaft into the drill cavity.

Example 5—An underwater drilling system, comprising a frame comprising an upper coupler, a connection flange to be attached to a ship skin, wherein the connection flange comprises a lower coupler comprising a knife gate actuatable to provide a seal between the lower coupler and the upper coupler, wherein the upper coupler is separable from the lower coupler, and a drill cavity comprising an upper drill cavity defined in the upper coupler and a lower drill cavity defined in the lower coupler. The underwater drilling system further comprises a waste cartridge fluidically coupled to the drill cavity through the upper coupler and a pump configured to purge fluid within the upper drill cavity into the waste cartridge.

Example 6—The underwater drilling system of Example 5, wherein the pump is configured to pump water into the upper drill cavity to purge the fluid within the upper drill cavity.

Example 7—The underwater drilling system of Examples 5 or 6, wherein the waste cartridge comprises a check valve configured to prevent waste fluid contained within the waste cartridge from flowing into the upper drill cavity.

Example 8—The underwater drilling system of Examples 5, 6, or 7, further comprising an air purge valve positioned between the upper drill cavity and the waste cartridge.

Example 9—The underwater drilling system of Examples 5, 6, 7, or 8, wherein the waste cartridge comprises a transparent shell.

Example 10—The underwater drilling system of Examples 5, 6, 7, 8, or 9, wherein the upper drill cavity comprises a first capacity, and wherein the waste cartridge comprises a second capacity which is greater than the first capacity.

Example 11—The underwater drilling system of Examples 5, 6, 7, 8, 9, or 10, wherein the second capacity is at least three times greater than the first capacity.

Example 12—An underwater drilling system comprising a frame comprising a base, a connection flange pre-attached to the base, wherein the connection flange comprises a female coupler and a cavity defined in the connection flange, wherein the cavity comprises an upper cavity, a lower cavity, and a gate actuatable to provide a seal between the upper cavity and the lower cavity, wherein the frame is separable from the female coupler, a container fluidically coupled to the upper cavity, and a pump to expel fluid within the upper cavity into the container.

Example 13—The underwater drilling system of Example 12, wherein the pump is to pump water into the upper cavity to purge fluid within the upper cavity.

Example 14—The underwater drilling system of Examples 12 or 13, wherein the container comprises a check valve to prevent waste fluid contained within the container from flowing into the upper cavity.

Example 15—The underwater drilling system of Examples 12, 13, or 14, further comprising an air purge valve positioned between the upper cavity and the container.

Example 16—The underwater drilling system of Examples 12, 13, 14, or 15, wherein the container comprises a transparent shell.

Example 17—The underwater drilling system of Examples 12, 13, 14, 15, or 16, wherein the upper cavity comprises a first capacity, and wherein the container comprises a second capacity which is greater than the first capacity.

Example 18—The underwater drilling system of Examples 12, 13, 14, 15, 16, or 17, wherein the second capacity is at least three times greater than the first capacity.

Example Set 5

Example 1—An underwater drilling system comprising a drilling assembly, a frame supporting the drilling assembly, a connection flange assembly configured to be attached to a ship skin by the drilling assembly, wherein the connection flange assembly comprises a drill cavity defined therein, and an automatic air-bleed valve assembly fluidically coupled to the drill cavity, wherein the automatic air-bleed valve assembly is attached to the frame by way of a fluidic pivot coupling, and wherein the automatic air-bleed valve assembly comprises an auto-bleed valve and an external float member.

Example 2—The underwater drilling system of Example 1, wherein the fluidic pivot joint comprises a hydraulic swivel elbow.

Example 3—The underwater drilling system of Examples 1 or 2, wherein the automatic air-bleed valve assembly further comprises a body portion defining an inner fluid chamber and an air-release aperture and an inner shuttle valve body comprising an internal float, wherein the internal float is configured to permit movement of the inner shuttle valve body relative to the body portion to seal the air-release aperture and to unseal the air-release aperture.

Example 4—The underwater drilling system of Examples 1, 2, or 3, wherein the inner shuttle valve body comprises an internal tube comprising an open bottom in fluid communication with the inner fluid chamber and an upper vent head.

Example 5—The underwater drilling system of Examples 1, 2, 3, or 4, wherein the upper vent head comprises a plug configured to seal and unseal the air-release aperture.

Example 6—The underwater drilling system of Examples 1, 2, 3, 4, or 5, wherein the air-release aperture is defined in a top plate of the body portion.

Example 7—The underwater drilling system of Examples 1, 2, 3, 4, 5, or 6, further comprising a waste cartridge fluidically coupled to the drill cavity, and wherein the automatic air-bleed valve assembly is upstream of the waste cartridge such that air is configured to be released by way of the automatic air-bleed valve assembly before reaching the waste cartridge.

Example 8—An air-bleed assembly for use with an underwater drilling system, the air-bleed assembly comprising an input tube fluidically couplable to a drill cavity and a head assembly comprising a frame comprising an upper vent, a first float, an internal cavity fluidically coupled to the input tube and the upper vent, and a shuttle movable within the internal cavity such that air pressure is configured to push the shuttle away from the upper vent to automatically unseal and escape through the upper vent.

Example 9—The air-bleed assembly of Example 8, wherein the input tube further comprises a tube comprising a fluidic pivot coupling configured to permit the first float to bias the head assembly toward an equalized pressure position.

Example 10—The air-bleed assembly of Examples 8 or 9, wherein the frame comprises a chamber wall defining the internal cavity extending between a lower plate of the frame and an upper plate of the frame.

Example 11—The air-bleed assembly of Examples 8, 9, or 10, wherein the shuttle comprises a second float engaged with the chamber wall, and wherein the second float provides an outer seal between an upper portion of the internal cavity and a lower portion of the internal cavity.

Example 12—The air-bleed assembly of Examples 8, 9, 10, or 11, wherein the upper vent comprises a first upper vent, wherein the shuttle comprises an inner tube comprising a second upper vent in fluid communication with the upper portion of the internal cavity and an open bottom in fluid communication with the lower portion of the internal cavity.

Example 13—The air-bleed assembly of Examples 8, 9, 10, 11, or 12, wherein the upper plate comprises a first upper plate, and wherein the shuttle further comprises a second upper plate configured to seal the first upper vent when the shuttle is in an upper-most position and unseal the first upper vent when the shuttle is not in the upper-most position.

Example 14—The air-bleed assembly of Examples 8, 9, 10, 11, 12, or 13, wherein a gap is defined between the second float and the first upper plate when the shuttle is in the upper-most position.

Example 15—A method for automatically bleeding air from a drill cavity of an underwater drilling assembly, wherein the underwater drilling assembly comprises a frame, a drill assembly mounted to the frame, and a flange assembly through which a hole is drilled by the drill assembly into a ship skin, wherein the drill cavity is defined in the flange assembly, the method comprising attaching the underwater drilling assembly to the ship skin, drilling the hole in the ship skin through the flange assembly, bleeding air within the drill cavity through an automatic air-bleed valve assembly comprising an external float, an internal chamber, a shuttle movable within the internal chamber to seal and unseal a top plate of the automatic air-bleed valve assembly upon generating an air pressure greater than a fluid pressure applied to the shuttle within the internal chamber, and sealing the flange assembly.

Example 16—The method of Example 15, wherein bleeding air within the drill cavity further comprises passing air through an inner tube of the shuttle.

While several forms have been illustrated and described, it is not the intention of the applicant to restrict or limit the scope of the appended claims to such detail. Numerous modifications, variations, changes, substitutions, combinations, and equivalents to those forms may be implemented and will occur to those skilled in the art without departing from the scope of the present disclosure. Moreover, the structure of each element associated with the described forms can be alternatively described as a means for providing the function performed by the element. Also, where materials are disclosed for certain components, other materials may be used. It is therefore to be understood that the foregoing description and the appended claims are intended to cover all such modifications, combinations, and variations as falling within the scope of the disclosed forms. The appended claims are intended to cover all such modifications, variations, changes, substitutions, modifications, and equivalents.

The foregoing detailed description has set forth various forms of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, and/or examples can be implemented, individually and/or collectively, by a wide range of hardware, software, firmware, or virtually any combination thereof. Those skilled in the art will recognize that some aspects of the forms disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as one or more program products in a variety of forms, and that an illustrative form of the subject matter described herein applies regardless of the particular type of signal bearing medium used to actually carry out the distribution.

Instructions used to program logic to perform various disclosed aspects can be stored within a memory in the system, such as dynamic random access memory (DRAM), cache, flash memory, or other storage. Furthermore, the instructions can be distributed via a network or by way of other computer readable media. Thus a machine-readable medium may include any mechanism for storing or transmitting information in a form readable by a machine (e.g., a computer), but is not limited to, floppy diskettes, optical disks, compact disc, read-only memory (CD-ROMs), and magneto-optical disks, read-only memory (ROMs), random access memory (RAM), erasable programmable read-only memory (EPROM), electrically erasable programmable read-only memory (EEPROM), magnetic or optical cards, flash memory, or a tangible, machine-readable storage used in the transmission of information over the Internet via electrical, optical, acoustical or other forms of propagated signals (e.g., carrier waves, infrared signals, digital signals, etc.). Accordingly, the non-transitory computer-readable medium includes any type of tangible machine-readable medium suitable for storing or transmitting electronic instructions or information in a form readable by a machine (e.g., a computer).

As used in any aspect herein, the term "control circuit" may refer to, for example, hardwired circuitry, programmable circuitry (e.g., a computer processor including one or more individual instruction processing cores, processing unit, processor, microcontroller, microcontroller unit, controller, digital signal processor (DSP), programmable logic device (PLD), programmable logic array (PLA), or field programmable gate array (FPGA)), state machine circuitry, firmware that stores instructions executed by programmable circuitry, and any combination thereof. The control circuit may, collectively or individually, be embodied as circuitry that forms part of a larger system, for example, an integrated circuit (IC), an application-specific integrated circuit (ASIC), a system on-chip (SoC), desktop computers, laptop computers, tablet computers, servers, smart phones, etc. Accordingly, as used herein "control circuit" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment). Those having skill in the art will recognize that the subject matter described herein may be implemented in an analog or digital fashion or some combination thereof.

As used in any aspect herein, the term "logic" may refer to an app, software, firmware and/or circuitry configured to perform any of the aforementioned operations. Software may be embodied as a software package, code, instructions, instruction sets and/or data recorded on non-transitory computer readable storage medium. Firmware may be embodied as code, instructions or instruction sets and/or data that are hard-coded (e.g., nonvolatile) in memory devices.

As used in any aspect herein, the terms "component," "system," "module" and the like can refer to a computer-related entity, either hardware, a combination of hardware and software, software, or software in execution.

As used in any aspect herein, an "algorithm" refers to a self-consistent sequence of steps leading to a desired result, where a "step" refers to a manipulation of physical quantities and/or logic states which may, though need not necessarily, take the form of electrical or magnetic signals capable of being stored, transferred, combined, compared, and otherwise manipulated. It is common usage to refer to these signals as bits, values, elements, symbols, characters, terms, numbers, or the like. These and similar terms may be associated with the appropriate physical quantities and are merely convenient labels applied to these quantities and/or states.

A network may include a packet switched network. The communication devices may be capable of communicating with each other using a selected packet switched network communications protocol. One example communications protocol may include an Ethernet communications protocol which may be capable permitting communication using a Transmission Control Protocol/Internet Protocol (TCP/IP). The Ethernet protocol may comply or be compatible with the Ethernet standard published by the Institute of Electrical and Electronics Engineers (IEEE) titled "IEEE 802.3 Standard", published in December 2008 and/or later versions of this standard. Alternatively or additionally, the communication devices may be capable of communicating with each other using an X.25 communications protocol. The X.25 communications protocol may comply or be compatible with a standard promulgated by the International Telecommunication Union-Telecommunication Standardization Sector (ITU-T). Alternatively or additionally, the communication devices may be capable of communicating with each other using a frame relay communications protocol. The frame relay communications protocol may comply or be compatible with a standard promulgated by Consultative Committee for International Telegraph and Telephone (CCITT) and/or the American National Standards Institute (ANSI). Alternatively or additionally, the transceivers may be capable of communicating with each other using an Asynchronous Transfer Mode (ATM) communications protocol. The ATM communications protocol may comply or be compatible with an ATM standard published by the ATM Forum titled "ATM-MPLS Network Interworking 2.0" published August 2001, and/or later versions of this standard. Of course, different and/or after-developed connection-oriented network communication protocols are equally contemplated herein.

Unless specifically stated otherwise as apparent from the foregoing disclosure, it is appreciated that, throughout the foregoing disclosure, discussions using terms such as "processing," "computing," "calculating," "determining," "displaying," or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

One or more components may be referred to herein as "configured to," "configurable to," "operable/operative to," "adapted/adaptable," "able to," "conformable/conformed to," etc. Those skilled in the art will recognize that "configured to" can generally encompass active-state components and/or inactive-state components and/or standby-state components, unless context requires otherwise.

Those skilled in the art will recognize that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flow diagrams are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

It is worthy to note that any reference to "one aspect," "an aspect," "an exemplification," "one exemplification," and the like means that a particular feature, structure, or characteristic described in connection with the aspect is included in at least one aspect. Thus, appearances of the phrases "in one aspect," "in an aspect," "in an exemplification," and "in one exemplification" in various places throughout the specification are not necessarily all referring to the same aspect. Furthermore, the particular features, structures or characteristics may be combined in any suitable manner in one or more aspects.

Any patent application, patent, non-patent publication, or other disclosure material referred to in this specification and/or listed in any Application Data Sheet is incorporated by reference herein, to the extent that the incorporated materials is not inconsistent herewith. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

In summary, numerous benefits have been described which result from employing the concepts described herein. The foregoing description of the one or more forms has been presented for purposes of illustration and description. It is not intended to be exhaustive or limiting to the precise form disclosed. Modifications or variations are possible in light of the above teachings. The one or more forms were chosen and described in order to illustrate principles and practical application to thereby enable one of ordinary skill in the art to utilize the various forms and with various modifications as are suited to the particular use contemplated. It is intended that the claims submitted herewith define the overall scope.

What is claimed is:

1. An underwater drilling assembly, comprising:
a drill assembly;
a connection flange assembly configured to be attached to a ship skin by the drill assembly, wherein the connection flange assembly comprises a plurality of guide tabs; and
a frame supporting the drill assembly, wherein the frame comprises:
a lower platform comprising attachment legs extending therefrom, wherein the attachment legs are configured to attach the underwater drill assembly to a ship skin, and wherein each attachment leg comprises:
a fluidic actuator comprising an output shaft;
an expandable leg assembly attached to the output shaft;
a suction cup base attached to the expandable leg assembly by way of a ball and socket joint; and
a guide flange comprising a slot configured to receive one of the guide tabs of the connection flange assembly.

2. The underwater drilling assembly of claim 1, wherein the expandable leg assembly comprises:
an upper leg portion attached to and translatable by the output shaft; and
a lower leg portion spring loaded against the upper leg portion to permit a retraction movement of the upper leg portion relative to the lower leg portion upon retraction of the output shaft.

3. The underwater drilling assembly of claim 2, wherein the expandable leg assembly further comprises an outer housing comprising a slot defined therein, and wherein the lower leg portion comprises a plunger attached to the lower leg by way of a pin, and wherein the pin extends radially outward from the plunger and is received within the slot.

4. The underwater drilling assembly of claim 3, wherein the outer housing is fixedly attached to the lower platform.

5. The underwater drilling assembly of claim 4, wherein the connection flange assembly comprises a guide fin, wherein the outer housing comprises a guide bracket extending from a lower end of the outer housing, wherein the guide bracket comprises a slot, and wherein the guide fin is positionable within the slot to guide the frame relative to the connection flange assembly.

6. The underwater drilling assembly of claim 2, wherein the lower leg portion comprises a plunger, wherein the plunger comprises a head slidably supported within the upper leg portion, and wherein a coil spring is positioned between the head and a bottom of the upper leg portion.

7. The underwater drilling assembly of claim 1, wherein the fluidic actuator comprises a hydraulic actuator.

8. The underwater drilling assembly of claim 1, wherein the lower leg portion comprises a ball portion extending therefrom, wherein the suction cup base comprises a socket, and wherein the ball portion is positioned within the socket.

9. An underwater drilling assembly frame, comprising:
a frame; and
a plurality of legs configured to secure the frame to a ship skin, wherein each leg comprises:
a suction cup base;
a piston;
an outer column fixedly attached to the frame;
an inner column positioned within the outer column, wherein the inner column comprises:
an upper tube fixedly attached to the piston; and
a lower leg vertically constrained relative to the suction cup base, wherein the piston is actuatable to expand the upper tube relative to the lower leg to pull the upper tube away from the ship skin.

10. The underwater drilling assembly frame of claim 9, wherein the lower leg is spring loaded against the upper tube.

11. The underwater drilling assembly frame of claim 10, wherein the outer column comprises a slot defined therein, and wherein the lower leg comprises a plunger attached to the lower leg by way of a pin, and wherein the pin extends radially outward from the plunger and is received within the slot.

12. The underwater drilling assembly frame of claim 11, further comprising a flange mountable to the ship skin, wherein the flange comprises a guide fin, wherein the outer column comprises a guide bracket extending from a lower end of the outer column, wherein the guide bracket comprises a slot, and wherein the guide fin is positionable within the slot to guide the frame relative to the flange.

13. The underwater drilling assembly frame of claim 10, wherein the lower leg comprises a plunger, wherein the plunger comprises a head slidably supported within the upper tube, and wherein a coil spring is positioned between the head and a bottom of the upper tube.

14. The underwater drilling assembly frame of claim 9, wherein the piston is actuatable by a hydraulic actuator.

15. The underwater drilling assembly frame of claim 9, wherein the lower leg comprises a ball extending therefrom, wherein the suction cup base comprises a socket, and wherein the ball is positioned within the socket.

16. A method for attaching an underwater drilling assembly to a ship skin, wherein the underwater drilling assembly comprises a frame, a drill assembly attached to the frame, and a connection flange assembly comprising a gasket, wherein the frame comprises a plurality of legs, wherein each leg comprises a suction cup base and an expandable leg assembly, the method comprising:
lowering the underwater drill assembly onto a ship skin and pressing the gasket against the ship skin to provide a seal against the ship skin with the connection flange assembly;
positioning each suction cup base of the plurality of legs against the ship skin;
initiating a suction force to secure each suction cup base to the ship skin;
actuating a fluidic actuator of each leg to pull an upper leg portion of the expandable leg assembly of each leg to increase a holding force of the plurality of legs;
attaching the connection flange assembly to the ship skin; and
drilling a hole in the ship skin.

17. The method of claim 16, wherein actuating the fluidic actuator of each leg to pull the upper leg portion of the expandable leg assembly of each leg comprises pulling the upper leg portion upwardly relative to the ship skin and a lower leg portion of the expandable leg assembly.

18. The method of claim 17, wherein actuating the fluidic actuator of each leg to pull the upper leg portion of the expandable leg assembly of each leg comprises applying a pulling force to the suction cup base which is less than a suction force applied by the suction cup base.

19. The method of claim 16, the method further comprising actuating a spring mechanism within the legs to permit independent vertical movement of each leg relative to the ship skin.

* * * * *